US010507377B2

(12) United States Patent
Sicking

(10) Patent No.: US 10,507,377 B2
(45) Date of Patent: Dec. 17, 2019

(54) SPORTS WALL ASSEMBLY

(71) Applicant: Dean L. Sicking, Indian Springs Village, AL (US)

(72) Inventor: Dean L. Sicking, Indian Springs Village, AL (US)

( * ) Notice: Subject to any disclaimer, the term of this patent is extended or adjusted under 35 U.S.C. 154(b) by 0 days.

(21) Appl. No.: 15/962,373

(22) Filed: Apr. 25, 2018

(65) Prior Publication Data

US 2018/0318700 A1 Nov. 8, 2018

Related U.S. Application Data

(60) Provisional application No. 62/500,438, filed on May 2, 2017, provisional application No. 62/615,331, filed on Jan. 9, 2018.

(51) Int. Cl.

| | |
|---|---|
| ***A63C 19/08*** | (2006.01) |
| ***A63B 71/02*** | (2006.01) |
| *E01C 13/12* | (2006.01) |
| *A63C 19/10* | (2006.01) |

(52) U.S. Cl.

CPC ..... *A63C 19/08* (2013.01); *A63B 71/022* (2013.01); *A63C 19/10* (2013.01); *A63C 2019/085* (2013.01)

(58) Field of Classification Search

CPC ..... A63C 19/00; A63C 19/08; A63C 19/10; A63C 2019/085; E01C 13/12; E01C 13/003

USPC ..... 472/88–92, 94; 256/1, 24–26

See application file for complete search history.

(56) References Cited

U.S. PATENT DOCUMENTS

| | | | | |
|---|---|---|---|---|
| 3,883,120 | A * | 5/1975 | Tippmann | E04H 17/16 256/24 |
| 4,883,267 | A | 11/1989 | Burley | |
| 4,905,970 | A | 3/1990 | Holmsten et al. | |
| 5,820,470 | A * | 10/1998 | Saunders | A63C 19/00 472/92 |
| 6,004,217 | A | 12/1999 | Johnston et al. | |
| 6,155,022 | A | 12/2000 | DeCanio et al. | |
| 6,783,461 | B2 | 8/2004 | Frazier et al. | |
| 9,091,091 | B2 | 7/2015 | Sicking et al. | |
| 10,279,244 | B2 | 5/2019 | Kapsalis | |

(Continued)

FOREIGN PATENT DOCUMENTS

CA 2 770 978 A1 9/2012

*Primary Examiner* — Kien T Nguyen

(74) *Attorney, Agent, or Firm* — Studebaker & Brackett PC

(57) ABSTRACT

Rate of deceleration is an important factor in determining the severity of injuries possibly sustained when participants collide with a wall assembly while playing, for example, ice hockey. Decreasing the rate of deceleration of the participant during such a collision with a wall assembly, by extending the distance over which a participant decelerates, is a key factor in reducing head and spinal injuries. The present disclosure provides apparatuses for decreasing the rate of deceleration by providing a wall assembly having a moveable piece that includes a first position and a plurality of second positions with a bias of the moveable piece to the first position. The movable wall assembly can move independently of a support frame, thereby further decreasing the rate of deceleration of a participant in a collision. The movable wall assembly can be supported on a base and slidable with respect to the base.

34 Claims, 64 Drawing Sheets

(56) References Cited

U.S. PATENT DOCUMENTS

| | | | |
|---|---|---|---|
| 2003/0119591 | A1 | 6/2003 | Frazier et al. |
| 2013/0040745 | A1 | 2/2013 | Kapsalis et al. |

* cited by examiner

SPORTS WALL ASSEMBLY

CROSS-REFERENCE TO RELATED APPLICATIONS

This application claims the benefit of priority to U.S. Provisional Patent Application No. 62/500,438, filed on May 2, 2017, and U.S. Provisional Patent Application No. 62/615,331, filed on Jan. 9, 2018, the contents of which are hereby incorporated by reference in their entirety.

TECHNICAL FIELD

This disclosure relates to playing or activity surfaces surrounded by a wall. The wall can be described as an assembly of boards.

BACKGROUND

Some types of sporting activities, such as, for example, hockey, arena football, soccer, etc., are played on an activity surface or playing field that is surrounded by a wall configured to contain the activity and participants on or near the activity surface or playing field, such as a playing field, hockey rink, skating rink, etc. Containment of the activity can include assisting to keep a ball, puck, or participant in the bounds or confines of the activity surface or playing field or near the bounds or confines of the activity surface or playing field. Participants can include individuals, players of a game, and/or competitors in a match. The wall can also be configured to protect spectators of the activity. Accordingly, the wall can be described as a protective wall, containment wall, sport wall, or other, similar terms.

One application of the sport, protective, or containment wall is in the sport of hockey, in which the wall is sometimes referred to as boards. While the wall can be described in the singular because the wall can extend entirely around a periphery of the activity surface or playing field, such as, for example, an ice rink, the wall can be formed of a plurality of individual segments or units positioned adjacent or alongside each other to form a continuous wall of segments. It should be understood that such wall segments can include entry and exit locations or points, such as doors, and such wall segments may not entirely surround the activity surface or playing field. Some walls can support a translucent or transparent material, for example, glass, or plastic, which serves to shield spectators while also allowing them to observe the playing or activity surface.

SUMMARY

This disclosure provides a wall assembly comprising a support assembly, a movable wall assembly, and a plurality of shock absorbers positioned between the support assembly and the movable wall assembly. Each of the plurality of shock absorbers stores energy when a force is exerted upon the movable wall assembly by an object such that the movable wall assembly moves from a first position to one of a plurality of second positions to cause deceleration of the object over a distance. Further, the plurality of shock absorbers move the movable wall assembly from the one of the plurality of second positions to the first position by releasing energy when the force is removed.

This disclosure also provides a wall assembly comprising a base, a friction modifying element positioned on the base, and a movable wall assembly positioned on the friction modifying element. The movable wall assembly is movable with respect to the base when a force is exerted upon the movable wall assembly by an object such that the movable wall assembly moves from a first position to one of a plurality of second positions to cause deceleration of the object over a distance. Additionally, the movable wall assembly is biased to move the movable wall assembly from the one of the plurality of second positions to the first position when the force is removed.

This disclosure also provides a wall assembly comprising a base, a moveable wall assembly, and a plurality of shock absorbers positioned between the base and the moveable wall assembly. The moveable wall assembly includes a base interface that includes a curvilinear surface positioned on the base. When a force is applied to the moveable wall assembly, the moveable wall assembly moves along the curvilinear surface from a first position to one of a plurality of second positions, storing energy in the plurality of shock absorbers. When the force is removed from the moveable wall assembly, the stored energy in the plurality of shock absorbers moves the moveable wall assembly from the one of the plurality of second positions to the first position.

Advantages and features of the embodiments of this disclosure will become more apparent from the following detailed description of exemplary embodiments when viewed in conjunction with the accompanying drawings.

DETAILED DESCRIPTION

Figure 1:
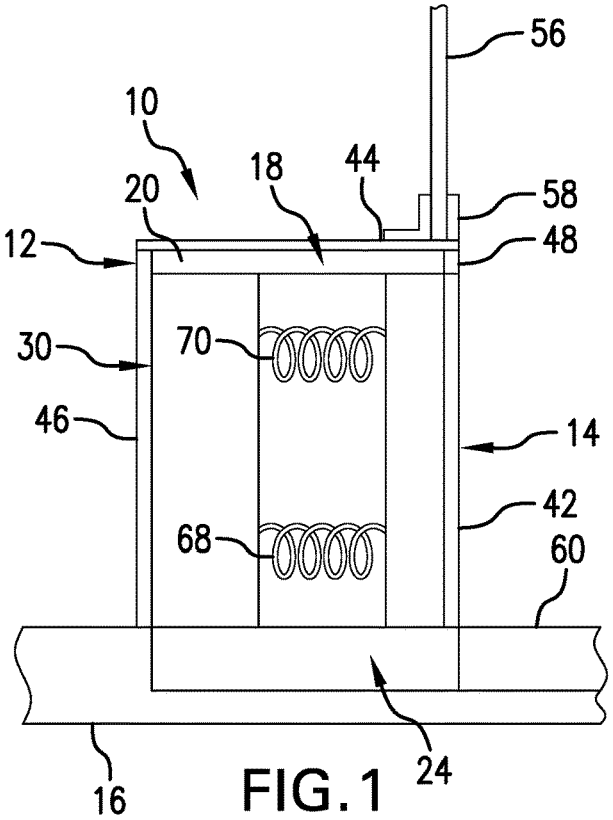
FIG. 1 shows a view of a wall assembly in accordance with an exemplary embodiment of the present disclosure.

While conventional board designs serve their purpose of game containment and visibility, the inventor appreciated that injuries resulting from collisions between participants and boards, such as head trauma, concussion, orthopedic damage, spinal cord injury, paralysis, including quadriplegia, and death, can be reduced by addressing a sudden deceleration of a participant impacting the boards.

The inventor also appreciated that lengthening the time of the impact would lessen, reduce, or decrease the rate of deceleration experienced by the participant, and the lessened, reduced, or decreased rate of deceleration would reduce the magnitude or severity of any injury caused by impacting or hitting the wall. To this end, the inventor created structures designed to reduce the rate of deceleration of an activity participant by increasing the distance over which such a deceleration occurs. Lengthening the distance of deceleration reduces deceleration g-forces experienced by the participant, and thus reduces the severity of injuries as compared to existing wall or board designs. To achieve the decreased rate of deceleration, the inventor determined that, in an exemplary embodiment, deceleration over a distance such as, for example, at least 8 inches, preferably at least 10 inches, and more preferably at least 12 inches, or a deceleration distance range of 8-12 inches, would significantly lessen the rate of deceleration of the participant.

In addition to concerns regarding head trauma from impacting a board, resulting compressive forces in the neck are a mechanism by which burst fracture of vertebrae occurs in the neck. Such an injury mechanism is a common cause for quadriplegia in ice hockey.

For example, tripping a hockey player skating at a relatively high speed, such as, for example, 3-12 miles per hour, or more, toward a goal in front of the boards, or pushing the player head-first into the boards, can create high compressive forces in the player's neck due to a combination of the speed of the player and weight of the player. In some circumstances, the weight and speed of other players can contribute to compressive forces. The compressive forces can be sufficient to cause a burst fracture of the participant or player's vertebra. Therefore, limiting the peak compressive forces upon impact in parts of the participant's body, for example, in the neck, would decrease the risk of injury and/or the severity of injury. However, the inventor determined that existing walls or boards have a mass with too much inertia to prevent catastrophic injuries, such as those described herein, because they cannot limit the maximum peak neck load imparted by the wall or boards to 4 kN (900 pounds) or less to reduce or decrease severity of serious injury and to increase participant safety. Indeed, testing with anthropomorphic or human-shaped dummies has shown that, even with a free standing wall panel weighing 100 pounds, the dynamic impact load on a participant's neck would be well above the 4 kN target value.

The inventor further determined by computer simulation and full scale testing with anthropomorphic dummies that neck compression begins to drop off significantly during impact of a head with a surface such as a wall when the neck bends and is no longer aligned with rest of the participant's spine. Accordingly, the inventor has designed a wall assembly that can limit the forces on a participant's neck to 4 kN or less and aid in rotation of the head to bend the neck sufficiently to reduce compressive load on the neck, decreasing the risk and severity of injuries from the force of a head hitting the wall or boards.

As noted hereinabove, the inventor also realized that another factor affecting the severity of participant injuries is the length of deflection, "stroke," or movement of a board, that is, the distance an impacted face of a board, i.e., an "impact face," can deflect or move before the energy from the participant is dissipated. In an exemplary embodiment, the wall assembly can be designed or configured to absorb most of the participant's impact energy during movement of the wall from a first, initial, start, base, or beginning position to a second, ending, terminal, or deflected position while stopping movement of the participant. In the hockey example provided hereinabove, for a 200 pound player traveling 12 mph, the board stroke, displacement, movement, or deflection in the direction outward or away from the rink in response to the component of the player's movement in that direction, is preferably at least about 8 inches, more preferably at least about 10 inches, even more preferably at least about 12 inches, to stop the participant before the available deflection, displacement, stroke, or movement of the wall is exhausted, ended, terminated, finished, completed, or stopped, where higher speeds preferably have larger deflections available to stop a player over longer distances to decrease the rate of deceleration. As described hereinabove, the preferable wall design or configuration is such that the participant's head rolls or rotates as the wall displaces, deflects, or moves to reduce the risk of a burst fracture of cervical vertebrae and the risk of quadriplegia associated therewith. Testing using dummies and computer modeling have shown that the disclosed deflection, stroke, displacement, or movement in the range of 8-12 inches described hereinabove, is sufficient to allow the participant's head to rotate or roll as described hereinabove to reduce or limit injuries from contact of the participant's head with a wall while moving at the speeds described hereinabove.

In addition to the disclosed features, after a collision, the wall segment or board is designed or configured to restore or substantially restore to its original position without functionally deteriorating, so the game or activity can continue without interruption. Further, the wall segment or board is designed to sustain such collisions or impacts repeatedly and restore to the original position of the wall each time during the lifetime expected of conventional walls.

In an exemplary embodiment, the inventor's design imagines a wall with a rigid back support frame and a front wall that, upon impact of a projectile, such as a participant, player, or competitor, moves with respect to the back support frame and restores to its pre-impact position after withdrawal or deflection of the projectile from the wall. With this approach, the mass of each front wall section can be reduced to less than 50 pounds, which decreases inertia as compared to the inertia of conventional walls. Reducing the inertia of the front wall can facilitate keeping impact loads experienced by the projectile to 4 kN or less. It should be noted that 50 pounds is a preferred upper limit, i.e., the maximum, for the weight of any of the movable wall assemblies described herein. While the weight of any of the movable wall can be greater than 50 pounds, the greater the weight or mass, the greater the impact load experienced by a projectile, such as a human head, the greater the risk of serious injury. Accordingly, in another embodiment, the weight or mass of the movable wall can be 55 pounds or less. In yet a further embodiment, the weight or mass of the movable wall can be 60 pounds or less.

Figure 2:
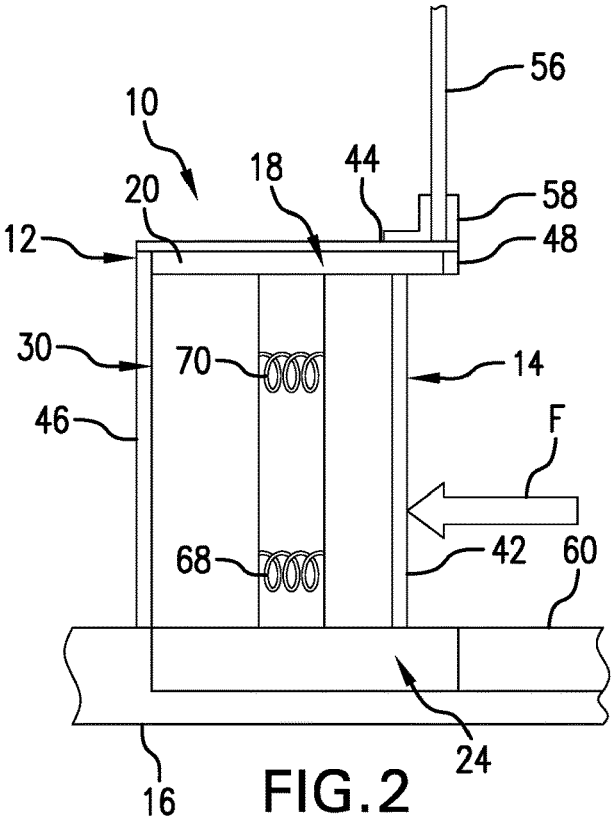
FIG. 2 shows another view of the wall assembly of FIG. 1.
Figure 3:
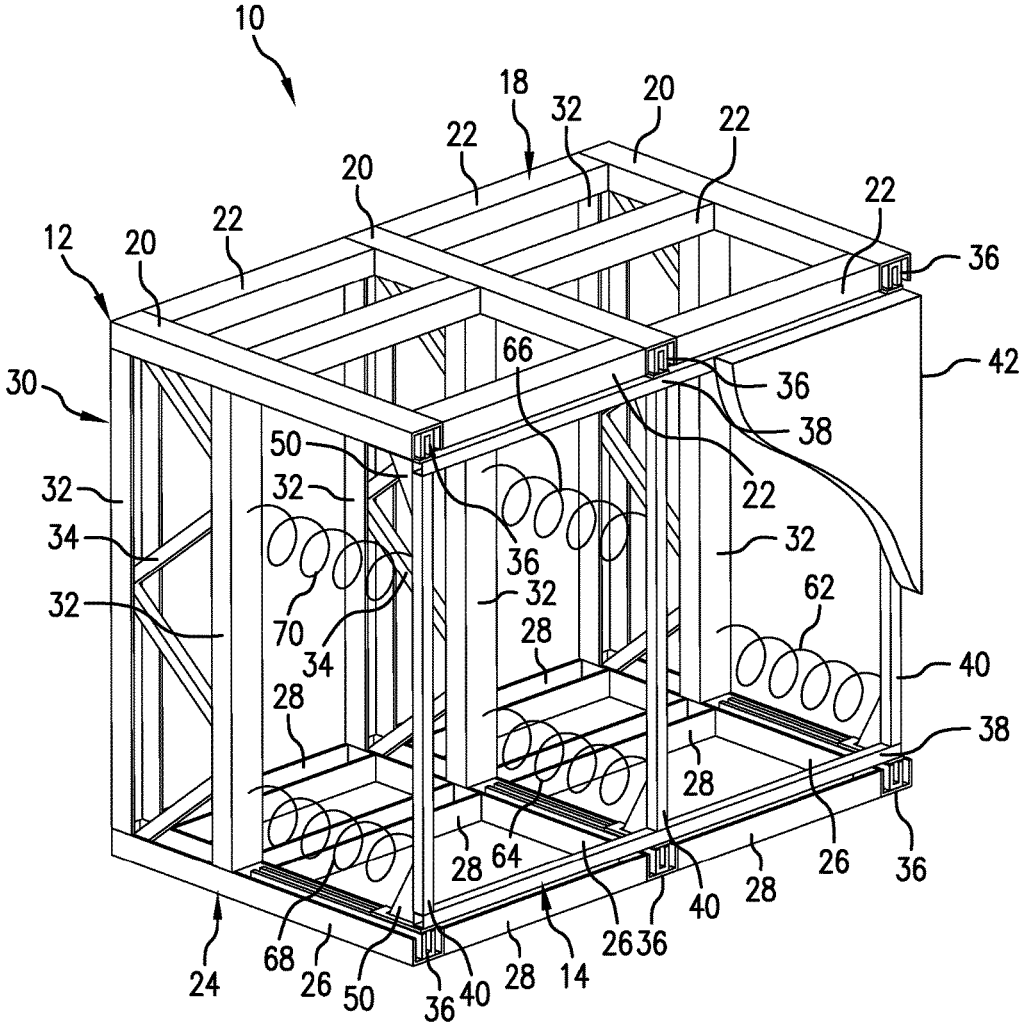
FIG. 3 shows a view of an exemplary configuration of portions of the wall assembly of FIG. 1.

Turning to FIGS. 1-3, a wall assembly, indicated generally at 10, in accordance with an exemplary embodiment of the present disclosure is shown. It should be understood that wall assembly 10 can also be described as wall segment 10 or board 10. Thus, an activity surface would generally include a plurality of wall assemblies, wall segments, or boards 10 extending along or around the activity surface, including extending entirely around an activity surface with the exception of, for example, entry and exit locations. Alternatively, one or more wall assemblies can be configured to be movable as an assembly to function as a gate or door for entrance onto the activity surface. In an exemplary embodiment, wall assembly 10 includes a support assembly 12 and a movable board or wall assembly 14 slidably or movably positioned on support assembly 12. Support assembly 12 can be attached or fastened to a base 16, which can be concrete, cement or other suitable material, and which can form a floor of a building (not shown).

As shown in FIG. 3, support assembly 12 can include a plurality of elements, including, for example, a transverse or horizontally extending upper or top frame support 18, which can include a plurality of upper transverse frames 20 that extend in a direction that is approximately perpendicular to a major surface of movable wall assembly 14, and a plurality of upper connecting frames 22 that extend approximately parallel to the major surface of movable wall assembly 14. The major surface can be a surface of a front wall that faces the activity surface or playing field, described in more detail hereinbelow. Upper connecting frames 22 are attached to and extend between adjacent pairs of upper transverse frames 20 to provide strength and stability to upper transverse frames 20. Such attachment can be, for example, by way of fasteners and brackets (not shown), welding, or other attachment devices and mechanisms.

Support assembly 12 can also include a transverse or horizontally extending lower or bottom support frame 24, which can include a plurality of lower transverse frames 26 that extend in a direction that is approximately perpendicular to the major surface of movable wall assembly 14, and a plurality of lower connecting frames 28 that extend approximately parallel to the major surface of movable wall assembly 14. Lower connecting frames 28 are attached to and extend between adjacent pairs of lower transverse frames 26 to provide strength and stability to lower transverse frames 26. Such attachment can be, for example, by way of fasteners and brackets (not shown), welding, or other attachment devices and mechanisms.

Support assembly 12 can also include a vertically extending support frame assembly 30 that is positioned between upper or top support frame 18 and lower or bottom support frame 24. Support frame assembly 30 can include a plurality of vertically extending connecting frames 32 that are attached or connected to upper or top support frame 18 and lower or bottom support frame 24 by way of fasteners, brackets, welding, and the like. Support frame assembly 30 can also include angled brackets 34 to provide support between adjacent vertically extending connecting frames 32.

Each disclosed element of wall assembly 10 that is labeled with an identical number can be identically configured, or each element can be different from each other. For example, some vertically extending connecting frames 32 can be rectangular tubes, and other frames 32 can be U-shaped or V-shaped.

Each upper transverse frame 20 and each lower transverse frame 26 can include a track 36 that is approximately parallel to a respective upper transverse frame 20 or lower transverse frame 26. Thus, each track 36 is also approximately perpendicular to the major surface of movable wall assembly 14. Each track 36 can be integrally formed with each respective upper transverse frame 20 or lower transverse frame 26, or each track 36 can be a separate piece attached, fastened, connected, or otherwise affixed to each respective upper transverse frame 20 or lower transverse frame 26.

Figure 9:
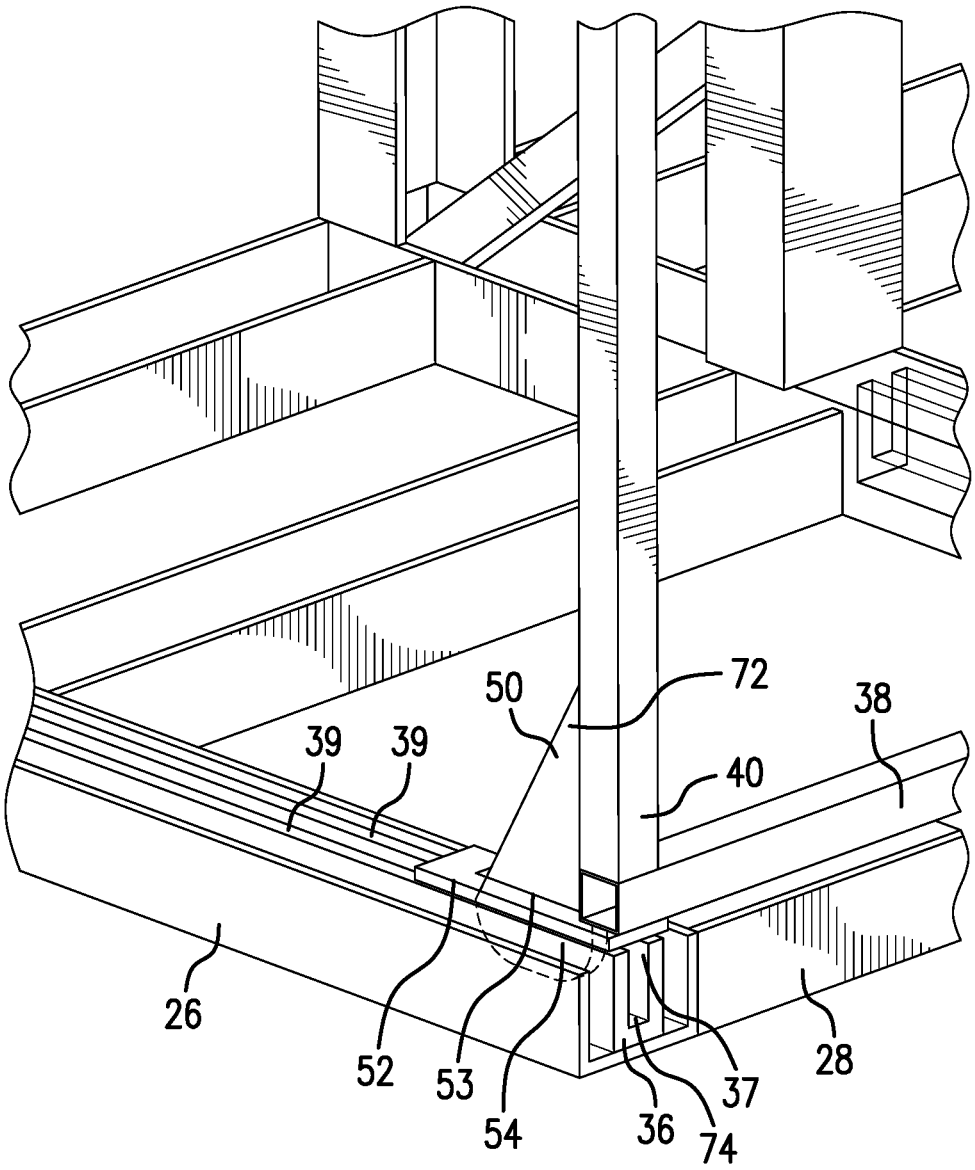
FIG. 9 shows a view of a portion of the wall assembly of FIG. 3.

As shown in FIG. 9, track 36 is U-shaped and includes an upwardly facing slot, groove, or channel 37. Track 36 can include horizontal surfaces 39, adjacent to slot, groove, or channel 37. Horizontal surfaces 39 provide a sliding surface for another component of wall assembly 10, as will be described in more detail hereinbelow. As will be seen, slot, groove, or channel 37 of track 36 guides movable wall assembly 14 between a first position, such as the position shown in FIG. 1, and a second position, such as the position shown in FIG. 2, under the force of an impact, hit, push, or force from, for example, the participant in a sport. Also, as will be seen, track 36 guides movable wall assembly 14 from the second position back to the original first position once the impact, hit, push, or force that caused the movement from the first position to the second position is removed or released. Thus, movable wall assembly 14 is biased to be in the first position. For any particular configuration of wall assembly 10, there is one first position, such as the first position shown in FIG. 1, and a plurality of second positions, such as the second position shown in FIG. 2. The second position is determined by a stroke or deflection resulting from the force applied against movable wall assembly 14 or by the maximum distance that movable wall assembly 14 can move if force applied or exerted against movable wall assembly 14 is such that movable wall assembly 14 moves to a limit of travel.

Support assembly 12 can further include a plurality of caps, covers, or the like to prevent participants and spectators from contacting or entering into an internal volume of wall assembly 10. Such caps or covers, which are mostly removed in FIG. 3 to enable description of the elements of wall assembly 10, can include, as shown in FIGS. 1 and 2, a top cap or cover 44, a back cap or cover 46, and an end cap or cover 48. Each of top cap or cover 44, back cap or cover 46, and end cap or cover 48 can be formed or fabricated from, for example, wood, plastic, composite, or other material suitable for the environment. The thickness of the material depends on the spacing of various frame members, the type of wood used, and the environment, including whether wall assembly 10 is installed within a building or exposed to environmental elements such as rain, snow, sunlight, cold, heat, and the like.

Movable wall assembly 14 includes a plurality of horizontal frame pieces 38 and a plurality of vertical frame pieces 40. Frame pieces 38 and 40 are attached, affixed, or connected to each other by brackets, fasteners, welding, and the like. Movable wall assembly 14 also includes a front wall 42, shown partially removed in FIG. 3, which is attached or connected to frame pieces 38 and 40 by fasteners, brackets, or other attachment hardware or mechanism. Front wall 42 can be made of a material similar to the materials selected for top cap or cover 44, back cap or cover 46, and end cap or cover 48, or another material suitable for the anticipated impacts and force from participants on the activity field.

Figure 10:
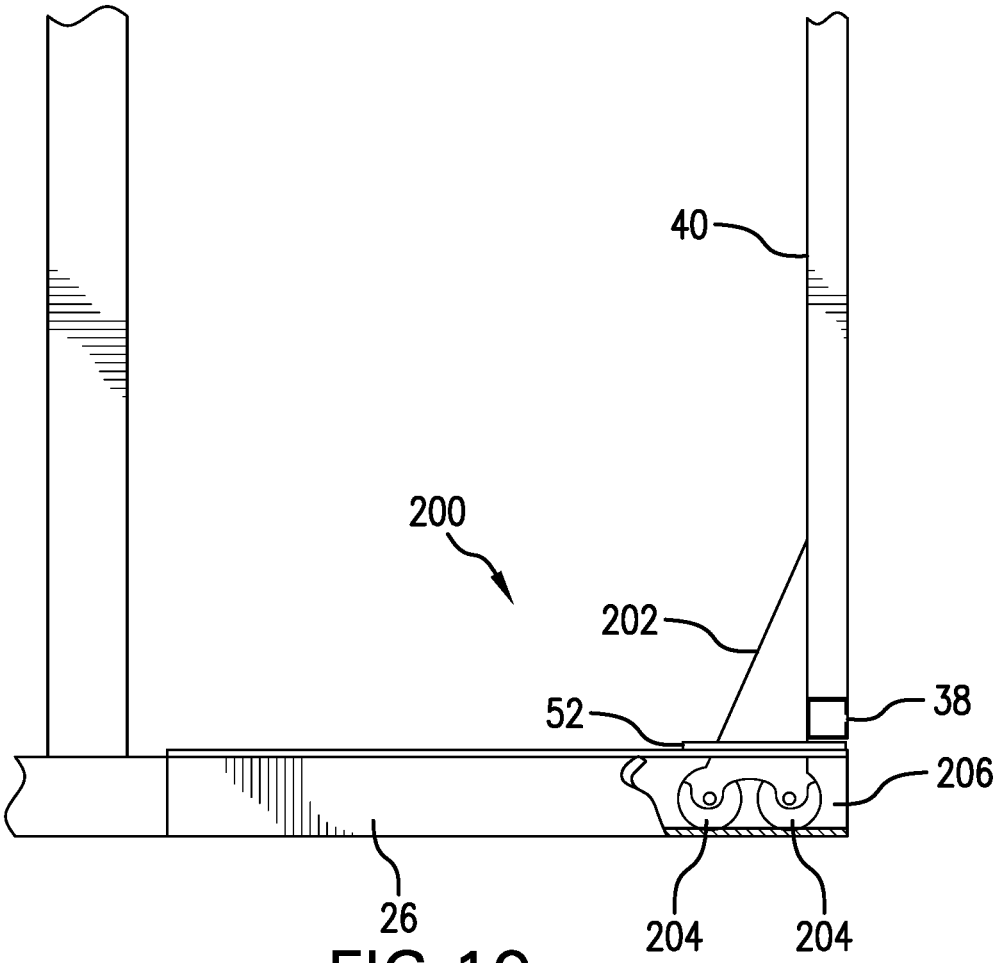
FIG. 10 shows a simplified view of a wall assembly in accordance with a still further exemplary embodiment of the present disclosure.

Movable wall assembly 14 also includes a plurality of plates 50, shown in more detail in FIGS. 9 and 10, each of which is attached to a respective vertical frame piece 40 near a top of each of vertical frame piece 40 and near a bottom of each vertical frame piece 40. Each plate 50 includes an end 54 that can be curvilinear and sized and dimensioned to slide within slot, groove, or channel 37 of track 36. In another exemplary embodiment, only vertical frame pieces 40 at either end of movable wall assembly 14 include a plate 50 near the top and bottom and a vertical frame piece 40 near a horizontal center of movable wall assembly does not include any plate 50. Plate 50 can be described as a knife plate 50 because of the overall shape of plate 50.

Wall assembly 10 further can include a plurality of horizontal slide plates 52. Each slide plate 52 is positioned at a location that is directly between horizontal surfaces 39 of slot, groove, or channel 37 and a bottom of movable wall assembly 14, such as a bottom of horizontal frame 38. Each slide plate 52 includes an opening 53 that can be rectangular. End 54 of an associated knife plate 50 extends through opening 53 and then into slot, groove, or channel 37. Knife plate 50 is positioned on vertical frame 40 and sized and dimensioned such that end 54 is above a bottom surface 74 of slot, groove, or channel 37 in any position of movable wall assembly 14. In other words, end 54 does not contact bottom surface 74 of slot, groove, or channel 137. When movable wall assembly 14 is in the first position shown in FIG. 1, slide plate 52 may support the weight of movable wall assembly 14.

Turning now to FIG. 9, plate 50, can constitute a single plate or piece of, for example, wood, metal, plastic, composite, or any other rigid material that does not easily deform. Plate 50 may be formed to have one substantially triangular end or portion 72, which is attached to, connected to, positioned on, or mounted on vertical frame 40, that is on an opposite end of plate 50 from end 54, which can be substantially rounded (shown in FIG. 9 with a dashed line). It should be understood that the configuration of track 36, plate 50, horizontal plate 52, and associated features can be the same at the top of movable wall assembly adjacent to respective upper transverse frames 20 as disclosed hereinabove with respect to lower transverse frames 26.

The configuration of track 36, plate 50, horizontal plate 52, and associated features can modify the static and dynamic coefficients of friction between movable wall assembly 14 and support assembly 12. Such a modification of friction reduces the force initially required to displace movable wall assembly 14 when a participant impacts or hits movable wall assembly 14, which can reduce risk and severity of injury as discussed hereinabove.

Figure 5:
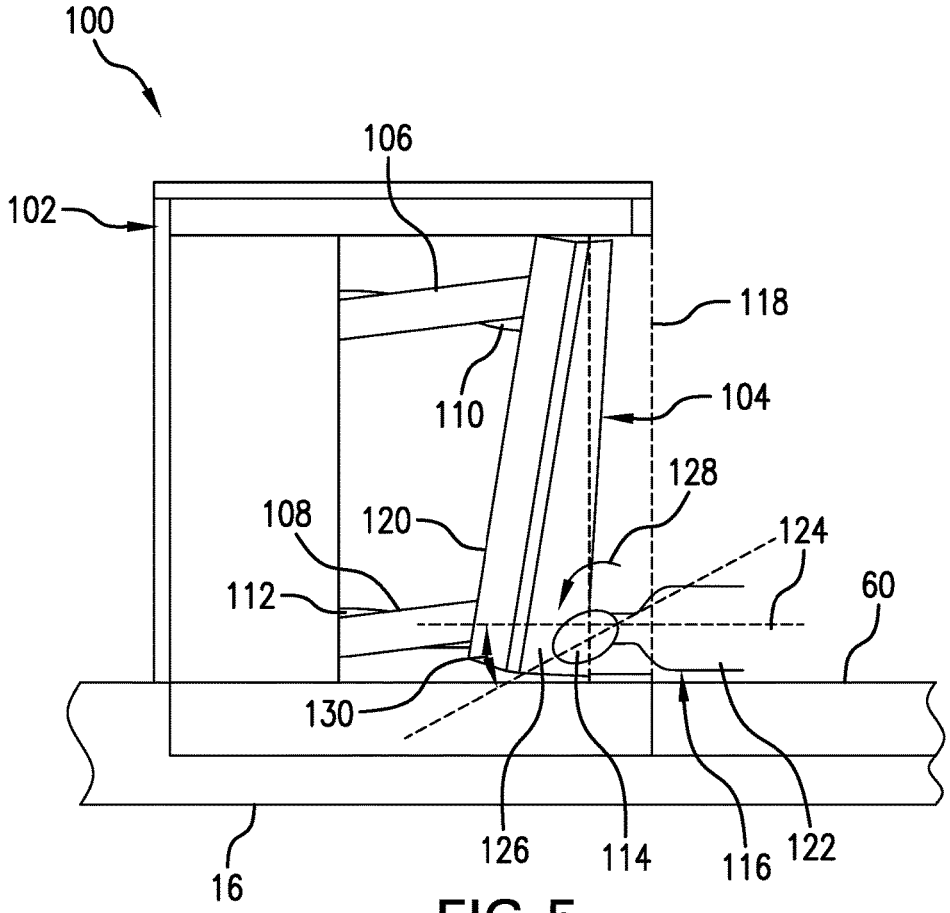
FIG. 5 shows a view of a wall assembly in accordance with another exemplary embodiment of the present disclosure.

In another exemplary embodiment, and as shown schematically in FIG. 10, movable wall assembly 14 can be slidingly or movably connected to support assembly 12 by a plate assembly 200 that includes a plate 202, which can be similar to plate 50 disclosed hereinabove, and which can be attached at one end to vertical frame piece 40 of movable wall assembly 14. The opposite or other end of plate 202 can be attached to a system of carriage wheels 204 that are positioned in a carriage track, slot, or groove 206, each of which is formed in a respective lower transverse frame 26, and which is shown partially cut away in FIG. 10. As movable wall assembly 14 is deflected or moved under the forces described herein, carriage wheels 204 move along carriage track 206 as movable wall assembly 14 moves from the first position, such as that shown in FIG. 1, to the second position, such as that shown in FIG. 2, or as shown in FIG. 5.

As shown in, for example, FIGS. 1 and 2, wall assembly 10 can also include a vertically extending glass or plastic sheet 56 supported by brackets or other support 58. Glass or plastic sheet 56 is typically sufficiently transparent that light readily passes through glass or plastic sheet 56 to enable viewing through glass or plastic sheet 56.

Wall assembly 10 can be positioned on base 16 such that an activity surface 60 is approximately at a bottom of movable wall assembly 14, i.e., flush with the bottom of movable wall assembly 14, and a top of lower connecting frames 28 adjacent to movable wall assembly 14. Activity surface 60 can be an upper surface of, for example, ice, a playing field, and the like. In an alternative embodiment, the bottom of movable wall assembly 14 can be below or lower than activity surface 60.

In an exemplary embodiment, a plurality of shock absorbers 60-70 are each positioned between and connected to support assembly and movable wall assembly 14. In another exemplary embodiment, movable wall assembly 14 can be connected to support assembly 12 by upper connecting frames 22 in addition to shock absorbers 60-70.

As noted hereinabove, some elements of wall assembly 10 can be made of any suitable material capable of withstanding the impacts of a hockey game or similar sporting event. For example, in one exemplary embodiment, various frames elements can be made of a suitable wood. In another exemplary embodiment, such frame elements can be produced of a plastic such as PVC. Frame elements can include chrome molybdenum steel, aluminum, copper, or other suitable metal. One suitable type of chrome molybdenum steel might be SAE 4142. It is envisioned that a wide range of suitable materials may be used for such support elements consistent with the teachings of this disclosure.

Upper transverse frames 20, upper connecting frames 22, lower transverse frames 26, lower connecting frames 28, vertically extending support frames 30, connecting frames 32, and angled brackets 34 can be formed in a variety of shapes. For example, such elements may constitute rectangular planks or boards. In another exemplary embodiment, such elements may constitute tubes or filled cylinders. The shape of such elements may be based in part on the material chosen to form such support elements. In an exemplary embodiment, elements 20, 22, 26, 28, 30, 32, and 34 can be formed of wooden planks or boards. In another exemplary embodiment, elements 20, 22, 26, 28, 30, 32, and 34 can be formed of hollow PVC tubes. The embodiments disclosed herein are exemplary in that they are representative of a range of embodiments that would be achievable from the teachings provided herein.

In a preferred embodiment, the material of front wall 42 can be, for example, plastic or composite, which may be thinner than conventional front faces to achieve the desired weight and reduced inertia as disclosed herein. By reducing the thickness of the front panel to 0.25 in, the front panel weight can be reduced to less than 35 pounds. In this example, the material of the thinner sheeting may be reinforced with carbon or glass fibers to maintain stiffness, which maintains puck rebound. That is, stiffening fibers may help maintain puck rebound without increasing the inertia of front wall 42.

In operation, wall assembly 10 responds to impacts or force on front wall 42, as shown in FIGS. 1 and 2. Movable wall assembly 14 is positioned as shown in FIG. 1 by the force of shock absorbers 60-70, which can be pneumatic, hydraulic, or mechanical shock absorbers, e.g., springs. Wall assembly 10 can include one or more stops (not shown) to fix the location of movable wall assembly 14 in the first, uncompressed position. Such stops can be integral to, for example one or more tracks 36 or upper transverse frames 20 and lower transverse frames 26. The stops can also be a separate components attached to one or more tracks 36 or upper transverse frames 20 and lower transverse frames 26. Mechanical stops can also be provided to limit the extent of movement or deflection that results from a force applied to movable wall assembly 14.

Upon impact or other force to front wall 42 as shown by arrow F, shock absorbers 60-70 are compressed by storing a portion of the energy from force F, and movable wall assembly 14 is displaced from the initial or first position shown in FIG. 1 backwards or away from activity surface 60 and toward support assembly 12. In an exemplary embodiment, support assembly 12 does not move from its initial position because support assembly 12 is fixed to base or floor 16. In another exemplary embodiment, support assembly 12 may be configured to also be displaced upon impact to front wall 42 and/or upper or top support frame 18, as discussed hereinbelow in more detail.

In an exemplary embodiment, shock absorbers 60-70 can be an array of springs positioned between and connected or attached to movable wall assembly 14 and support assembly 12. However, any shock absorber designed or capable of being tuned to absorb impacts on front wall 42 and sufficiently increase the distance of deceleration can be used. For example, hydraulic or pneumatic dampers, stabilizers, and damping coils, or a combination thereof, may be used as shock absorbers 60-70.

In an exemplary embodiment, movable wall assembly 14 can be attached or connected to support assembly 12 by elastomer springs, which are nonlinear and thus produce more energy dissipation without higher compressive forces than conventional coil springs. As an example, the spring constant of an elastomer spring may be approximately 8 pounds/inch, so that using four springs would produce a total spring force on movable wall assembly 14 of about 800 pounds with a stroke of 10 inches. In such an embodiment, four elastomer springs may be wound to have an initial tension of approximately 100 pounds, such that the pre-loaded force on the panel is approximately 400 pounds.

Rotation of a participant's head, as discussed above, may be induced by providing a lower stiffness (or spring constant) on one side of movable wall assembly 14 as compared to an opposite side of movable wall assembly. The low stiffness side may be swapped back and forth from one panel to the next in order to make sure that the net stiffness of the joints between adjacent panels is always different for each side of every panel. Thus, in an exemplary embodiment, shock absorbers 60-70 can each have different spring constants.

Figure 4A:
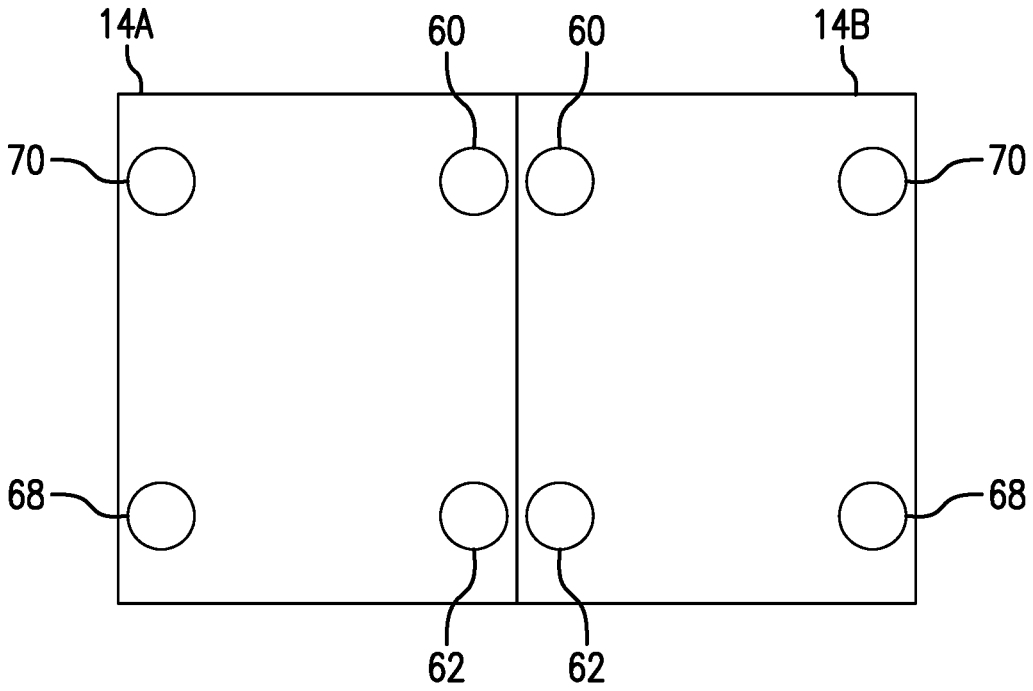
FIG. 4A shows a schematic view of an exemplary configuration of shock absorbers that can be used in the embodiment of FIG. 1.

FIG. 4A shows a schematic representation of adjacent movable wall assembly assemblies 14A and 14B and an exemplary configuration of shock absorbers 60, 62, 68, and 70, which can be used in the embodiment of FIG. 1 without shock absorbers 64 and 66. In such a configuration, each of shock absorbers 60, 62, 68, and 70 can have different spring constants. For example, shock absorbers 68, and 70 can have different spring constants than shock absorbers 60 and 62. In another example, each of shock absorbers 60, 62, 68, and 70 in a single movable wall assembly 14 may have a different spring constant, such that each shock absorber 60, 62, 68, and 70 has its own unique spring constant.

As shown in FIG. 4A, the configuration of shock absorbers 60, 62, 68, and 70 in movable wall assembly 14A can mirror the configuration of shock absorbers 60, 62, 68, and 70 in adjacent movable wall assembly 14B. In this way, an exemplary wall can include a plurality of wall assemblies 10 or movable wall assembly assemblies 14 such that adjacent wall assemblies 10 or movable wall assembly assemblies 14 have mirrored or reflected spring properties.

Although FIG. 4A shows an exemplary embodiment wherein each section of movable wall assembly 14A and 14B includes four shock absorbers 60, 62, 68, and 70, such a configuration should not be seen as limiting. For example, a section of movable wall assembly 14 may include six shock absorbers 60, 62, 64, 66, 68, and 70 (as shown in FIG. 1). Alternatively, wall assembly 10 can include any number of springs to achieve a behavior of movable wall assembly 14 consistent with the teachings of this disclosure.

Figure 4B:
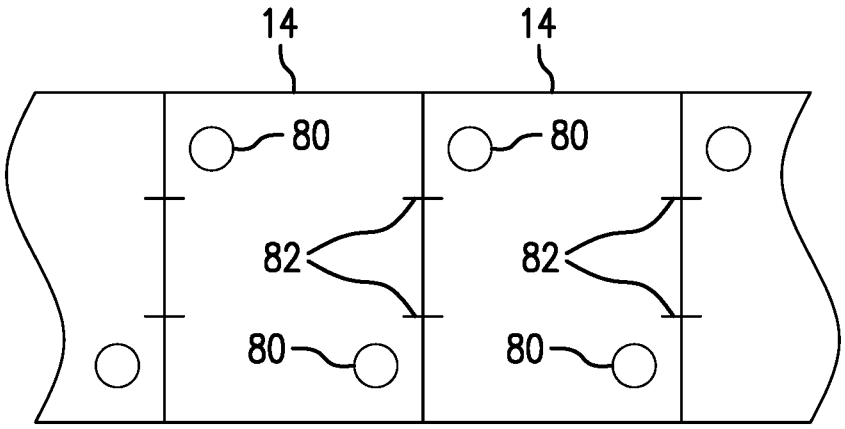
FIG. 4B shows a schematic view of another exemplary configuration of shock absorbers that can be used in the embodiment of FIG. 1.

FIG. 4B shows another exemplary embodiment where each section of movable wall assembly 14 includes diagonally positioned shock absorbers 80, and pins 82 connect adjacent movable wall assemblies 14 to each other. In addition to shock absorbers 80 being diagonally positioned, shock absorbers 80 alternate positions between adjacent walls. In other words, a shock absorber on one movable wall assembly 14 is across from a location that includes no shock absorber on an immediately or directly adjacent movable wall assembly 14. It should be understood that because pins 82 connect adjacent movable wall assemblies 14 together, the force applied to one movable wall assembly 14 will be carried through pins 82 to an adjacent movable wall assembly 14. Indeed, movable wall assemblies 14 are configured to distribute force over four shock absorbers 80. In the example of FIG. 4B, the force applied to one movable wall assembly 14 will be distributed to the two shock absorbers 80 on the impacted wall, and to at least one shock absorber 80 on each wall adjacent to the impacted wall for a total of four shock absorbers. In a situation where the impact is close to a joint or connection between two adjacent movable wall assemblies 14, the impact will be distributed over the four shock absorbers 80 positioned on the two adjacent movable wall assemblies 14.

Referring to FIG. 5, a wall assembly, indicated generally at 100, in accordance with an exemplary embodiment of the present disclosure is shown. Wall assembly 100 includes a support assembly 102, a movable wall assembly 104 positioned on and movable with respect to support assembly 102, base 16, and activity or playing surface 60. A plurality of shock absorbers 106, 108, 110, and 112 are positioned between and connected to support assembly 102 and movable wall assembly 104. Shock absorbers 106,108, 110, and 112 can be biased, for example by springs, pistons, and the like, to position movable wall assembly 104 in an un-deflected position, or to return movable wall assembly 104 to the un-deflected position after the deflecting force is removed. Under the force of an impact on movable wall assembly 104 from, for example, a head 114 of a participant 116, shock absorbers 106, 108, 110, and 112 compress by varying amounts based on a location of impact. As shock absorbers 106, 108, 110, and 112 compress, movable wall assembly 104 moves or deflects from a first position 118 shown in dashed lines to a second position that is directly between first position 118 and shock absorbers 106, 108, 110, and 112.

When head 114 first hits movable wall assembly 104, head 114 can be in line with a body centerline 124 of a body 122 on which head 114 is positioned. If head 114 remains in this orientation, compressive forces are transmitted through head 114 into a spine (not shown) of body 122, which can lead to serious injuries, as described hereinabove. However, while head 114 can hit any location on movable wall assembly 104, head 114 will typically impact movable wall assembly 104 at a point that would cause a corner 126 of movable wall assembly 104 to deflect, move, or stroke more than the remaining corners of movable wall assembly 104. The greater deflection of corner 126, which is shown in an exaggerated manner in FIG. 5, causes head 114 to roll out of alignment with body centerline 124 in a direction 128, thus putting head 114 at an angle 130 with respect to body centerline 124. A combination of rolling head 114 as shown with the decreased rate of deceleration caused by the compression of shock absorbers 106, 108, 110, and 112 until participant 116 comes to a stop decreases the risk and severity of injuries, particularly compressive injuries of the spinal column.

Figure 7:
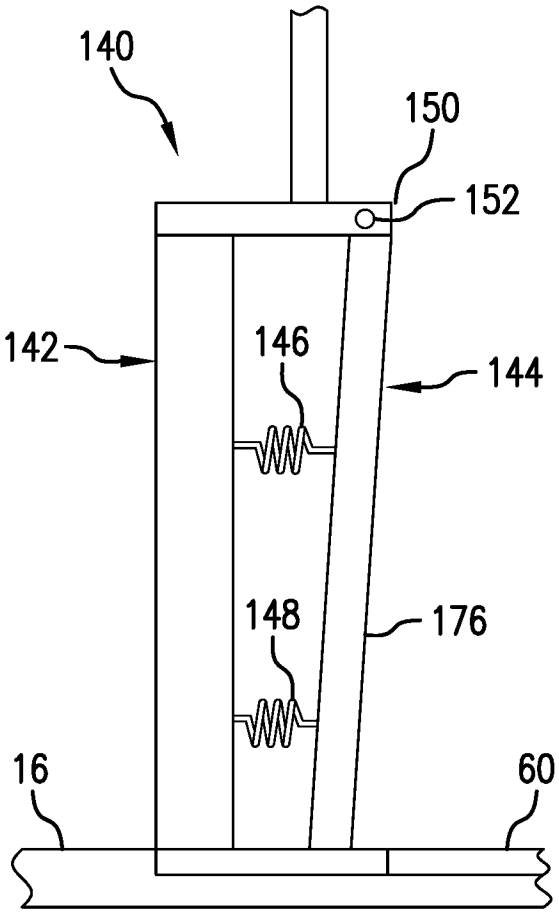
FIG. 7 shows a further view of the wall assembly of FIG. 6.
Figure 6:
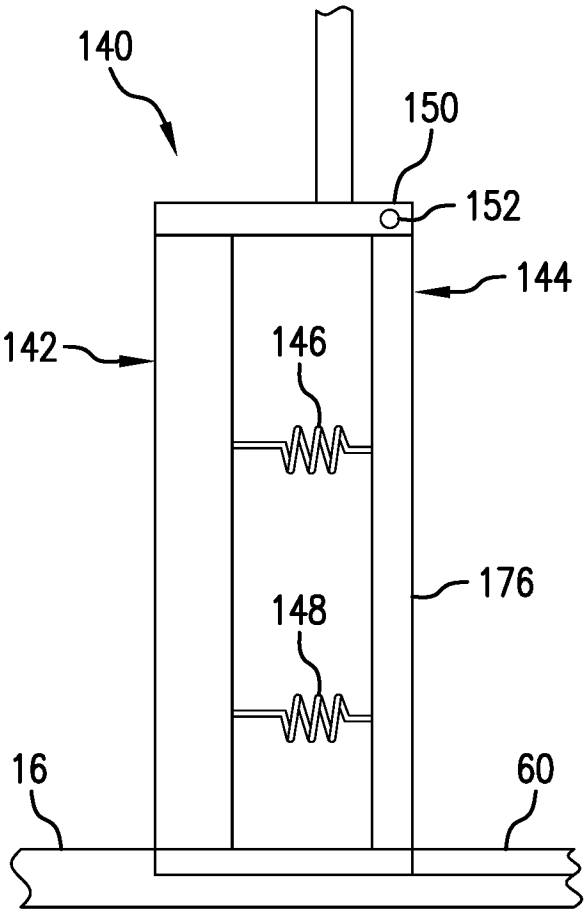
FIG. 6 shows a view of a wall assembly in accordance with yet another exemplary embodiment of the present disclosure.
Figure 8:
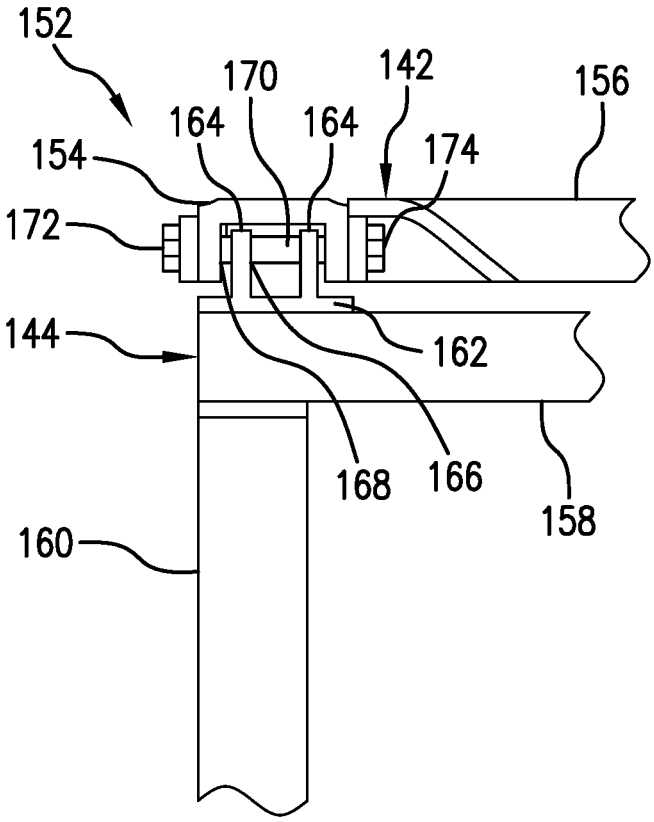
FIG. 8 shows a view of a portion of the wall assembly of FIG. 6.

FIGS. 6-8 show a wall assembly, indicated generally at 140, in accordance with another exemplary embodiment of the present disclosure. Wall assembly 140 includes a support assembly 142 and a movable wall assembly 144. Wall assembly 140 includes a plurality of shock absorbers 146 and 148 positioned between and attached to support assembly 142 and movable wall assembly 144. As with other embodiments disclosed herein, an impact on movable wall assembly 144 is transmitted or transferred to shock absorbers 146 and 148 such that movable wall assembly 144 moves from a first position shown in FIG. 6 to a second position 7. However, movable wall assembly 144 is attached at a top 150 that is a spaced distance above or away from activity surface 60 to support assembly 142 by way of a plurality of hinge or pivot assemblies 152.

Support assembly 142 includes a plurality of upper transverse frames 154 and a plurality of upper connecting frames 156, which have some similarity to upper transverse frames 20 and upper connecting frames 22 shown in FIG. 3. Upper connecting frame 156 shown in FIG. 8 is shown partially cut away to expose portions of hinge or pivot assembly 152. Movable wall assembly 144 includes a plurality of horizontal frame pieces 158 and a plurality of vertical frame pieces 160, which includes some similarity to horizontal frame pieces 38 and a plurality of vertical frame pieces 40 shown in FIG. 3. Each of the plurality of hinge or pivot assemblies 152 includes a hinge base 162 mounted on, positioned on, or attached to horizontal frame piece 158 of movable wall assembly 144. Hinge base 162 includes a pair of protrusions, extensions, or ears 164, each of which includes a hole or opening 166. Upper transverse frame 154 can include holes or openings 168 formed therein. Holes or openings 166 are aligned with holes or openings 168, and a hinge pin 170 extends through holes or openings 166 and holes or openings 168. Hinge pin 170 is retained by a fastener 172 and a fastener 174, which can include a head formed on hinge pin 170, a nut, or other component. In this embodiment, a collision, impact, or other force on a major surface or front face 176 of movable wall assembly 144 causes movable wall assembly 144 to rotate from the first position to the second position, with such rotation being about the plurality of hinge pins 170.

In an alternative embodiment, hinge or pivot assembly 152 can be replaced with a material having high flexibility, such as, for example, an elastomer or a rubber, to attach or connect movable wall assembly 144 to support assembly 142. It should be understood that any technique allowing for a flexible joint consistent with the teachings of this disclosure may be used to connect movable wall assembly 144 to support assembly 142.

In an exemplary embodiment, shock absorber 146 may have a higher stiffness, or require a greater force to compress, than shock absorber 148, which may facilitate greater deflection of a bottom of movable wall assembly 144 during an impact. Conversely, shock absorber 146 may have a lower stiffness than shock absorber 148. As disclosed above, the stiffness of each shock absorber may be independently modified to provide an optimal deflection of movable wall assembly 144 upon impact on major surface or front face 176 of movable wall assembly 144, and adjacent wall assemblies 140 can be pinned to one another.

Figure 11:
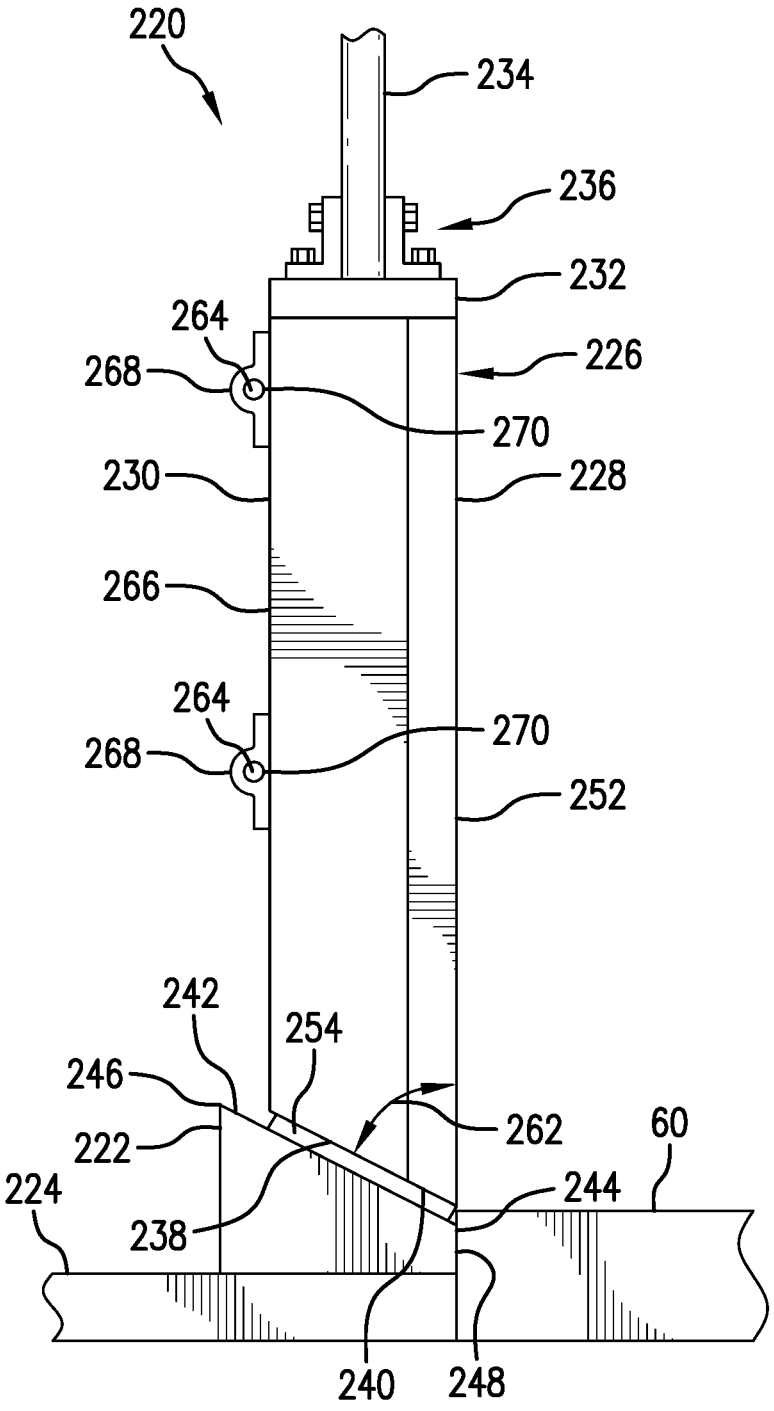
FIG. 11 shows a view of a wall assembly in accordance with an even further exemplary embodiment of the present disclosure.
Figure 12:
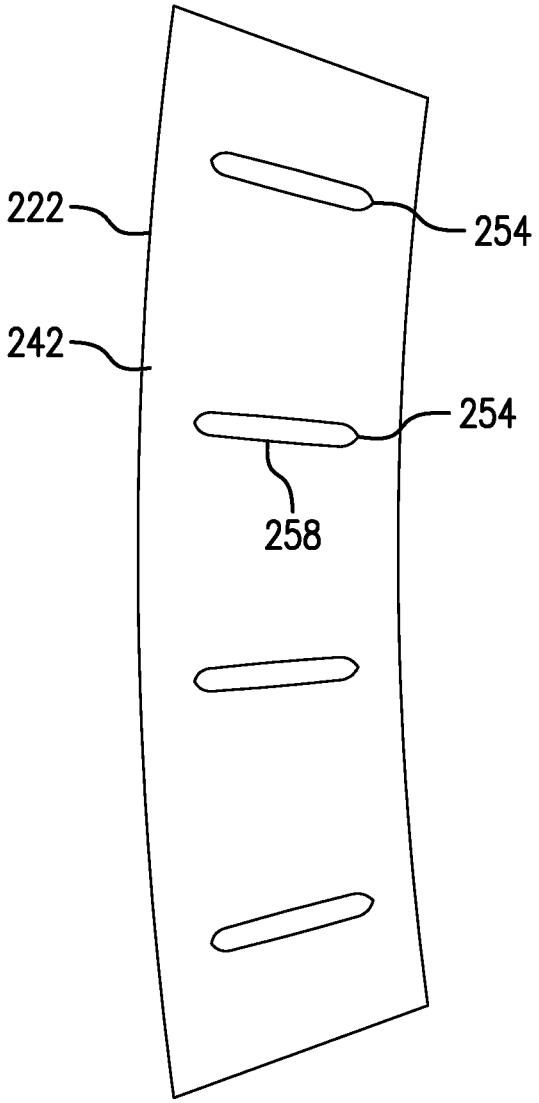
FIG. 12 shows a simplified view of a top surface of an exemplary base of the embodiment of FIG. 11.

FIGS. 11 and 12 show a wall assembly, indicated generally at 220, in accordance with an exemplary embodiment of the present disclosure. Wall assembly 220 includes a base 222, which can be attached to, for example, a floor 224. Wall assembly 220 also includes a movable wall assembly 226, which can include a front wall 228 and a support frame 230, which is positioned generally over base 222 in an overlapping configuration such that base 222 is positioned directly between movable wall assembly 226 and floor 224. Movable wall assembly 226 can also include a top support frame 232 that connects front wall 228 to support frame 230. A transparent glass or plastic shield or barrier 234 can be supported on support frame 230 and attached to support frame 230 by brackets and fasteners 236.

Support frame 230 includes a bottom surface 238, and front wall 228 includes a bottom surface 240. In the present embodiment, bottom surfaces 238 and 240 form a plane that is inclined relative to a substantially horizontal position, such as, for example, a direction parallel to the ground, playing or activity surface 60, or floor 224. In another exemplary embodiment, only one of bottom surface 238 of support frame 230 and bottom surface 240 of front wall 228 may constitute such an inclined plane. Bottom surface 238 of support frame 230 and bottom surface 240 of front wall 228 can be formed so as to be even with the level of playing or activity surface 60 at a location adjacent to playing or activity surface 60, or formed so as to be below the level of a playing or activity surface 60.

Base 222 includes an upper surface 242 that is also inclined relative to a substantially horizontal position. That is, upper surface 242 can be formed as a ramp or incline. In a cross-sectional side view, base 222 can have a trapezoidal shape configured to create a lower end 244 that is near, proximate, or adjacent to playing or activity surface 60 and an upper end 246 that is raised, higher, or above lower end 244 and a spaced distance from playing or activity surface 60. Base 222 may be formed as a trigonal shape (not shown) such that there is no distance between a lower end of inclined planar surface 242 and a vertex of the bottom of base 222. In other words, the lower end of inclined planar surface 242 is immediately adjacent to the bottom of base 222. Base 222 may be formed as a shape similar to a parallelogram or a rhombus (not shown).

As noted hereinabove, base 222 can be positioned underneath or below movable wall assembly 226 such that movable wall assembly 226 sits on and is supported by top or upper surface 242 of base 222. Movable wall assembly 226 can be positioned such that a front surface 252 of front wall 228 aligns with a front surface 248 and lower end 244 of base 222. Base 222 can be positioned so that when an object, such as a person or participant in an activity, impacts, hits, or collides with front surface 252 of front wall 228, movable wall assembly 226 is pushed diagonally along and up the incline of surface 242. Movable wall assembly 226 can be secured in position by, for example, cables 264, as disclosed in U.S. Pat. No. 9,091,091 to Sicking et al. Cables 264 provide a restoring or return force to movable wall assembly 226 in combination with the interaction of surfaces 238 and 240 with surface 242.

In an exemplary embodiment, a friction modification element 254 can be disposed or positioned directly between base 222 and movable wall assembly 226. Friction modification element 254 can be directly in contact with top surface 242 of base 222 and with either or both of bottom surface 238 of the support frame 230 and bottom surface 240 of front wall 228.

As shown in FIG. 12, friction modification element 254 can include a plurality of individual and separate sliders 258. Sliders 258, in the top view of base 222 shown in FIG. 12, can extend approximately parallel to top surface 242 of base 222 so as to be elongated in a length direction extending perpendicular to front surface 248 of front wall 228 when viewing sliders 258 in a plan or top view, which is also generally the direction of movement of a movable wall assembly, such as movable wall assembly 226, when a force is applied against movable wall assembly 226. In addition to extending perpendicularly to front surface 248 of front wall 228 when viewed from above or in plan view, each slider 258 is preferably at an angle 262 to front surface 248 when viewed from a side or in an elevation view, as shown in FIG. 11 and as disclosed elsewhere herein. It should be understood that angle 262 is related to the deceleration rate of an impacting force, in combination with a restoring force. Such restoring force can be applied by, for example, any of the shock absorbers disclosed herein. In addition, a restoring force can be applied by one or more cables 264 that are slidingly attached to a back surface 266 of movable wall assembly 226, which can also be the back surface of support frame 230. In the context of the wall assemblies disclosed herein, a back surface is a surface on an opposite side of any wall assembly from an activity surface 60. Thus, the back surface is transversely located with respect to activity surface 60. Cables 264 can be attached to back surface 266 by brackets 268. Each bracket 268 includes an opening 270, which can be a hole, through which a respective cable 264 extends. Cables 264 are fixed at locations separate from movable wall assembly 226. Cables 264 can be fixed to non-movable posts or beams (not shown) secured to, for example, floor 224.

Each cable 264 extends approximately parallel to back surface 266, and generally horizontal to the ground. In this context, approximately parallel and generally horizontal can each be, for example within five angular degrees on each side of parallel, i.e., ten degrees full width, more preferably within three angular degrees on each side of parallel, i.e., six degrees full width, and most preferably within 1 angular degree on each side of parallel, i.e., two degrees full width.

When a force is applied to a front location of movable wall assembly 226, such as front surface 248, then movable wall assembly 226 moves transversely or horizontally away from activity surface 60. At the same time, movable wall assembly 226 moves upwardly away in a direction that is away from activity surface 60 because upper surface 242 is positioned at angle 262. It should be understood that each cable 264 can move relative to movable wall assembly 226 because each cable 264 is slidably positioned in each bracket 268. As movable wall assembly 226 moves, each cable 264 stretches, and can extend a spring (not shown) used to secure each cable 264 to a fixed support (not shown). After the force applied to movable wall assembly 226, cable 264, which is elastically deformed, i.e., stretch by the force applied to movable wall assembly 226, restores movable wall assembly 226 to its original position, aided by the force of gravity. Thus, angle 262 affects the force required to move movable wall assembly 226 from a first, stationary position, as shown in FIG. 11, to a second, impacted position, which can be similar to the position of the wall assembly shown in, for example, FIG. 38. In an exemplary embodiment, angle 262 is in the range of 45 degrees to 90 degrees from vertical, which is equivalent to 0 to 45 degrees from horizontal. In another embodiment, angle 262 is in the range of 49 degrees to 78 degrees from vertical, which is equivalent to 22 to 41 degrees from horizontal. In yet another embodiment, angle 262 is in the range of 58 to 69 degrees from vertical, which is equivalent to 21 to 32 degrees from horizontal. In still another embodiment, angle 262 is in the range of 61 to 66 degrees from vertical, which is equivalent to 24 to 29 degrees from horizontal.

In an even further embodiment, angle 262 is in the range of 65 to 90 degrees from vertical, which is equivalent to 0 to 25 degrees from horizontal. In a yet even further embodiment, angle 262 is in the range of 72 to 82 degrees from vertical, which is equivalent to 8 to 18 degrees from horizontal. In a still yet even further embodiment, angle 262 is in the range of 74 to 80 degrees from vertical, which is equivalent to 10 to 16 degrees from horizontal.

The selection of an angle depends on at least the coefficient of friction of upper surface 242 if movable wall assembly rests directly on upper surface 242, the presence of any bearing surfaces, such as friction modification element 254, and the tension of the shock absorber, which includes cable 264 since cable 264 elastically deforms under force, absorbing force applied to movable wall assembly 226.

Sliders 258 can be formed or can include a variety of materials to modify friction between movable wall assembly 226 and base 222. Such materials can include at least one of one: bronze, brass, polytetrafluoroethylene (PTFE), and nylon; however, this list should not be considered limiting, as any suitable friction-reducing and/or modifying material, consistent with the teachings of this disclosure, may be used.

Figure 13:
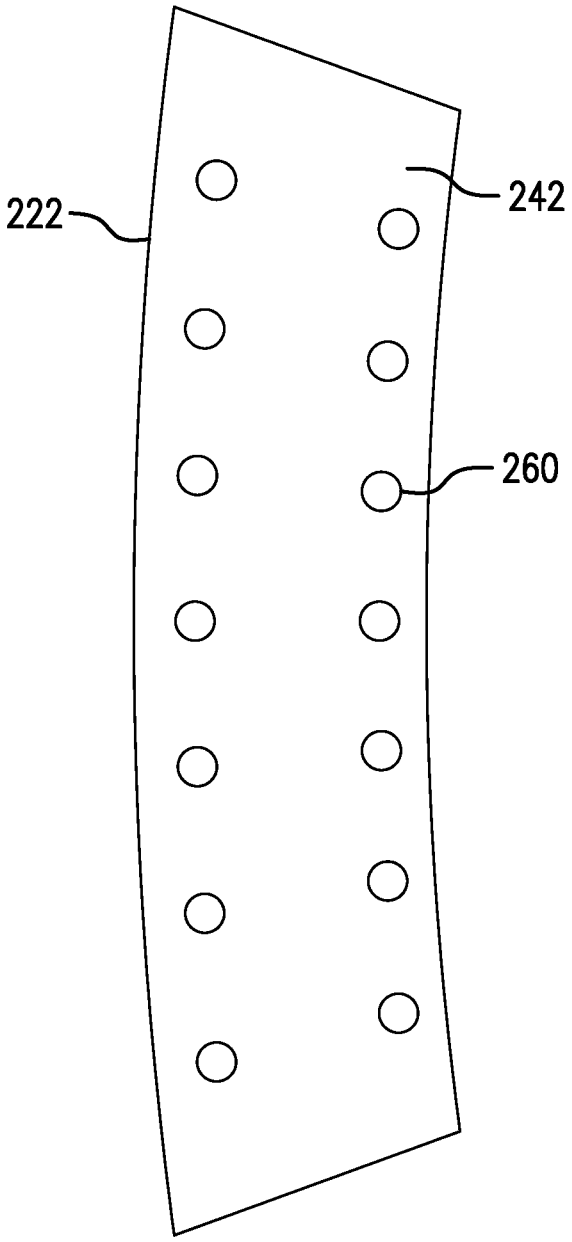
FIG. 13 shows a simplified view of a top surface of another exemplary base of the embodiment of FIG. 11.
Figure 14:
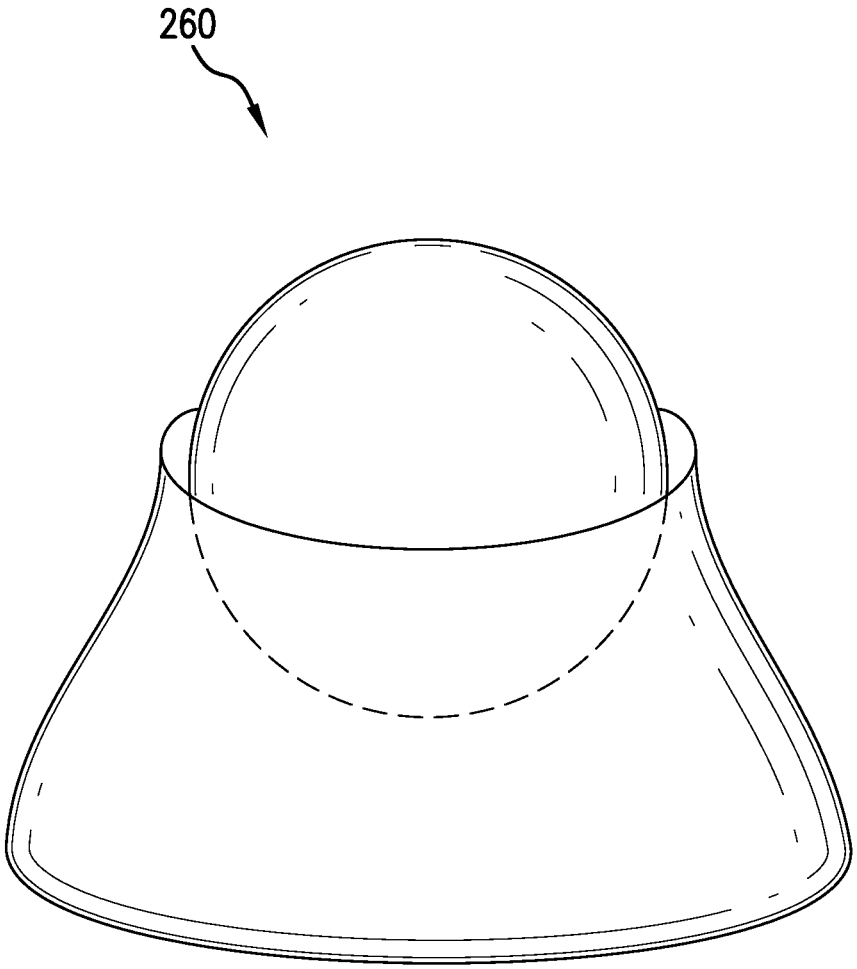
FIG. 14 shows a perspective view of a friction modifying element of the FIG. 13.
Figure 57:
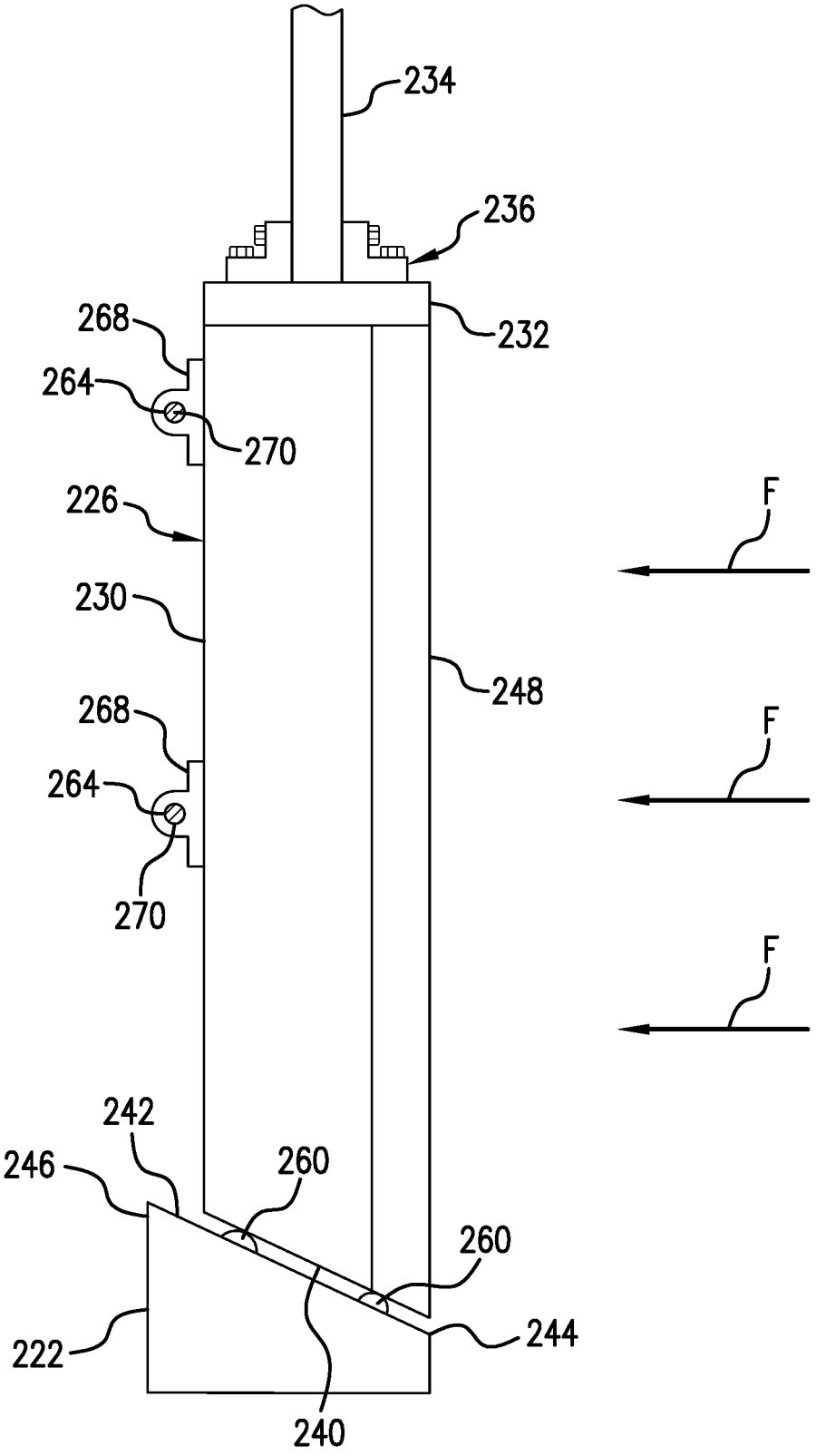
FIG. 57 shows a view of a wall assembly positioned on the base of FIG. 13 in accordance with an exemplary embodiment of the present disclosure.

In another exemplary embodiment shown in FIGS. 13, 14, and 57, friction modification element 254 can include rollers 260 positioned on top surface 242 of base 222. As shown in FIG. 13, rollers or bearings 260 may be disposed in rows along a direction extending parallel to front surface 248 of front wall 228. Rollers 260 can be any suitable configuration to reduce friction and maintain the proper orientation, position, and support of movable wall assembly 226. Rollers 260 can include a variety of materials to reduce the friction between movable wall assembly 226 and base 222. Such materials may include at least one of one: bronze, brass, PTFE, and nylon; however, this list should not be considered limiting, as any suitable material consistent with the teachings of this disclosure may be used. As shown in FIG. 14, rollers 260 can constitute self-contained ball bearings. However, any suitable roller may serve the purpose of reducing friction between movable wall assembly 226 and base 222.

In a further exemplary embodiment, friction modification element 254 can be attached to bottom surfaces 238 and 240 of movable wall assembly 226. That is, surface 242 shown in FIGS. 12 and 13 can alternatively be viewed as bottom surfaces 238 and 240 of movable wall assembly 226 with similar configurations of friction modification elements 254 provided thereon.

Figure 15:
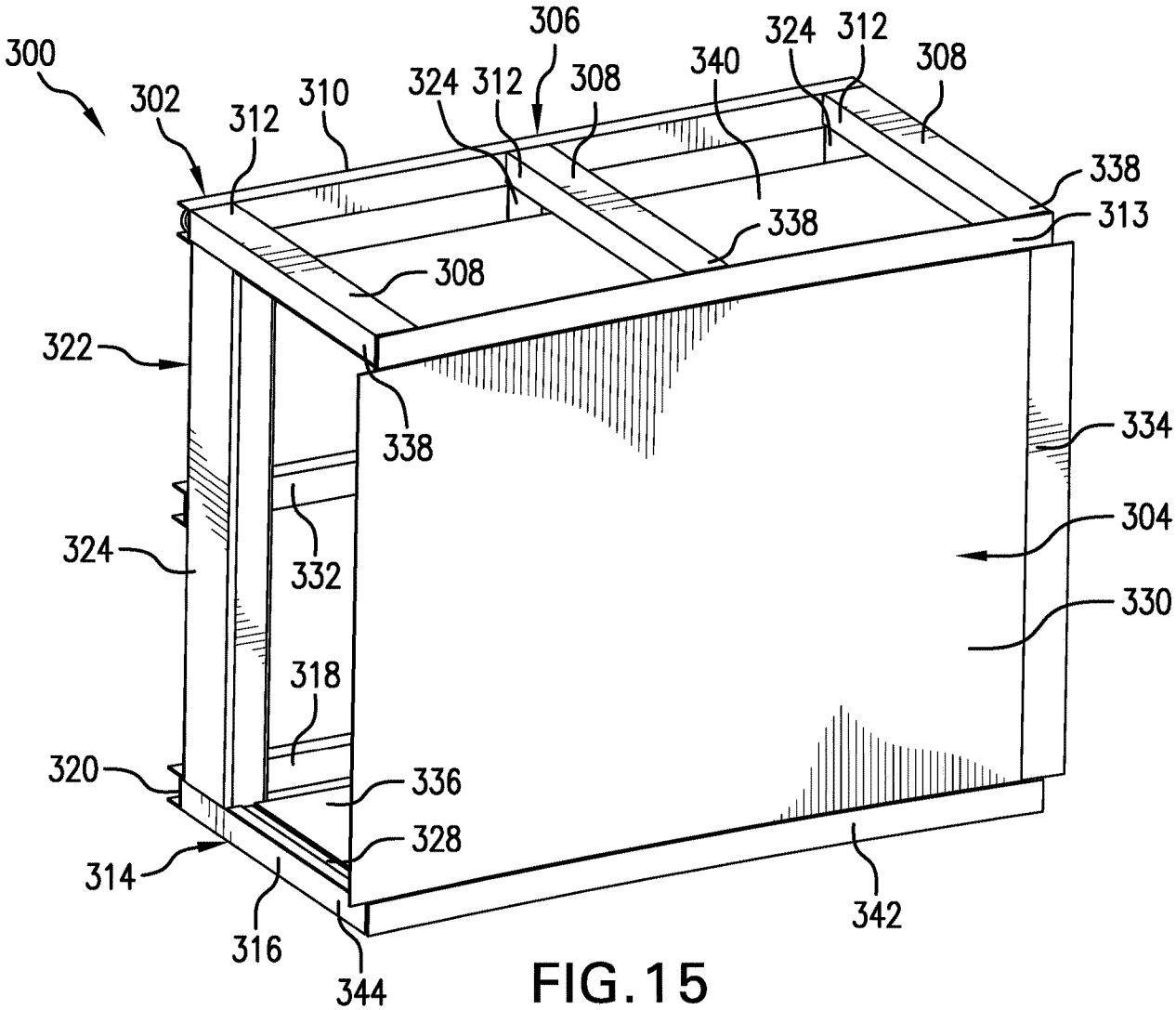
FIG. 15 shows a perspective view of a wall assembly in accordance with yet another exemplary embodiment of the present disclosure.
Figure 16:
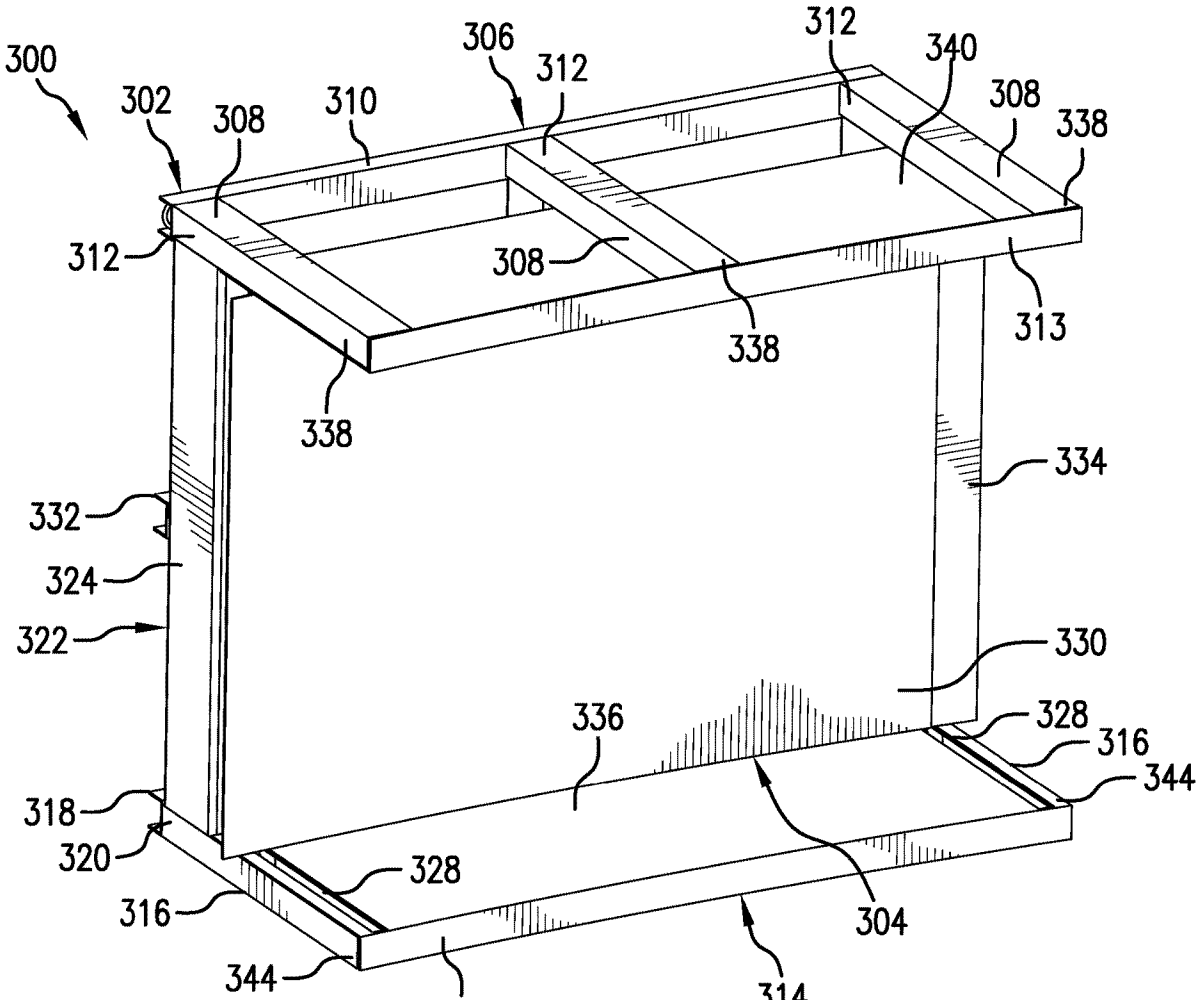
FIG. 16 shows a further perspective view of the wall assembly of FIG. 15.

FIGS. 15 and 16 show views of a wall assembly, indicated generally at 300, in accordance with yet another exemplary embodiment of the present disclosure. Wall assembly 300, which can also be described as wall segment 300 or board 300, includes a support assembly 302 and a movable board or wall assembly 304.

Support assembly 302 can include a plurality of elements, including, for example, a transverse or horizontally extending upper or top frame support 306, which can include a plurality of upper transverse frames 308 that extend in a direction that is approximately perpendicular to movable wall assembly 304, and at least one rear upper connecting frame 310 that extends approximately parallel to movable wall assembly 304. Rear upper connecting frame 310 is attached to and extends along respective ends 312 of upper transverse frames 308 to provide strength and stability to upper transverse frames 308. Such attachment can be, for example, by way of fasteners and brackets (not shown), welding, or other attachment devices and mechanisms. Each end 312 is located at an opposite end of a respective upper transverse frame 308 from movable wall assembly 304 when movable wall assembly 304 is in an un-deflected position.

Support assembly 302 can also include a front upper connecting frame 313 that extends approximately parallel to a major surface of movable wall assembly 304 and approximately parallel to rear upper connecting frame 310. Front upper connecting frame 313 is attached to and extends along respective ends 338 of upper transverse frames 308 to provide strength and stability to upper transverse frames 308. Such attachment can be, for example, by way of fasteners and brackets (not shown), welding, or other attachment devices and mechanisms. Each end 338 is located at an opposite end of a respective upper transverse frame 308 from end 312. In addition, each end 338 is near to, adjacent to, close to, alongside of, or proximate to movable wall assembly 304 when movable wall assembly 304 is in an un-deflected position.

Support assembly 302 can also include a transverse or horizontally extending lower or bottom support frame 314, which can include a plurality of lower transverse frames 316 that extend in a direction that is approximately perpendicular to movable wall assembly 304, at least one rear, lower, connecting frame 318 that extends approximately parallel to a front or outer surface of movable wall assembly 304, and at least one front, lower, connecting frame 342 that also extends approximately parallel to a front or outer surface of movable wall assembly 304. Rear, lower, connecting frame 318 can be connected to respective ends 320 of each lower transverse frame 316, each end 320 positioned at a location that is at an opposite end of a respective lower transverse frame 316 from the un-deflected position of movable wall assembly 304. Rear, lower, connecting frame 318 helps to provide strength and stability to lower transverse frames 316. The attachment of rear, lower, connecting frame 318 to each respective lower transverse frame 316 can be, for example, by way of fasteners and brackets (not shown), welding, or other attachment devices and mechanisms.

Front, lower, connecting frame 342 can be connected to respective ends 344 of each of lower transverse frame 316, each end 344 positioned at a location that is at, near to, close to, adjacent to, alongside to, or in proximity to, movable wall assembly 304 when movable wall assembly 304 is in the un-deflected position shown in FIG. 15. Each end 344 is also at an opposite end of a respective lower transverse frame 316 from end 320. Front, lower, connecting frame 342 helps to provide strength and stability to lower transverse frames 316, particularly in conjunction with rear, lower, connecting frame 318. The attachment of front, lower, connecting frame 342 to each respective lower transverse frame 316 can be, for example, by way of fasteners and brackets (not shown), welding, or other attachment devices and mechanisms.

Support assembly 302 can also include a vertically extending support frame assembly 322 that is positioned between upper or top support frame 306 and lower or bottom support frame 314. Support frame assembly 322 can include a plurality of vertically extending connecting frames 324, each of which is attached or connected to upper or top support frame 306 and lower or bottom support frame 314 by way of fasteners, brackets, welding, and the like. Such connection of each connecting frame 324 can be directly to, for example, a respective upper transverse frame 308 and directly to a respective lower transverse frame 316. In addition, the connection of each connecting frame 324 to the respective upper transverse frame 308 and the respective lower transverse frame 316 can be at a location on upper transverse frame 308 near to, close to, alongside to, adjacent to, in proximity to, or at end 312 and at a location on lower transverse frame 316 that is near to, close to, alongside to, adjacent to, in proximity to, or at end 320. Each connecting frame 324 can be in a conventional beam configuration, can be an extruded square or rectangular tube, can be a welded assembly, and the like. Though not shown in FIGS. 15 and 16, each connecting frame 324 is preferably hollow to conserve weight.

Each disclosed element of wall assembly 300 that is labeled with an identical number can be identically configured, or each element can be different from each other. For example, some vertically extending connecting frames 324 can be square or rectangular tubes, and other frames 324 can be U-shaped or V-shaped.

Each upper transverse frame 308 and each lower transverse frame 316 can include a track 328 that is approximately parallel to a respective upper transverse frame 308 and/or lower transverse frame 316. Thus each track 328 is also approximately perpendicular to movable wall assembly 304. Each track 328 can be integrally formed with each respective upper transverse frame 308 or lower transverse frame 316, or each track 328 can be a separate piece attached, fastened, connected, or otherwise affixed to each respective upper transverse frame 308 or lower transverse frame 316.

Wall assembly 300 can further include a plurality of walls or caps to cover portions of support assembly 302 and movable wall assembly 304 to prevent access to internal locations of wall assembly 300. For example, wall assembly 300 can include a front wall 330 that can be fabricated from a strong, lightweight plastic, composite, or wood material. Though removed in FIGS. 15 and 16, wall assembly 300 can also include a top cap or cover that may be similar to, for example, top cap or cover 44 shown in FIGS. 1 and 2, which connects or attaches to one or more of the sub-components included in upper or top support frame 306, such as one or more upper transverse frames 308. Wall assembly 300 can also include a back cap or cover (not shown) that may be similar to, for example, back cap or cover 46 shown in FIGS. 1 and 2, which connects or attaches to one or more of the subcomponents included in upper or top support frame 306, lower or bottom support frame 314, and/or vertically extending support frame assembly 322, such as rear upper connecting frame 310, rear, lower, connecting frame 318, and/or vertical connecting frames 324.

Vertically extending support frame assembly 322 can further include an intermediate transverse frame 332 that can be positioned at or near a vertically central location of each vertical connecting frame 324, which can thus be approximately a mid-point of each vertical connecting frame 324. More broadly, intermediate transverse frame 332 can be positioned at a location that is directly between rear upper connecting frame 310 and lower connecting frame 318. Intermediate transverse frame 332 can attach or connect to each vertical connecting frame 324 by way of fasteners, welding, sintering, one or more brackets, and the like. Such attachment of intermediate transverse frame 332 can be directly to each vertical connecting frame 324.

Because movable wall assembly 304 moves with respect to support assembly 302 and adjacent wall assemblies 300, potential "pinch points" can be formed as movable wall assembly 304 moves within support assembly 302. To minimize the risk of inadvertently trapping a portion of a human body or clothing between moving and non-moving parts, wall assembly 300 includes various covers, shields, spacers, etc. As shown in FIGS. 15 and 16, wall assembly 300 can include a vertically and transversely extending inter-wall shield 334 that is approximately parallel to front wall 330.

Wall assembly 300 can further include a lower internal cover, spacer, or shield 336 that is sized and dimensioned to prevent, for example, a finger being trapped vertically between front wall 330 and lower support frame 314, particularly when movable wall assembly 304 is deflected to the position shown in FIG. 16. Lower shield 336 is approximately parallel to the ground, or approximately perpendicular to a vertical direction from the ground. It is preferable for lower shield 336 to be as close to parallel to the ground as possible to avoid an increasing or decreasing gap between movable wall assembly 304 and lower shield 336 as movable wall assembly 304 moves from an un-deflected position, such as that shown in FIG. 15, to a deflected position, such as that shown in FIG. 16.

Also as shown in FIGS. 15 and 16, wall assembly 300 can include an upper internal cover, spacer, or shield 340 that is sized and dimensioned to prevent, for example, a finger being trapped vertically between front wall 330 and upper support frame 306, particularly when movable wall assembly 304 is deflected to the position shown in FIG. 16. Upper shield 340 is approximately parallel to the ground, or approximately perpendicular to a vertical direction from the ground. It is preferable for upper shield 340 to be as close to parallel to the ground as possible to avoid an increasing or decreasing gap between movable wall assembly 304 and upper shield 340 as movable wall assembly 304 moves from an un-deflected position, such as that shown in FIG. 15, to a deflected position, such as that shown in FIG. 16.

FIGS. 17-21 show views of a wall assembly, indicated generally at 350, in accordance with a still further exemplary embodiment of the present disclosure. In the views of FIGS. 17-21, covers or caps, shields, and shock absorbers are removed to simplify explanation of the figures. Wall assembly 350, which can also be described as wall segment 350 or board 350, includes a support assembly 352 and a movable board or wall assembly 354.

Support assembly 352 can include a plurality of elements, including, for example, a transverse or horizontally extending upper or top frame support 356, which can include a plurality of upper transverse frames 358 that extend in a direction that is approximately perpendicular to a major surface of movable wall assembly 354, and at least one rear upper connecting frame 360 that extends approximately parallel to movable wall assembly 354. Rear upper connecting frame 360 is attached to and extends along respective ends 362 of upper transverse frames 358 to provide strength and stability to upper transverse frames 358. Such attachment can be, for example, by way of fasteners and brackets (not shown), welding, or other attachment devices and mechanisms. Each end 362 is located at an opposite end of a respective upper transverse frame 358 from movable wall assembly 354 when movable wall assembly 354 is in an un-deflected position.

Support assembly 352 can also include a front upper connecting frame 364 (shown partially removed in FIG. 21) that extends approximately parallel to movable wall assembly 354 and approximately parallel to rear upper connecting frame 360. Front upper connecting frame 364 is attached to and extends along respective ends 372 of upper transverse frames 358 to provide strength and stability to upper transverse frames 358. Such attachment can be, for example, by way of fasteners and brackets (not shown), welding, or other attachment devices and mechanisms. Each end 372 is located at an opposite end of a respective upper transverse frame 358 from end 362. In addition, each end 372 is near to, adjacent to, close to, alongside of, or proximate to movable wall assembly 354 when movable wall assembly 354 is in an un-deflected position.

Support assembly 352 can also include a transverse or horizontally extending lower or bottom support frame 366, which can include a plurality of lower transverse frames 368 that extend in a direction that is approximately perpendicular to a major surface of movable wall assembly 354, at least one rear, lower, connecting frame 370 that extends approximately parallel to a front or outer surface of movable wall assembly 354, and at least one front, lower, connecting frame 374 (shown partially removed in FIG. 21) that also extends approximately parallel to a front, outer, or major surface of movable wall assembly 354. Rear, lower, connecting frame 370 can be connected to respective ends 376 of each lower transverse frame 368, each end 376 positioned at a location that is at an opposite end of a respective lower transverse frame 368 from the un-deflected position of movable wall assembly 354. Rear, lower, connecting frame 370 helps to provide strength and stability to lower transverse frames 368. The attachment of rear, lower, connecting frame 370 to each respective lower transverse frame 368 can be, for example, by way of fasteners and brackets (not shown), welding, or other attachment devices and mechanisms.

Figure 17:
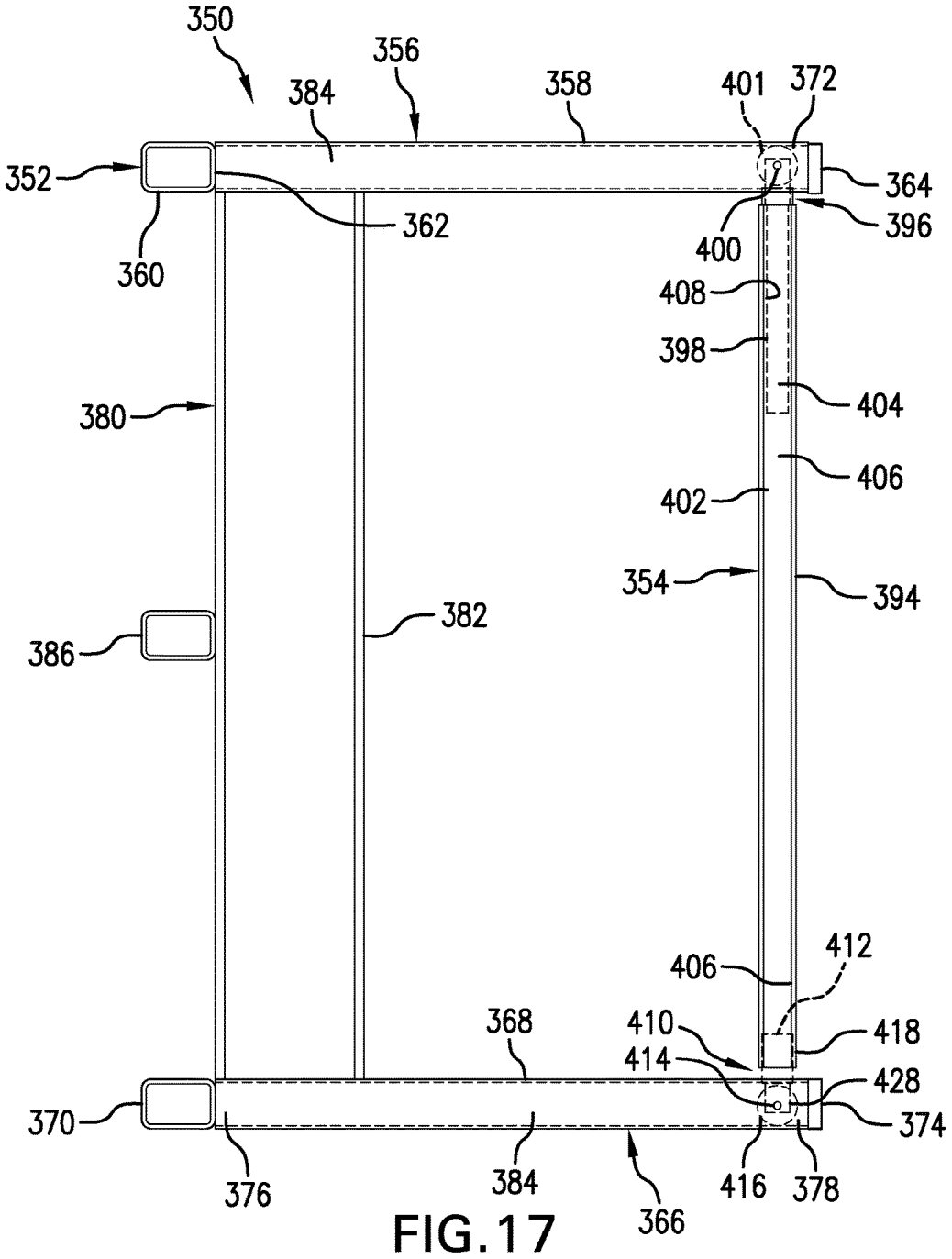
FIG. 17 shows a view of a wall assembly in accordance with a still further exemplary embodiment of the present disclosure.

Front, lower, connecting frame 374 can be connected to respective ends 378 of each lower transverse frame 368, each end 378 positioned at a location that is at, near to, close to, adjacent to, alongside to, or in proximity to, movable wall assembly 354 when movable wall assembly 354 is in the un-deflected position shown in FIG. 17. Each end 378 is also at an opposite end of a respective lower transverse frame 368 from end 376. Front, lower, connecting frame 374 helps to provide strength and stability to lower transverse frames 368, particularly in conjunction with rear, lower, connecting frame 370. The attachment of front, lower, connecting frame 374 to each respective lower transverse frame 368 can be, for example, by way of fasteners and brackets (not shown), welding, or other attachment devices and mechanisms.

Support assembly 352 can also include a vertically extending support frame assembly 380 that is positioned between upper or top support frame 356 and lower or bottom support frame 366. Support frame assembly 380 can include a plurality of vertically extending connecting frames 382, each of which is attached or connected to upper or top support frame 356 and lower or bottom support frame 366 by way of fasteners, brackets, welding, and the like. Such connection of each connecting frame 382 can be directly to, for example, a respective upper transverse frame 358 and directly to a respective lower transverse frame 368. In addition, the connection of each connecting frame 382 to the respective upper transverse frame 358 and the respective lower transverse frame 368 can be at a location on upper transverse frame 358 near to, close to, alongside to, adjacent to, in proximity to, or at end 362 and at a location on lower transverse frame 368 that is near to, close to, alongside to, adjacent to, in proximity to, or at end 376. Each connecting frame 382 can be in a conventional beam configuration, can be an extruded square or rectangular tube, can be a welded assembly, and the like. Though not shown in FIGS. 15 and 16, each connecting frame 382 is preferably hollow to conserve weight.

Each disclosed element of wall assembly 350 that is labeled with an identical number can be identically configured, or each element can be different from each other. For example, some vertically extending connecting frames 382 can be square or rectangular tubes, and other frames 382 can be U-shaped or V-shaped.

Each upper transverse frame 358 and each lower transverse frame 368 can include a track 384 that is approximately parallel to a respective upper transverse frame 358 and/or lower transverse frame 368. Thus each track 384 is also approximately perpendicular to movable wall assembly 354. Each track 384 can be integrally formed with each respective upper transverse frame 358 or lower transverse frame 368, or each track 384 can be a separate piece attached, fastened, connected, or otherwise affixed to each respective upper transverse frame 358 or lower transverse frame 368.

Wall assembly 350 can further include a plurality of walls or caps to cover portions of support assembly 352 and movable wall assembly 354 to prevent access to internal locations of wall assembly 350. For example, wall assembly 350 can include a front wall such as front wall 330 shown in FIGS. 15 and 16 that can be fabricated from a strong, lightweight plastic, composite, or wood material. Though not shown in FIGS. 17-21, wall assembly 350 can also include a top cap or cover that may be similar to, for example, top cap or cover 44 shown in FIGS. 1 and 2, which connects or attaches to one or more of the sub-components included in upper or top support frame 356, such as one or more upper transverse frames 358. Wall assembly 350 can also include a back cap or cover (not shown) that may be similar to, for example, back cap or cover 46 shown in FIGS. 1 and 2, which connects or attaches to one or more of the subcomponents included in upper or top support frame 356, lower or bottom support frame 366, and/or vertically extending support frame assembly 380, such as rear upper connecting frame 360, rear, lower, connecting frame 370, and/or vertical connecting frames 382.

Vertically extending support frame assembly 380 can further include an intermediate transverse frame 386 that can be positioned at or near a vertically central location of each vertical connecting frame 382, which can thus be approximately a mid-point of each vertical connecting frame 382. More broadly, intermediate transverse frame 386 can be positioned at a location that is directly between rear upper connecting frame 360 and lower connecting frame 370. Intermediate transverse frame 386 can attach or connect to each vertical connecting frame 382 by way of fasteners, welding, sintering, one or more brackets, and the like. Such attachment of intermediate transverse frame 386 can be directly to each vertical connecting frame 382.

Figure 21:
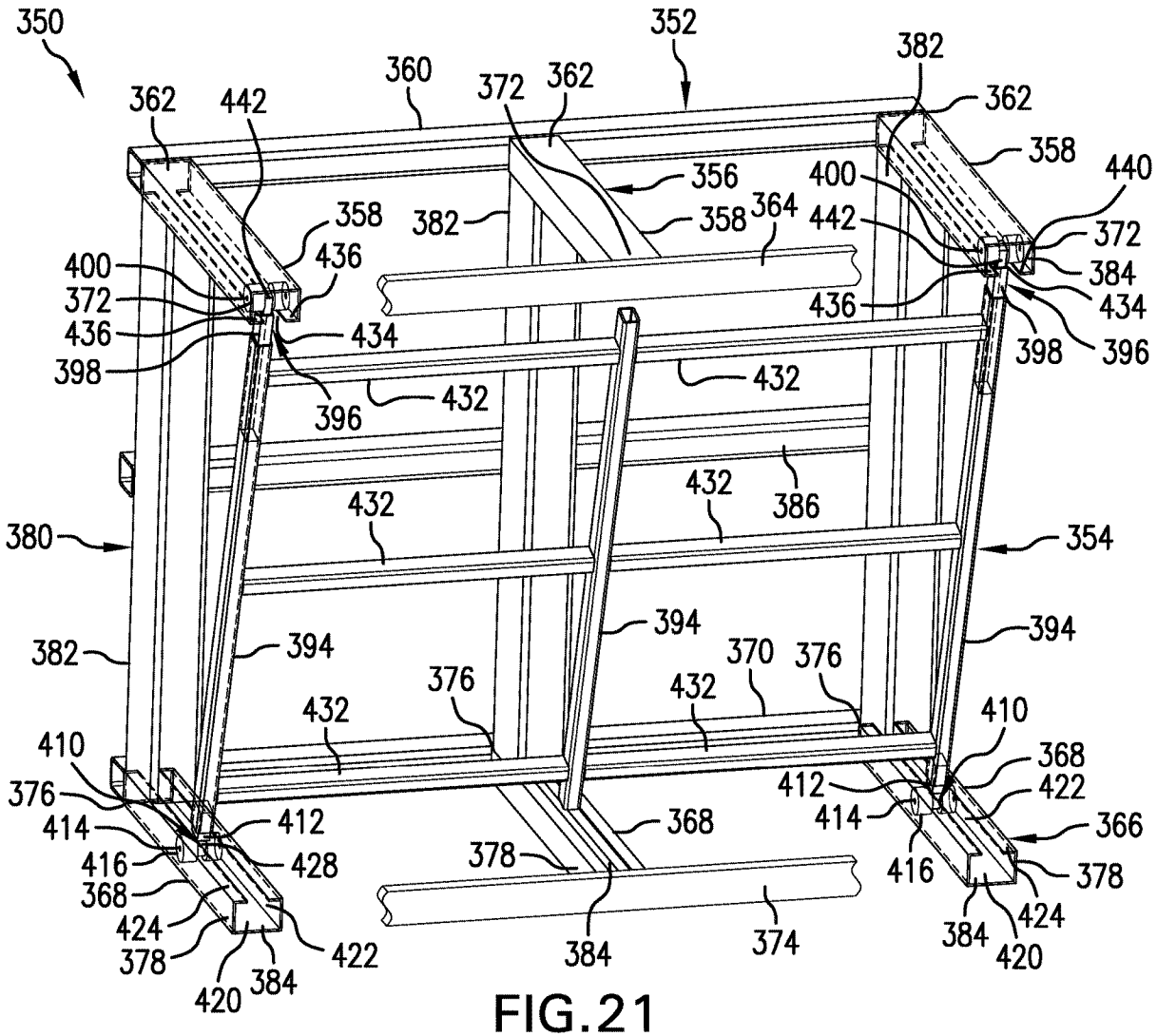
FIG. 21 shows a perspective view of the wall assembly of FIGS. 17-20 with portions of the wall assembly removed.

Movable wall assembly 354 can include a plurality of front wall supports 394 to which a front wall, such as front wall 330 shown in FIGS. 15 and 16, is attached. Such attachment of the front wall to each front wall support 394 can be by way of a fastener, brackets, and other attachment devices. Movable wall assembly 354 can also include a plurality of transverse front wall supports 432, such as is shown in FIG. 21.

Transverse front wall supports 432 can extend approximately perpendicularly to front wall supports 394, and connect front wall supports 394 to each other to provide strength to front wall supports 394. The attachment of transverse front wall supports 432 to front wall supports 394 can be by, for example, welding, fasteners, brackets, adhesives, and other fastening apparatus and methods. Transverse front wall supports 432 can be positioned vertically along front wall supports 394 in a first, lower or bottom location that is closer to a bottom end of front wall supports 394 than to a top end, which is also close to lower or bottom support frame 366. Transverse front wall supports 432 can also be positioned vertically along front wall supports 394 in a second, upper or top location that is closer to a top end of front wall supports than to a bottom end, which is also close to upper or top support frame 356. Transverse front wall supports 432 can also be positioned at or near a mid-point of the plurality of front wall supports 394, which is a location that is directly between transverse front wall supports 432 that are located near a top of the plurality of front wall supports 394 and transverse front wall supports 432 that are located near a bottom of the plurality of front wall supports 394. It should be understood that because a front wall, such as front wall 330 disclosed elsewhere herein, provides strength to movable wall assembly 354, the number of transverse front wall supports 432 can be more or less than the number disclosed herein depending on the strength of the front wall.

For example, in an exemplary embodiment the top transverse wall supports 432 can be shifted downwardly away from the top end of front wall supports 394 and the bottom transverse wall supports 432 can be shifted upwardly away from the bottom end of front wall supports 394, and in this configuration only four transverse wall supports 432 are part of a movable wall assembly. In yet another exemplary embodiment, the two transverse wall supports 432 near the mid-point of front wall supports 394 can be shifted upwardly or downwardly, and additional transverse wall supports 432 can be added in the space provided by the shifting of the transverse wall supports. It should be understood that transverse wall supports 432 can be approximately equally spaced from each other, or the distances between transverse wall supports 432 can be different to modify weight distribution and thus the movement responsiveness of an upper or lower part of movable wall assembly 354.

Figure 19:
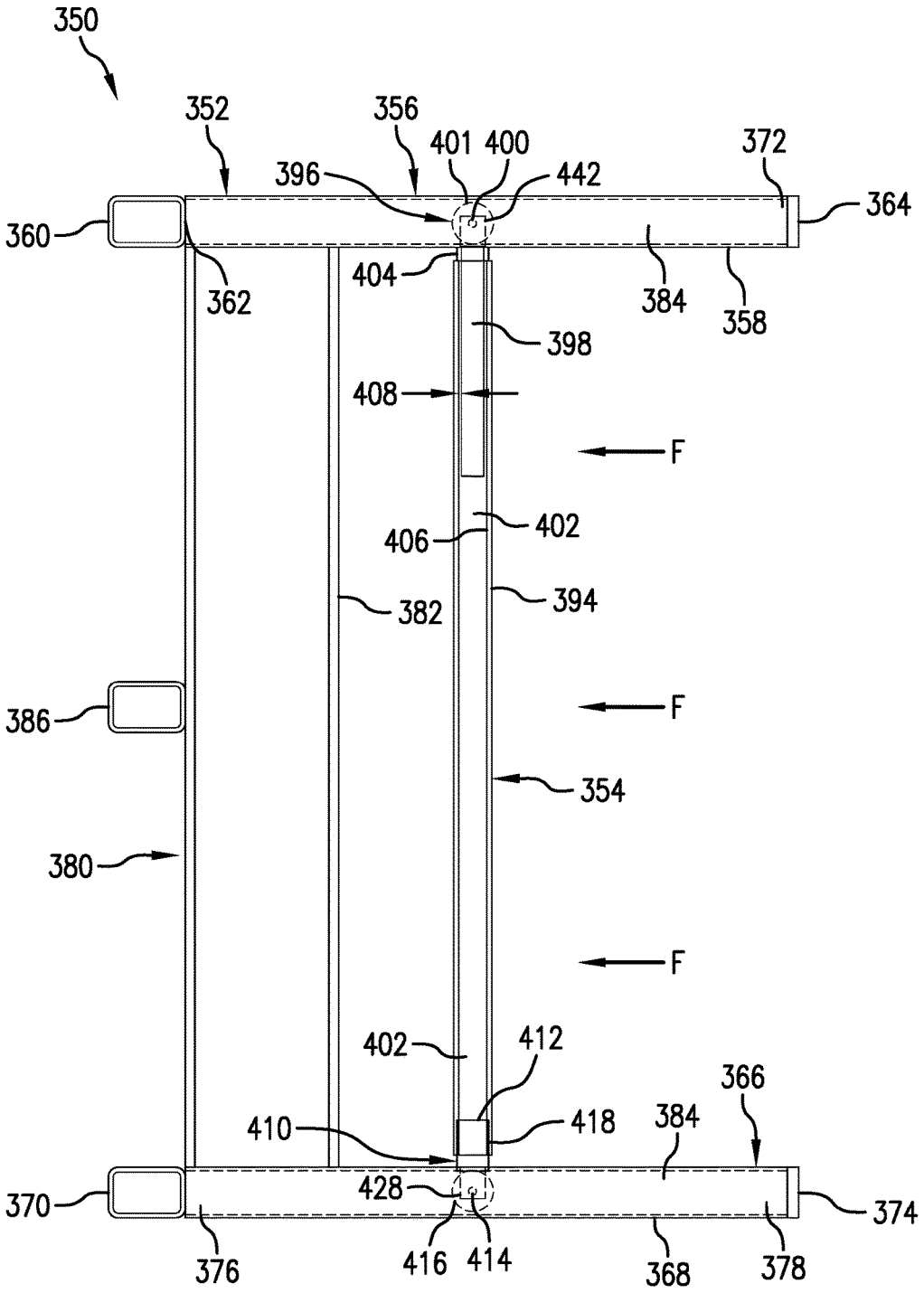
FIG. 19 shows a view of the wall assembly of FIG. 17 with the entire movable wall assembly deflected by a force.

Each front wall support 394, shown in cross section in FIG. 19, includes at least one interior cavity 402. Interior cavity 402 can be in the form of a cylinder, a rectangle, or a square. Thus, interior cavity 402 can be defined by a diameter, a width and a length, or other dimensions that define the size and shape of interior cavity 402.

Each front wall support 394 can further support an upper wheel assembly 396. Each upper wheel assembly 396 is sized and dimensioned to ride along a respective track 384. Wheel assembly 396 is described as "upper" because each wheel assembly 396 is positioned at a location that is vertically spaced or separated from, for example, lower or bottom support frame 366, which is configured to be positioned on base 16 (e.g., see FIGS. 1 and 2) or on an edge or periphery of activity surface 60, disclosed elsewhere herein.

Each upper wheel assembly 396 can include a wheel assembly support 398, a support shaft 400 positioned in wheel assembly support 398, and a wheel 401 rotatably positioned on support shaft 400. Each wheel assembly support 398 includes an exterior surface 404 that is approximately a same shape as an interior wall 406 of front wall supports 394, with a clearance or gap 408 between interior wall 406 and exterior surface 404. Clearance or gap 408, which in an exemplary embodiment can be in a range from, for example, 0.02 inches to 0.10 inches, enables relatively easy sliding movement between front wall support 394 and a respective wheel assembly support 398, as disclosed in more detail hereinbelow.

Each front wall support 394 can further support a lower wheel assembly 410. Each lower wheel assembly 410 is sized and dimensioned to ride along a respective track 384. Wheel assembly 410 is described as "lower" because each wheel assembly 410 is positioned at a location that is vertically closer to the ground than, for example, upper wheel assembly 396. In addition, lower wheel assembly 410 would typically be adjacent to, next to, close to, alongside, near to, or in proximity to base 16, as well as lower or bottom support frame 366.

Each lower wheel assembly 410 can include a wheel assembly support 412, an axle or shaft support 428 attached to formed as a part of wheel assembly support 412, a wheel support shaft 414 positioned in axle or shaft support 428, and a wheel 416 rotatably positioned on support shaft 414.

Each wheel assembly support 412 includes an exterior surface 418 that is approximately a same shape as interior wall 406 of front wall supports 394. However, the outer dimensions of each wheel assembly support 412 are larger than the interior dimensions of interior wall 406 of front wall supports 394. Thus, mating of each lower wheel assembly 410 with a respective front wall support 394 can be an interference or friction fit to minimize relative movement or motion between lower wheel assembly 410 and respective front wall support 394.

Figure 20:
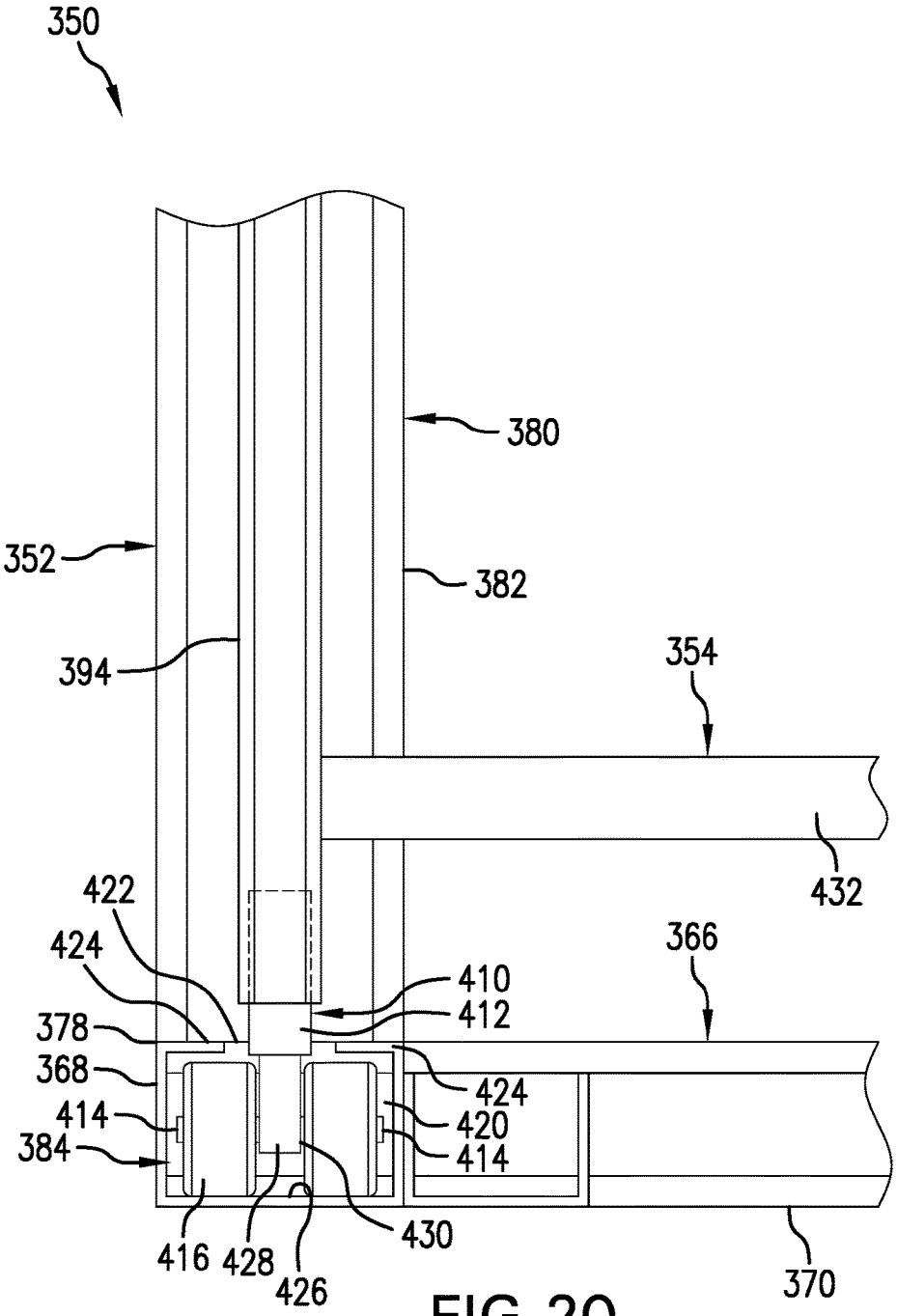
FIG. 20 shows a view of a portion of the wall assembly of FIG. 17.

FIG. 20 shows details of track 384 and a wheel assembly, e.g., lower wheel assembly 410, positioned in track 384. Track 384 can be formed at least partially or entirely within lower transverse frame 368. Lower transverse frame 368 can be formed as an extrusion, by stamping, by welding separate pieces together, or by other techniques. Lower transverse frame 368 can include an opening 420 at each end, and wheel assembly 410 can be inserted or positioned in track 384 by way of opening 420. After insertion of wheel assembly 410, front, lower connecting frame 374 can be attached to lower transverse frame 368 to cover opening 420 and to prevent removal of wheel assembly 410.

Lower transverse frame 368 can also include an opening 422 that extends from end 378 to end 376 of lower transverse frame 368 to enable wheel assembly support 412 to extend from an exterior of lower transverse frame 368 to an interior of lower transverse frame 368. Opening 422 is formed by a pair of lips 424 that extend toward each other to capture wheels 416 within track 384 during operation. Wheels 416 can ride on an interior surface 426 of lower transverse frame 368 as movable wall assembly 354 is deflected by force against movable wall assembly 354. As can be seen in FIG. 20, axle or shaft support 428 of lower wheel assembly 410 extends away from front wall support 394. Axle support 428 includes an opening 430 that is approximately perpendicular to a longitudinal axis of axle support 428. Opening 430 can extend entirely through axle support 428, and support shaft 414 extends through opening 430 so that wheel support shaft 414 is engaged to axle support 428. In an exemplary embodiment, axle support 428 can include a bearing to support wheel support shaft 414. By extending wheel support shaft 414 through axle support 428, movable wall assembly 354 is supported by a plurality of wheels 416 located in a plurality of tracks 384. It should be apparent that movable wall assembly 354 is thus supported within support assembly 352 by wheels 416, and wheel 416 supports support shafts 414, which support axle supports 428, which support front walls supports 394, along with a front wall such as front wall 330, along with the other elements of movable wall assembly 354.

Figure 18:
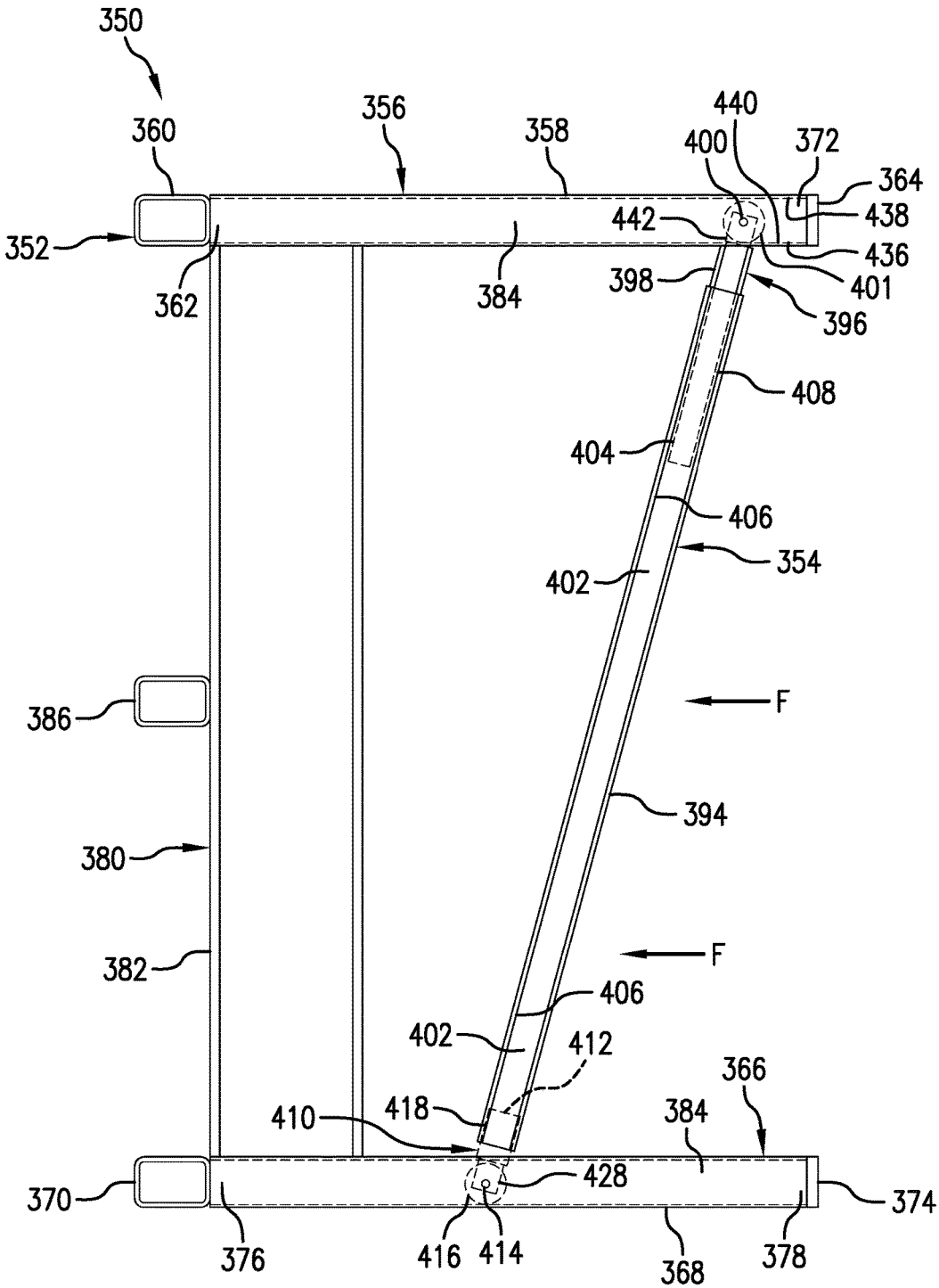
FIG. 18 shows a view of the wall assembly of FIG. 17 with a bottom portion of a movable wall assembly deflected by a force.

Upper transverse frame 358 can also include an opening 434 that extends from end 372 to end 362 of upper transverse frame 358 to enable wheel assembly support 398 to extend from an exterior of upper transverse frame 358 to an interior of upper transverse frame 358. Opening 434 is formed by a pair of lips 436 that extend toward each other to capture wheels 416 within track 384 during operation. Upper transverse frame 358 also includes an upper interior surface 438 and a lower interior surface 440 formed on an upper side of each of lips 436. It should be understood that each wheel assembly support 398 "floats" within respective front wall support 394. Thus, when movable wall assembly 354 deflects as shown in FIG. 18 due to a force F applied to movable wall assembly 354, the contact between wheels 416 and lower interior surface 440 of respective upper transverse frame 358 prevents wheels 416 from moving downwardly as respective front wall support 394 moves away from respective transverse frame 358, and respective front wall support 394 slides along wheel assembly support 398 during movement away from respective transverse frame 358. During this motion, due to the force of gravity and/or the friction between wheel assembly support 398 and respective transverse frame 358, wheels 416 connected to wheel assembly support 398 will contact and roll along lower interior surface 440.

After force F is removed, shock absorbers, which are not shown in FIGS. 17-21, but which are shown elsewhere herein, restore movable wall assembly 354 from the deflected position shown in FIG. 18 to the un-deflected position shown in FIG. 17. As movable wall assembly 354 returns to the un-deflected position near a front side of wall assembly 350 that is adjacent to activity surface 60, movable wall assembly 354 moves from the angled orientation shown in FIG. 18 to the vertical orientation shown in FIG. 17, i.e., approximately 90 degrees with respect to a ground plane. As movable wall assembly 354 returns to the vertical orientation, the upper or top end of each front wall support 394 moves toward the respective upper transverse frame 358. As front wall support 394 moves toward upper transverse frame 358, upper wheel assembly 396 can move upwardly due to friction between wheel assembly support 398 and front wall support 394. Thus, as movable wall assembly 354 moves from the position shown in FIG. 18 to the position shown in FIG. 17, wheels 416 positioned in upper transverse frame 358 can move upwardly to contact and roll along upper interior surface 438 of upper transverse frame 358. Also as movable wall assembly 354 moves from the position shown in FIG. 18 to the position shown in FIG. 17, wheel assembly support 398 can no longer move upwardly due to the contact between wheels 416 and upper interior surface 438. Accordingly, front wall support 394 slides along exterior surface 404 of wheel assembly support 398 to decrease the portion of wheel assembly support 398 that extends outside front wall support 394. The relative movement of upper wheel assembly 396 as it extends with respect to front wall support 394 can be described as "telescoping," since one element moves into and out from the other element. More specifically, wheel assembly support 398 telescopes with respect to wall support 394.

As shown in FIGS. 17 and 18, wheel assembly support 398 telescopes or extends outwardly or away from wall support 394 as movable wall assembly 354 deflects from a first position shown in FIG. 17 to a second position, such as that shown in FIG. 18. In another embodiment, wheel 401 and/or wheel assembly support 398 can be configured to move transversely with respect to movable wall assembly 354 during deflection of movable wall assembly 354 as movable wall assembly 354 deflects from the first position to the second position. In the context of FIGS. 17 and 18, transversely is in a direction that is approximately parallel to a front wall of movable wall assembly 354, which is out of the page in FIGS. 17 and 18. Such transverse movement can include, for example, a transverse movement of front wall support 394 relative to other elements of movable wall assembly 354. Alternatively, an interface between wheel assembly support 398 and wheel 401 can be configured for relative movement of wheel assembly support 398 relative to wheel 401 in a transverse direction As can be seen in FIG. 21, upper wheel assembly 396 can include an axle or shaft support 442 that extends upwardly away from front wall support 394. Axle support 442 includes an opening similar to opening 430 disclosed elsewhere herein that is approximately perpendicular to a longitudinal axis of axle support 442. Similar to opening 430, the opening in axle support 442 can extend entirely through axle support 442, and support shaft 400 extends through the opening in axle support 442 so that wheel support shaft 400 is engaged to axle support 442. In an exemplary embodiment, axle support 442 can include a bearing to support wheel support shaft 400. By extending wheel support shaft 400 through axle support 442, the upper portion of movable wall assembly 354 is positioned by the plurality of wheels 416 located in the plurality of tracks 384 located above movable wall assembly 354.

While an impact force F on movable wall assembly 354 can be offset from a center position, as shown in FIG. 18, such force F can be centrally located. In such situations, movable wall assembly 354 can move or deflect in a more vertical orientation, as shown in FIG. 19. The more centrally located an impacting or deflecting force F, the more vertical movable wall assembly 354 will be as it moves from the un-deflected position to the deflected position.

FIGS. 22-26 show views of a wall assembly, indicated generally at 450, in accordance with an exemplary embodiment of the present disclosure. In the views of FIGS. 22-26, covers or caps, shields, and shock absorbers are removed to simplify explanation of the figures. Wall assembly 450, which can also be described as wall segment 450 or board 450, includes a support assembly 452 and a movable board or wall assembly 454.

Support assembly 452 can include a plurality of elements, including, for example, a transverse or horizontally extending upper or top frame support 456, which can include a plurality of upper transverse frames 458 that extend in a direction that is approximately perpendicular to movable wall assembly 454, and at least one rear upper connecting frame 460 that extends approximately parallel to movable wall assembly 454. Rear upper connecting frame 460 is attached to and extends along respective ends 462 of upper transverse frames 458 to provide strength and stability to upper transverse frames 458. Such attachment can be, for example, by way of fasteners and brackets (not shown), welding, or other attachment devices and mechanisms. Each end 462 is located at an opposite end of a respective upper transverse frame 458 from movable wall assembly 454 when movable wall assembly 454 is in an un-deflected position.

Support assembly 452 can also include a front upper connecting frame 464 (shown partially removed in FIG. 26) that extends approximately parallel to movable wall assembly 454 and approximately parallel to rear upper connecting frame 460. Front upper connecting frame 464 is attached to and extends along respective ends 472 of upper transverse frames 458 to provide strength and stability to upper transverse frames 458. Such attachment can be, for example, by way of fasteners and brackets (not shown), welding, or other attachment devices and mechanisms. Upper connecting frame 464 can also function as a "stop" for movable wall assembly 454. In other words, when movable wall assembly 454 is at an un-deflected position, upper connecting frame 464 prevents movable wall assembly from moving further from support assembly 452, which would thus cause movable wall assembly to disengage with tracks located on support assembly 452 (the tracks are discussed in more detail hereinbelow). Each end 472 is located at an opposite end of a respective upper transverse frame 458 from end 462. In addition, each end 472 is near to, adjacent to, close to, alongside of, or proximate to movable wall assembly 454 when movable wall assembly 454 is in an un-deflected position.

Support assembly 452 can also include a transverse or horizontally extending lower or bottom support frame 466, which can include a plurality of lower transverse frames 468 that extend in a direction that is approximately perpendicular to movable wall assembly 454, at least one rear, lower, connecting frame 470 that extends approximately parallel to a front or outer surface of movable wall assembly 454, and at least one front, lower, connecting frame 474 (shown partially removed in FIG. 26) that also extends approximately parallel to a front or outer surface of movable wall assembly 454. Rear, lower, connecting frame 470 can be connected to respective ends 476 of each lower transverse frame 468, each end 476 positioned at a location that is at an opposite end of a respective lower transverse frame 468 from the un-deflected position of movable wall assembly 454. Rear, lower, connecting frame 470 helps to provide strength and stability to lower transverse frames 468. The attachment of rear, lower, connecting frame 470 to each respective lower transverse frame 468 can be, for example, by way of fasteners and brackets (not shown), welding, or other attachment devices and mechanisms.

Figure 22:
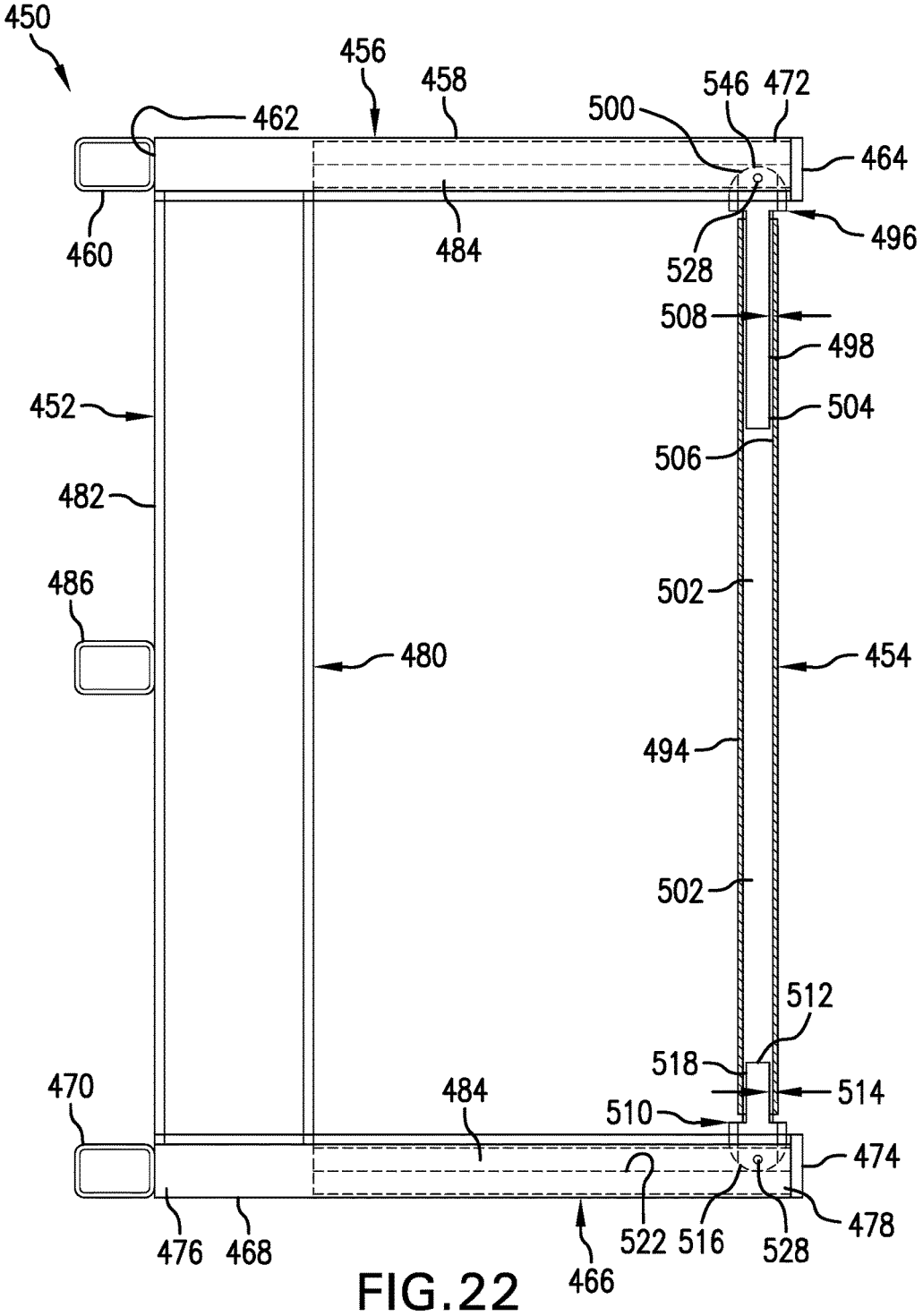
FIG. 22 shows a view of a wall assembly in accordance with an exemplary embodiment of the present disclosure.

Front, lower, connecting frame 474 can be connected to respective ends 478 of each lower transverse frame 468, each end 478 positioned at a location that is at, near to, close to, adjacent to, alongside to, or in proximity to, movable wall assembly 454 when movable wall assembly 454 is in the un-deflected position shown in FIG. 22. Each end 478 is also at an opposite end of a respective lower transverse frame 468 from end 476. Front, lower, connecting frame 474 helps to provide strength and stability to lower transverse frames 468, particularly in conjunction with rear, lower, connecting frame 470. The attachment of front, lower, connecting frame 474 to each respective lower transverse frame 468 can be, for example, by way of fasteners and brackets (not shown), welding, or other attachment devices and mechanisms.

Front, lower, connecting frame 474 can also function as a "stop" for movable wall assembly 454. In other words, when movable wall assembly 454 is at an un-deflected position, front, lower, connecting frame 474 prevents movable wall assembly from moving further from support assembly 452, which would thus cause movable wall assembly to disengage with tracks located on support assembly 452 (the tracks are discussed in more detail hereinbelow).

Support assembly 452 can also include a vertically extending support frame assembly 480 that is positioned between upper or top support frame 456 and lower or bottom support frame 466. Support frame assembly 480 can include a plurality of vertically extending connecting frames 482, each of which is attached or connected to upper or top support frame 456 and lower or bottom support frame 466 by way of fasteners, brackets, welding, and the like. Such connection of each connecting frame 482 can be directly to, for example, a respective upper transverse frame 458 and directly to a respective lower transverse frame 468. In addition, the connection of each connecting frame 482 to the respective upper transverse frame 458 and the respective lower transverse frame 468 can be at a location on upper transverse frame 458 near to, close to, alongside to, adjacent to, in proximity to, or at end 462 and at a location on lower transverse frame 468 that is near to, close to, alongside to, adjacent to, in proximity to, or at end 476. Each connecting frame 482 can be in a conventional beam configuration, can be an extruded square or rectangular tube, can be a welded assembly, and the like. Though not shown in FIGS. 22-26, each connecting frame 482 is preferably hollow to conserve weight.

Each disclosed element of wall assembly 450 that is labeled with an identical number can be identically configured, or each element can be different from each other. For example, some vertically extending connecting frames 482 can be square or rectangular tubes, and other frames 482 can be U-shaped or V-shaped.

Each upper transverse frame 458 and each lower transverse frame 468 can include a track 484 that is approximately parallel to a respective upper transverse frame 458 and/or lower transverse frame 468. Thus each track 484 is also approximately perpendicular to movable wall assembly 454. Each track 484 can be integrally formed with each respective upper transverse frame 458 or lower transverse frame 468, or each track 484 can be a separate piece attached, fastened, connected, or otherwise affixed to each respective upper transverse frame 458 or lower transverse frame 468.

Wall assembly 450 can further include a plurality of walls or caps to cover portions of support assembly 452 and movable wall assembly 454 to prevent access to internal locations of wall assembly 450. For example, wall assembly 450 can include a front wall such as front wall 330 shown in FIGS. 15 and 16 that can be fabricated from a strong, lightweight plastic, composite, or wood material. Though not shown in FIGS. 22-26, wall assembly 450 can also include a top cap or cover that may be similar to, for example, top cap or cover 44 shown in FIGS. 1 and 2, which connects or attaches to one or more of the sub-components included in upper or top support frame 456, such as one or more upper transverse frames 458. Wall assembly 450 can also include a back cap or cover (not shown) that may be similar to, for example, back cap or cover 46 shown in FIGS. 1 and 2, which connects or attaches to one or more of the subcomponents included in upper or top support frame 456, lower or bottom support frame 466, and/or vertically extending support frame assembly 480, such as rear upper connecting frame 460, rear, lower, connecting frame 470, and/or vertical connecting frames 482.

Vertically extending support frame assembly 480 can further include an intermediate transverse frame 486 that can be positioned at or near a vertically central location of each vertical connecting frame 482, which can thus be approximately a mid-point of each vertical connecting frame 482. More broadly, intermediate transverse frame 486 can be positioned at a location that is directly between rear upper connecting frame 460 and lower connecting frame 470. Intermediate transverse frame 486 can attach or connect to each vertical connecting frame 482 by way of fasteners, welding, sintering, one or more brackets, and the like. Such attachment of intermediate transverse frame 486 can be directly to each vertical connecting frame 482.

Figure 26:
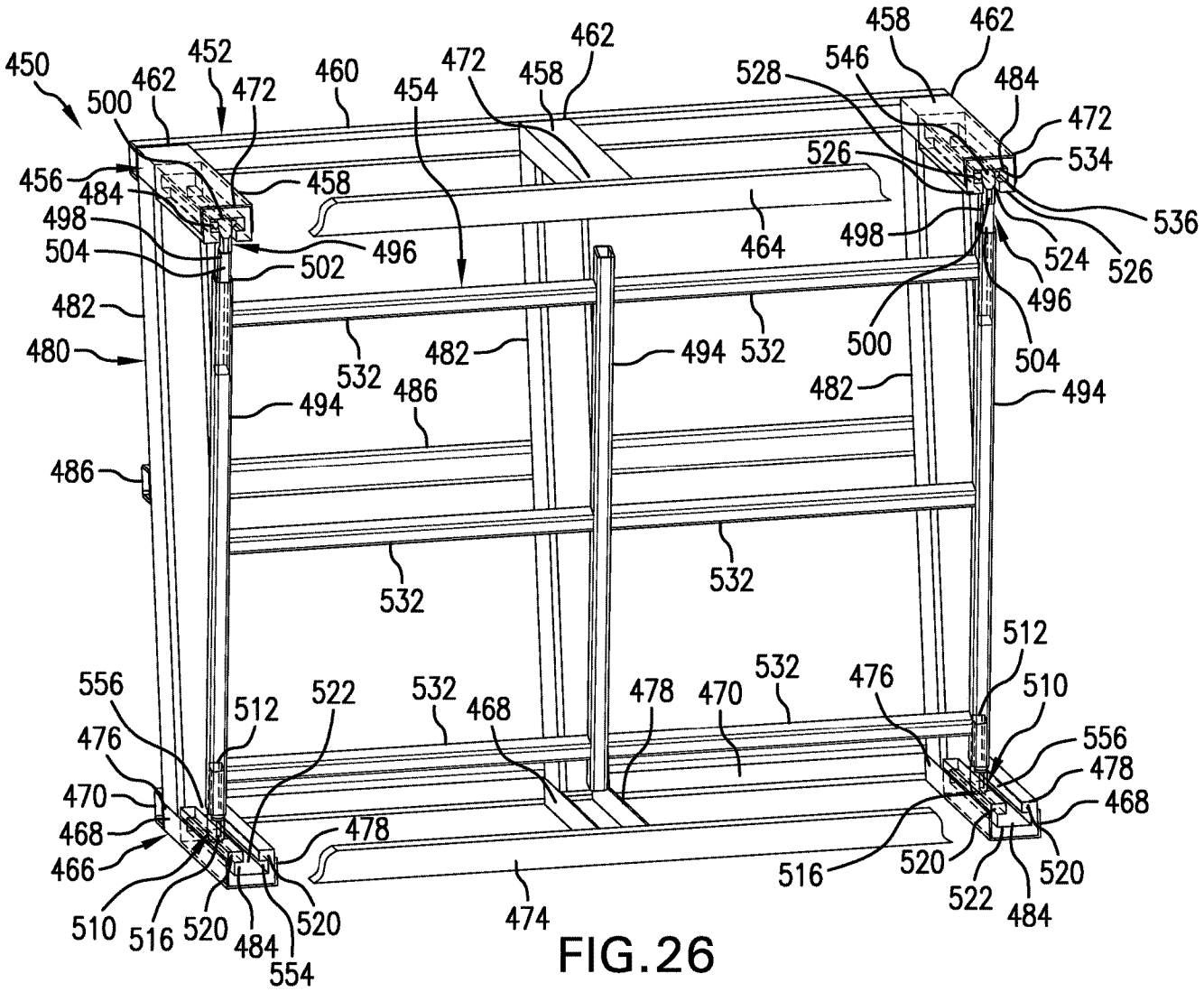
FIG. 26 shows a further view of the wall assembly of FIG. 22.

Movable wall assembly 454 can include a plurality of front wall supports 494 to which a front wall, such as front wall 330 shown in FIGS. 15 and 16, is attached. Such attachment of the front wall to each front wall support 494 can be by way of a fastener, brackets, and other attachment devices. Movable wall assembly 454 can also include a plurality of transverse front wall supports 532, such as is shown in FIG. 26.

Transverse front wall supports 532 can extend approximately perpendicularly to front wall supports 494, and connect front wall supports 494 to each other to provide strength to front wall supports 494. The attachment of transverse front wall supports 532 to front wall supports 494 can be by, for example, welding, fasteners, brackets, adhesives, and other fastening apparatus and methods. Transverse front wall supports 532 can be positioned vertically along front wall supports 494 in a first, lower or bottom location that is closer to a bottom end of front wall supports 494 than to a top end, which is also close to lower or bottom support frame 466. Transverse front wall supports 532 can also be positioned vertically along front wall supports 494 in a second, upper or top location that is closer to a top end of front wall supports than to a bottom end, which is also close to upper or top support frame 456. Transverse front wall supports 532 can also be positioned at or near a mid-point of the plurality of front wall supports 494, which is a location that is directly between transverse front wall supports 532 that are located near a top of the plurality of front wall supports 494 and transverse front wall supports 532 that are located near a bottom of the plurality of front wall supports 494. It should be understood that because a front wall, such as front wall 330 disclosed elsewhere herein, provides strength to movable wall assembly 454, the number of transverse front wall supports 532 can be more or less than the number disclosed herein depending on the strength of the front wall.

For example, in an exemplary embodiment the top transverse wall supports 532 can be shifted downwardly away from the top end of front wall supports 494 and the bottom transverse wall supports 532 can be shifted upwardly away from the bottom end of front wall supports 494, and in this configuration only four transverse wall supports 532 are part of a movable wall assembly. In yet another exemplary embodiment, the two transverse wall supports 532 near the mid-point of front wall supports 494 can be shifted upwardly or downwardly, and additional transverse wall supports 532 can be added in the space provided by the shifting of the transverse wall supports. It should be understood that transverse wall supports 532 can be approximately equally spaced from each other, or the distances between transverse wall supports 532 can be different to modify weight distribution and thus the movement responsiveness of an upper or lower part of movable wall assembly 454.

Each front wall support 494, shown in cross section in FIG. 22, includes at least one interior cavity 502. Interior cavity 502 can be in the form of a cylinder, a rectangle, or a square. Thus, interior cavity 502 can be defined by a diameter, a width and a length, or other dimensions that define the size and shape of interior cavity 502.

Each front wall support 494 can further support an upper knife assembly 496. Each upper knife assembly 496 is sized and dimensioned to ride along a respective track 484. Knife assembly 496 is described as "upper" because each knife assembly 496 is positioned at a location that is vertically spaced or separated from, for example, lower or bottom support frame 466, which is configured to be positioned on base 16 (e.g., see FIGS. 1 and 2) or on an edge or periphery of activity surface 60, disclosed elsewhere herein.

Each upper knife assembly 496 can include a knife assembly support 498, a knife 500 positioned on and connected to knife assembly support 498, and a pin 528 positioned in knife 500. Each knife assembly support 498 includes an exterior surface 504 that is approximately a same shape as an interior wall 506 of front wall support 494, with a clearance or gap 508 between interior wall 506 and exterior surface 504. Clearance or gap 508, which in an exemplary embodiment can be in a range from, for example, 0.02 inches to 0.10 inches, enables relatively easy sliding movement between front wall support 494 and a respective knife assembly support 498, as disclosed in more detail hereinbelow.

Knife 500 can be a separate piece that is directly or indirectly attached to knife assembly support 498. Knife 500 can also be integrally formed with knife assembly support 498. Though described as a "knife," knife 500 includes a width 544 that in an exemplary embodiment can be in the range 0.5 to 1 inch, depending on the material chosen. Knife 500 extends in a direction that is approximately parallel to the respective front wall support 494. Thus, when the respective front wall support 494 is vertical, such as is shown in FIG. 22, then knife 500 is approximately perpendicular to upper transverse frame 458.

Knife 500 includes a curvilinear upper surface 546. The purpose of curvilinear upper surface 546 is to provide clearance with an upper interior surface 534 of upper transverse frame 458 as movable wall assembly 454 deflects at an angle, such as the angle shown in FIGS. 23 and 26. Curvilinear upper surface 546 can be in the form of a semicircle in a side view of knife 500, such as the side view of FIG. 22.

Pin 528 can be press or interference fit into an opening formed in knife 500, and can extend perpendicularly to knife 500. In another exemplary embodiment pin 528 is integrally formed with knife 500. Pin 528 extends away from knife 500 on both sides of knife 500, as can be seen in, for example, FIG. 26. In an exemplary embodiment, a distance pin 528 extends from knife 500 is approximately equidistant on both sides of knife 500.

Each front wall support 494 can further support a lower knife assembly 510. Each lower knife assembly 510 is sized and dimensioned to ride along a respective track 484. Knife assembly 510 is described as "lower" because each knife assembly 510 is positioned at a location that is vertically closer to the ground than, for example, upper knife assembly 496. In addition, lower knife assembly 510 would typically be adjacent to, next to, close to, alongside, near to, or in proximity to base 16, as well as lower or bottom support frame 466.

Each lower knife assembly 510 can include a knife assembly support 512, a knife 516 positioned on and connected to knife assembly support 512, and a pin 528 positioned in knife 516. Each knife assembly support 512 includes an exterior surface 518 that is approximately a same shape as interior wall 506 of front wall supports 494, with a clearance or gap 514 between interior wall 506 and exterior surface 518. Clearance or gap 514, which in an exemplary embodiment can be in a range from, for example, 0.02 inches to 0.10 inches, enables relatively easy sliding movement between front wall support 494 and a respective knife assembly support 512, as disclosed in more detail hereinbelow.

Knife 510 can be a separate piece that is directly or indirectly attached to knife assembly support 512. Knife 510 can also be integrally formed with knife assembly support 512. Though described as a "knife," knife 510 includes a width 544 that in an exemplary embodiment can be in the range 0.5 to 2 inches, depending on the material chosen. Knife 510 extends in a direction that is approximately parallel to the respective front wall support 494. Thus, when the respective front wall support 494 is vertical, such as is shown in FIG. 22, then knife 510 is approximately perpendicular to lower transverse frame 468.

Knife 510 includes a curvilinear lower surface 552. The purpose of curvilinear lower surface 552 is to provide smooth movement of movable wall assembly 454 as movable wall assembly rotates or deflects from the vertical position shown in FIG. 22 to a tilted, angled, or deflected position shown in, for example, FIGS. 23 and 26. Curvilinear lower surface 552 can be in the form of a semicircle in a side view of knife 510, such as the side view of FIG. 22.

Pin 528 can be press or interference fit into an opening formed in knife 510, and can extend perpendicularly to knife 510. In another exemplary embodiment pin 528 is integrally formed with knife 510. Pin 528 extends away from knife 510 on both sides of knife 510, as can be seen in, for example, FIGS. 25 and 26. In an exemplary embodiment, a distance pin 528 extends from knife 510 is approximately equidistant on both sides of knife 510.

Figure 25:
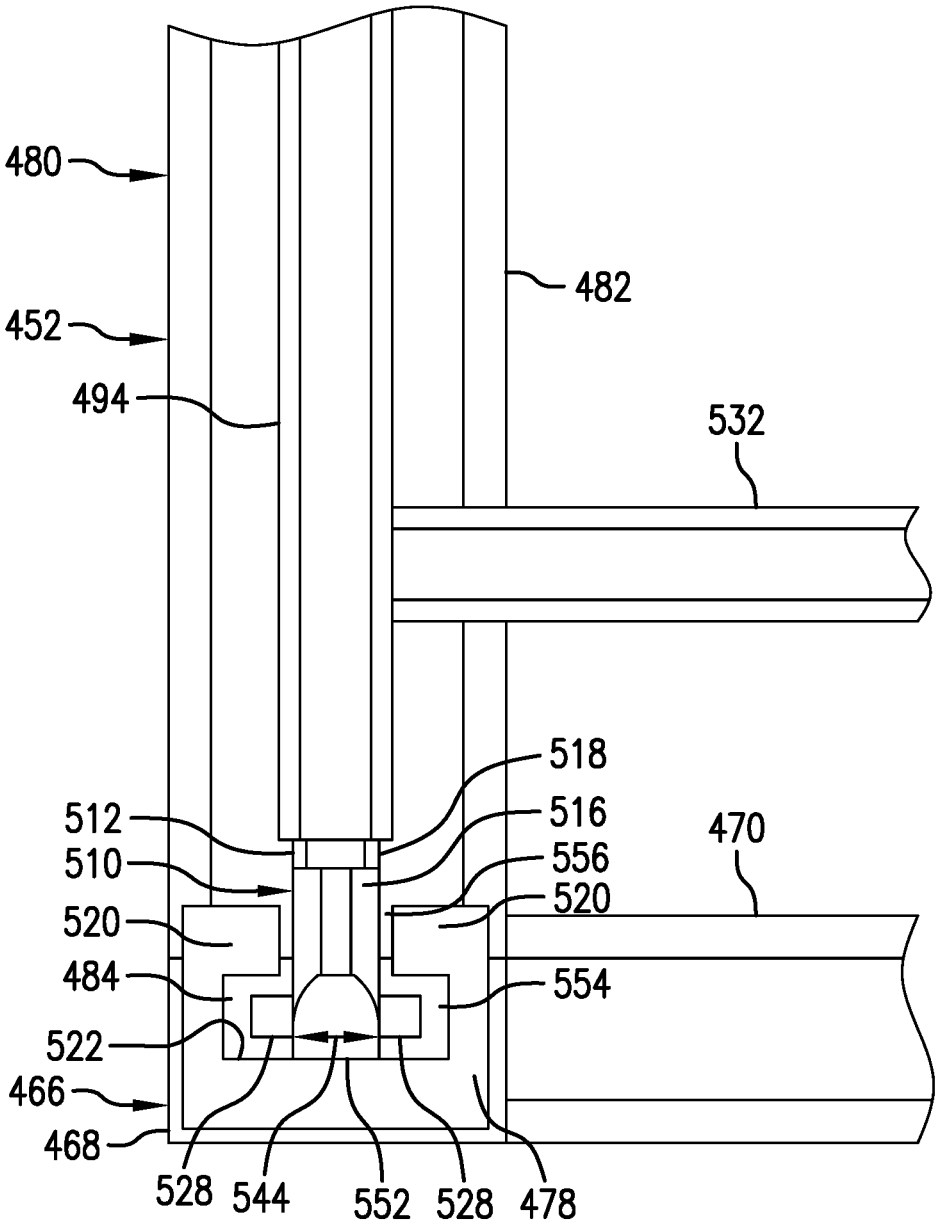
FIG. 25 shows a view of a portion of the wall assembly of FIG. 22.

FIG. 25 shows details of a lower track 484 and a knife assembly, e.g., lower knife assembly 510, positioned in track 484. Track 484 can be formed at least partially or entirely within lower transverse frame 468. Lower transverse frame 468 can be formed as an extrusion, by stamping, by welding separate pieces together, or by other techniques. Lower transverse frame 468 can include an opening 554 adjacent to end 478, and knife assembly 510 can be inserted or positioned in lower track 484 by way of opening 554. After insertion of knife assembly 510, front, lower connecting frame 474 can be attached to lower transverse frame 468 to cover opening 554 and to prevent removal of knife assembly 510.

Lower transverse frame 368 can also include an opening 556 that extends from end 478 to end 476 of lower transverse frame 468 to enable knife assembly 510 to extend from an exterior of lower transverse frame 468 to an interior of lower transverse frame 468. In an exemplary embodiment, knife 516 extends from the exterior of lower transverse frame 468 through opening 556 into the interior of lower transverse frame 468. Opening 556 is formed by a pair of lips 520 that extend toward each other to retain pin 528 within track 484 during operation, which thus prevents knife 516 from lifting out from track 384 during operation. Curvilinear lower surface 552 of knife 516 can ride on an interior surface 522 of lower transverse frame 468 due to the force of gravity as movable wall assembly 454 is deflected by force against movable wall assembly 454. Thus, movable wall assembly 454 is supported by a plurality of knives 516 located in a plurality of tracks 484. It should be apparent that movable wall assembly 454 is thus supported within support assembly 452 by knives 516, which support knife assembly supports 512, which support front walls supports 494, along with a front wall such as front wall 330, along with the other elements of movable wall assembly 454.

Figure 23:
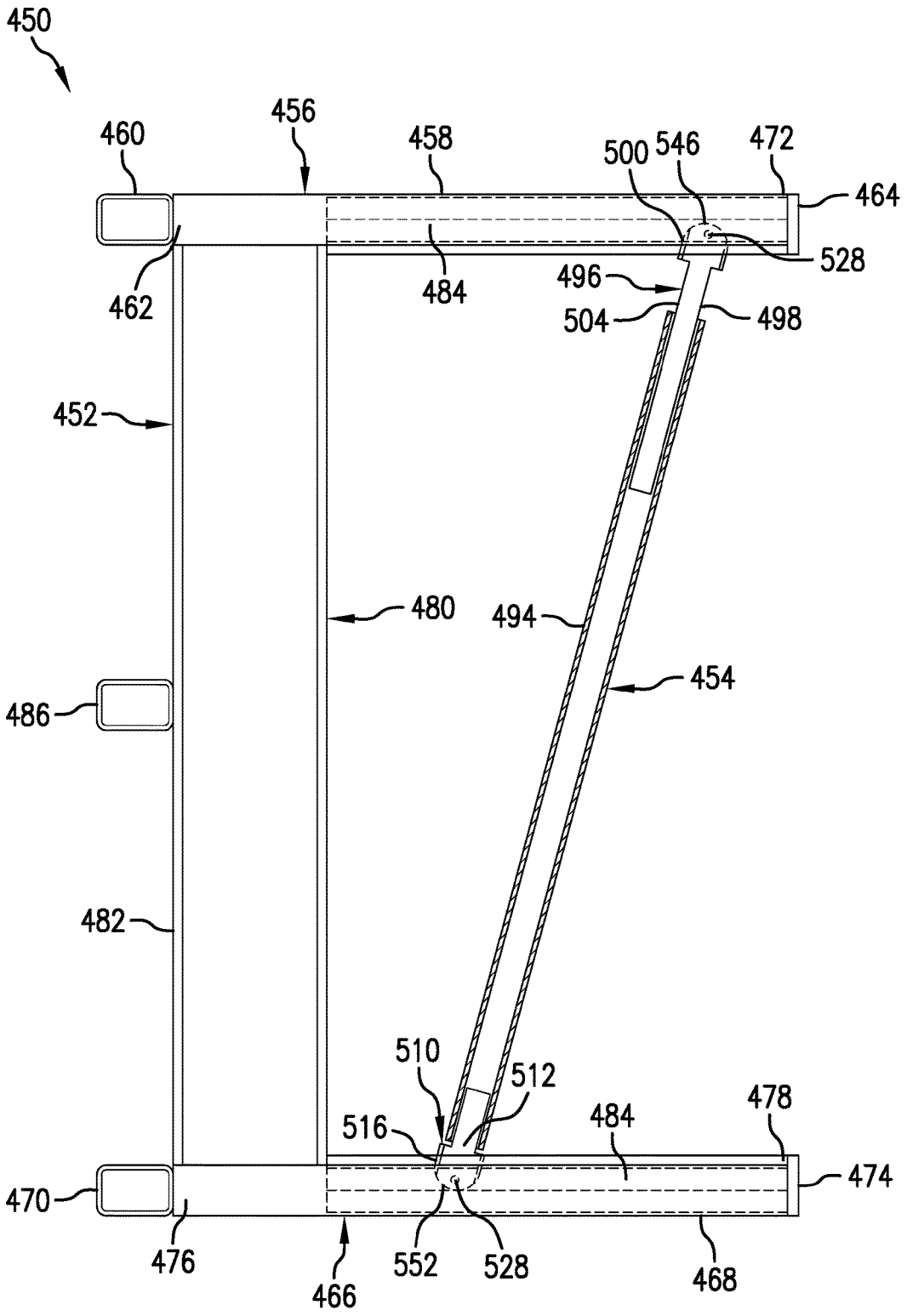
FIG. 23 shows a view of the wall assembly of FIG. 22 with a bottom portion of a movable wall assembly portion deflected by a force.

Upper transverse frame 458 can also include an opening 524 that extends from end 472 to end 462 of upper transverse frame 458 to enable upper knife assembly 496 to extend from an exterior of upper transverse frame 458 to an interior of upper transverse frame 458. Opening 524 is formed by a pair of lips 526 that extend toward each other to capture pin 528 within track 484 during operation. Upper transverse frame 458 also includes upper interior surface 534 and a lower interior surface 536 formed on an upper side of each of lips 526. It should be understood that each knife assembly support 498 "floats" within respective front wall support 494. Thus, when movable wall assembly 454 deflects as shown in FIGS. 23 and 26 due to a force, such as force F shown in FIG. 18, applied to movable wall assembly 454, the contact between pin 528 and lower interior surface 536 of respective upper transverse frame 458 prevents pin 528, along with knife 500 and knife assembly support 498, from moving downwardly as respective front wall support 494 moves away from respective transverse frame 458, and respective front wall support 494 slides along knife assembly support 498 during movement away from respective transverse frame 458. During this motion, due to the force of gravity and/or the friction between knife assembly support 498 and respective transverse frame 458, pin 528 connected to knife support assembly 498 will contact and slide along lower interior surface 536.

After the force on movable wall assembly 454 is removed, shock absorbers, which are not shown in FIGS. 22-26, but which are shown elsewhere herein, restore movable wall assembly 454 from the deflected position shown in FIGS. 23 and 26 to the un-deflected position shown in FIG. 22. As movable wall assembly 454 returns to the un-deflected position near a front side of wall assembly 450 that is adjacent to activity surface 60, movable wall assembly 454 moves from the angled orientation shown in FIGS. 23 and 26 to the vertical orientation shown in FIG. 22, i.e., approximately 90 degrees with respect to a ground plane. As movable wall assembly 454 returns to the vertical orientation, the upper or top end of each front wall support 494 moves toward the respective upper transverse frame 458. As front wall support 494 moves toward upper transverse frame 458, upper knife assembly 496 can move upwardly due to friction between knife assembly support 498 and front wall support 494. Thus, as movable wall assembly 454 moves from the position shown in FIGS. 23 and 26 to the position shown in FIG. 22, knife 500 positioned in upper transverse frame 458 can move upwardly to contact and slide along upper interior surface 534 of upper transverse frame 458. Also as movable wall assembly 454 moves from the position shown in FIGS. 23 and 26 to the position shown in FIG. 22, wheel assembly support 498 can no longer move upwardly due to the contact between curvilinear upper surface 546 and upper interior surface 534. Accordingly, front wall support 494 slides along exterior surface 504 of knife assembly support 498 to decrease the portion of knife assembly support 498 that extends outside front wall support 494. The relative movement of upper knife assembly 496 with respect to front wall support 494 can be described as "telescoping," since one element moves into and out from the other element. More specifically, knife assembly support 498 telescopes with respect to front wall support 494.

Figure 24:
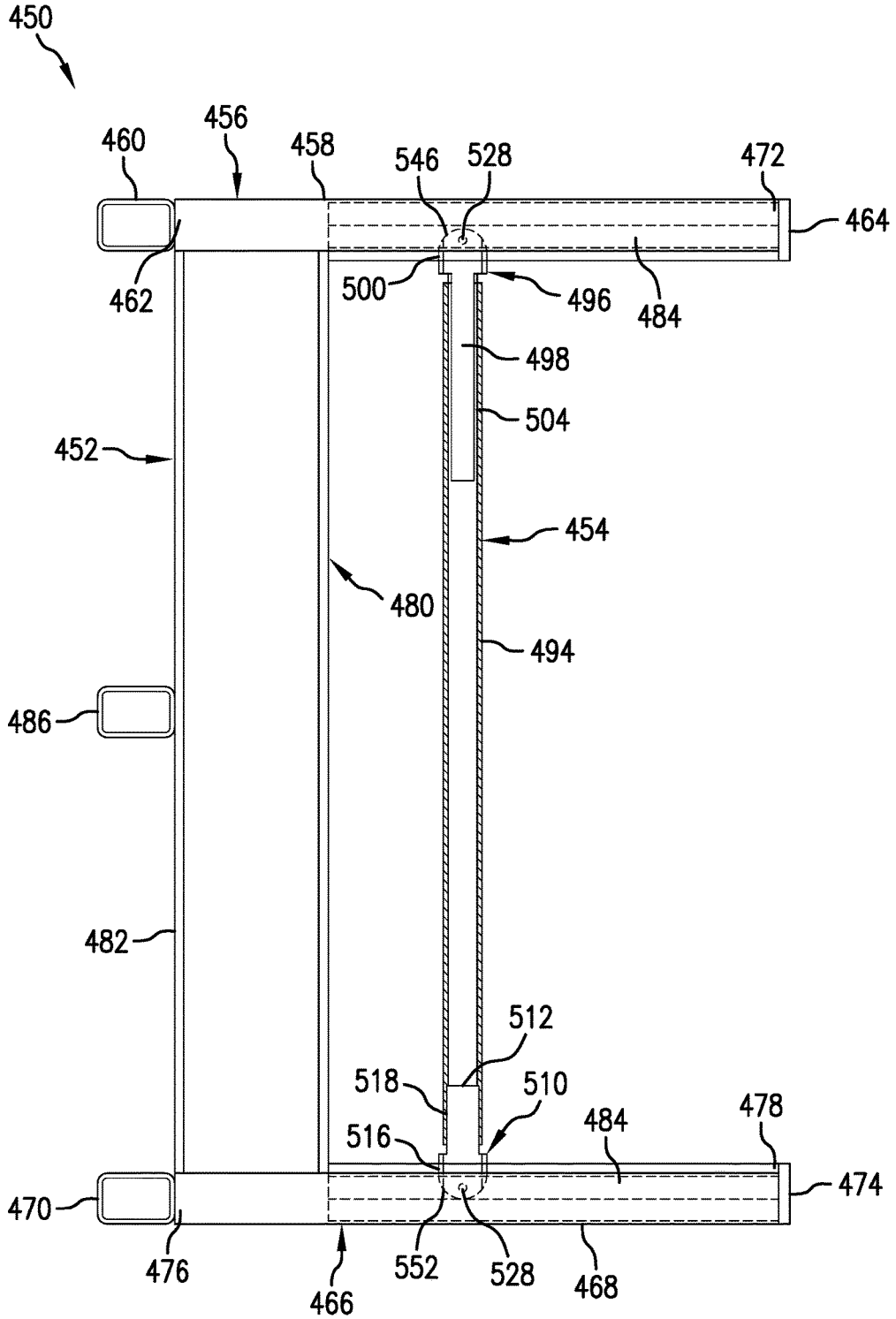
FIG. 24 shows a view of the wall assembly of FIG. 22 with the entire movable wall assembly portion of FIG. 23 moved by a force.

While an impact force on movable wall assembly 454 can be offset from a center position, as shown in FIG. 22, such force can be centrally located. In such situations, movable wall assembly 454 can move or deflect in a more vertical orientation, as shown in FIG. 24. The more centrally located an impacting or deflecting force, the more vertical movable wall assembly 454 will be as it moves from the un-deflected position to the deflected position.

Figure 27:
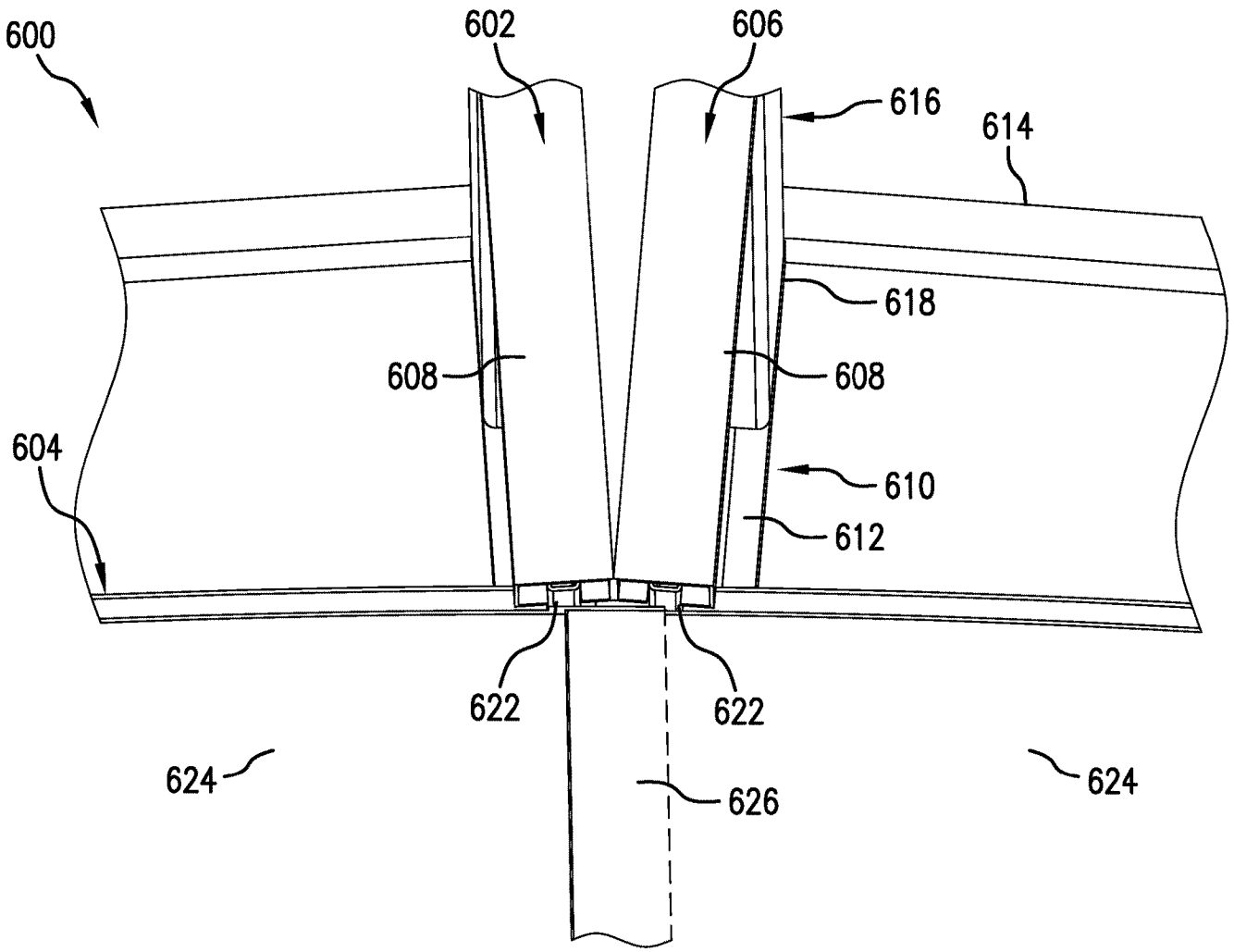
FIG. 27 shows a view of a wall assembly in accordance with another exemplary embodiment of the present disclosure.
Figure 28:
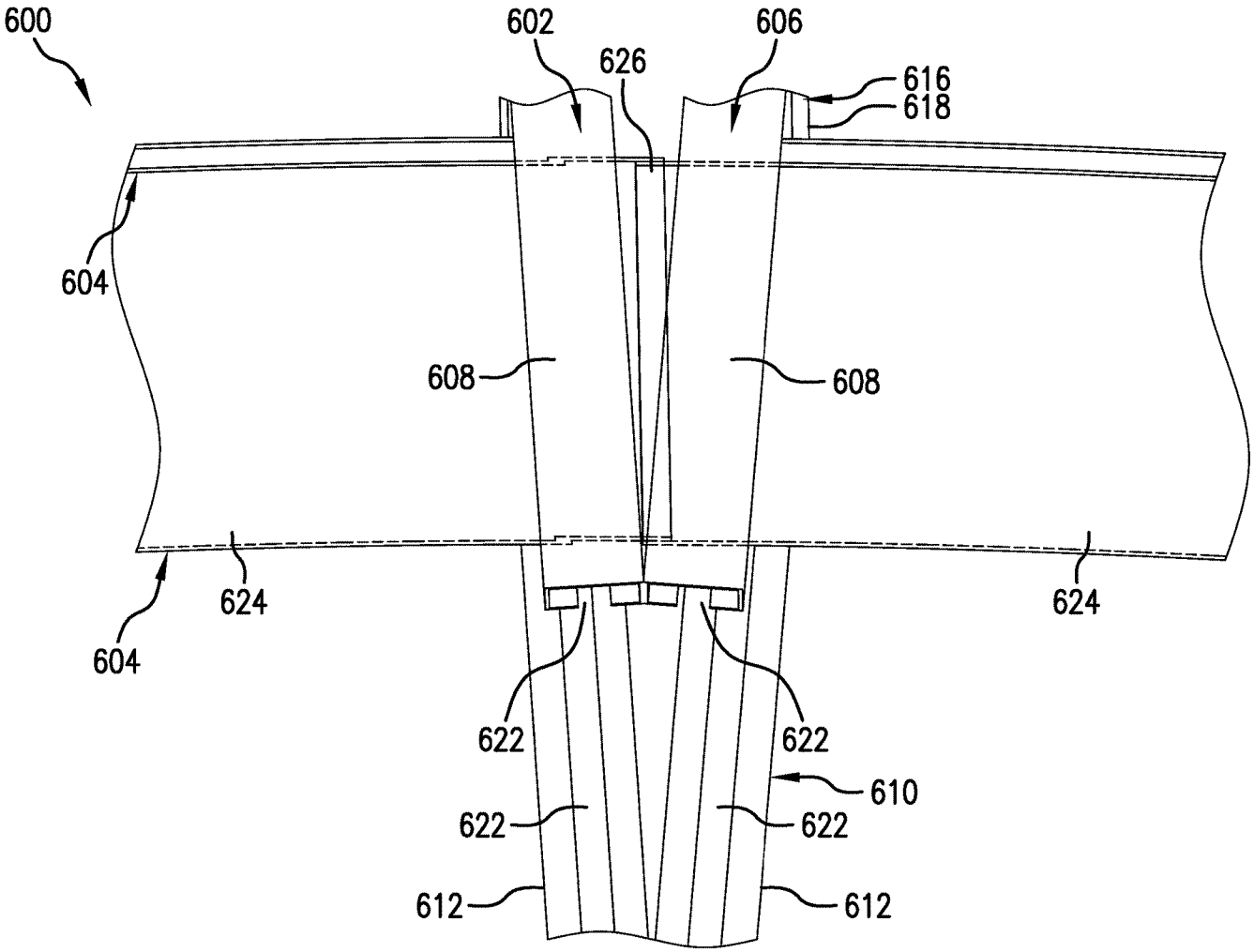
FIG. 28 shows a further view of the wall assembly of FIG. 27.

FIGS. 27 and 28 show views of a portion of a wall assembly, indicated generally at 600, in accordance with another exemplary embodiment of the present disclosure. Wall assembly 600 includes a support assembly 602 and a movable wall board or wall assembly 604 movably positioned on support assembly 602. It should be understood that wall assembly 600 can be configured similar to any of the other embodiments disclosed herein, except to the extent differences with other embodiments are disclosed. It should also be understood that the principles of the embodiment of FIGS. 27 and 28 can be incorporated into other embodiments disclosed herein.

Support assembly 602 can include a plurality of elements, including, for example, and a transverse or horizontally extending upper or top frame support 606, which can include a plurality of upper transverse frames 608 that extend in a direction that is approximately perpendicular to movable wall assembly 604. Support assembly 602 can also include a transverse or horizontally extending lower or bottom support frame 610, which can include a plurality of lower transverse frames 612 that extend in a direction that is approximately perpendicular to movable wall assembly 604, and at least one rear, lower, connecting frame 614 that extends approximately parallel to a front or outer surface of movable wall assembly 604. Rear, lower, connecting frame 614 helps to provide strength and stability to lower transverse frames 612. The attachment of rear, lower, connecting frame 614 to each respective lower transverse frame 612 can be, for example, by way of fasteners and brackets (not shown), welding, or other attachment devices and mechanisms.

Support assembly 602 can also include a vertically extending support frame assembly 616 that is positioned between upper or top support frame 606 and lower or bottom support frame 610. Support frame assembly 616 can include a plurality of vertically extending connecting frames 618, each of which is attached or connected to upper or top support frame 606 and lower or bottom support frame 610 by way of fasteners, brackets, welding, and the like. Such connection of each connecting frame 618 can be directly to, for example, a respective upper transverse frame 608 and directly to a respective lower transverse frame 612, as disclosed elsewhere herein. Each connecting frame 618 can be in a conventional beam configuration, can be an extruded square or rectangular tube, can be a welded assembly, and the like. Though not shown in FIGS. 27 and 28, each connecting frame 618 is preferably hollow to conserve weight.

Each upper transverse frame 608 and each lower transverse frame 612 can include a track 622 that is approximately parallel to a respective upper transverse frame 608 and/or lower transverse frame 612. Thus each track 622 is also approximately perpendicular to movable wall assembly 604. Each track 622 can be integrally formed with each respective upper transverse frame 608 or lower transverse frame 612, or each track 622 can be a separate piece attached, fastened, connected, or otherwise affixed to each respective upper transverse frame 608 or lower transverse frame 612.

Wall assembly 600 can further include a plurality of walls or caps to cover portions of support assembly 602 and movable wall assembly 604 to prevent access to internal locations of wall assembly 600. For example, wall assembly 600 can include a front wall 624 that can be fabricated from a strong, lightweight plastic, composite, or wood material. Though not shown in FIGS. 27 and 28, wall assembly 600 can also include a top cap or cover that may be similar to, for example, top cap or cover 44 shown in FIGS. 1 and 2, which connects or attaches to one or more of the subcomponents included in upper or top support frame 606, such as one or more upper transverse frames 608. Wall assembly 600 can also include a back cap or cover (not shown) that may be similar to, for example, back cap or cover 46 shown in FIGS. 1 and 2, which connects or attaches to one or more of the subcomponents included in upper or top support frame 606, lower or bottom support frame 610, and/or vertically extending support frame assembly 616, such as rear, lower, connecting frame 614, and/or vertical connecting frames 618.

As can be seen in FIG. 27, adjacent front walls 624 of adjacent wall assemblies 600 overlap in overlap region 626. When a force is applied to movable wall assembly 602 to a left of overlap region 626, a right of overlap region 626, or on overlap region 626, the movable wall assembly 600 to the left of overlap region 626 and the movable wall assembly to the right of overlap region 626 move because of a connection between adjacent movable wall assemblies 602, which can be by, for example, pins, such as pins 82 disclosed in FIG. 4B. Because two adjacent movable wall assemblies 604 can be positioned at an angle with respect to each other, or because two adjacent movable wall assemblies 604 can be deflected by an applied force at different angles, two adjacent movable wall assemblies 604 can move apart with respect to each other. Thus, the overlap of two adjacent front walls 624 prevents a gap from forming between two adjacent front walls 624 as the two adjacent movable walls assemblies move because of an impacting force.

It can be observed in FIGS. 27 and 28 that as movable wall assemblies 604 of two adjacent wall assemblies 600 positioned at an angle with respect to each other move due to an applied force, overlap region 626 becomes smaller. However, the amount of overlap between two adjacent wall assemblies 600 is designed such that some overlap always exists even when movable wall assemblies 604 are at the maximum possible deflection angle with respect to each other. The overlap between two adjacent front walls 624 reduces the risk of human appendages, clothing, etc., from being caught between two adjacent movable wall assemblies 604 as the two adjacent movable wall assemblies 604 from the position shown in FIG. 27 to the position shown in FIG. 28, and then back again under the restoring force of a shock absorber, embodiments of which are shown elsewhere herein.

Figure 29:
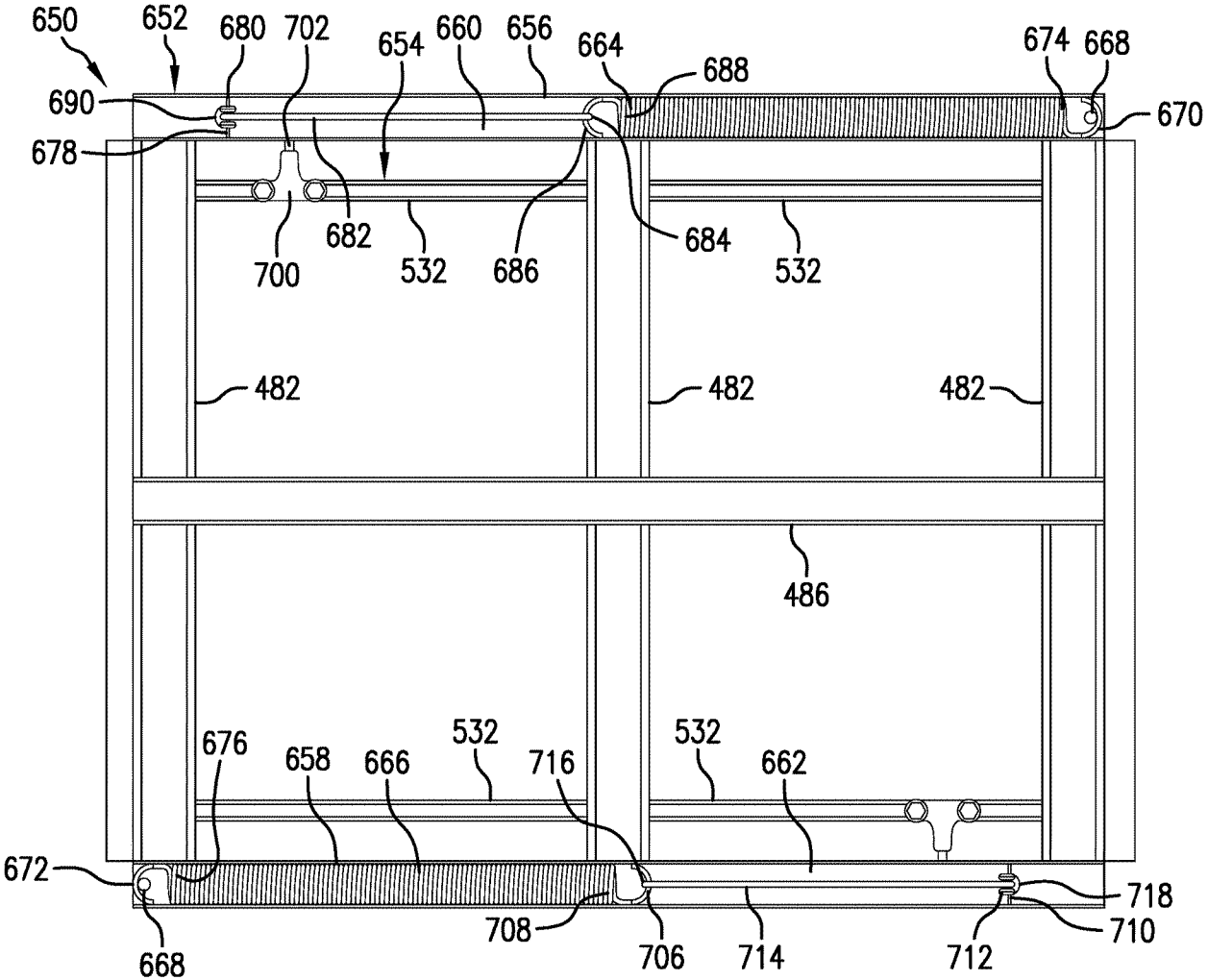
FIG. 29 shows a view of a wall assembly in accordance with yet another exemplary embodiment of the present disclosure.
Figure 30:
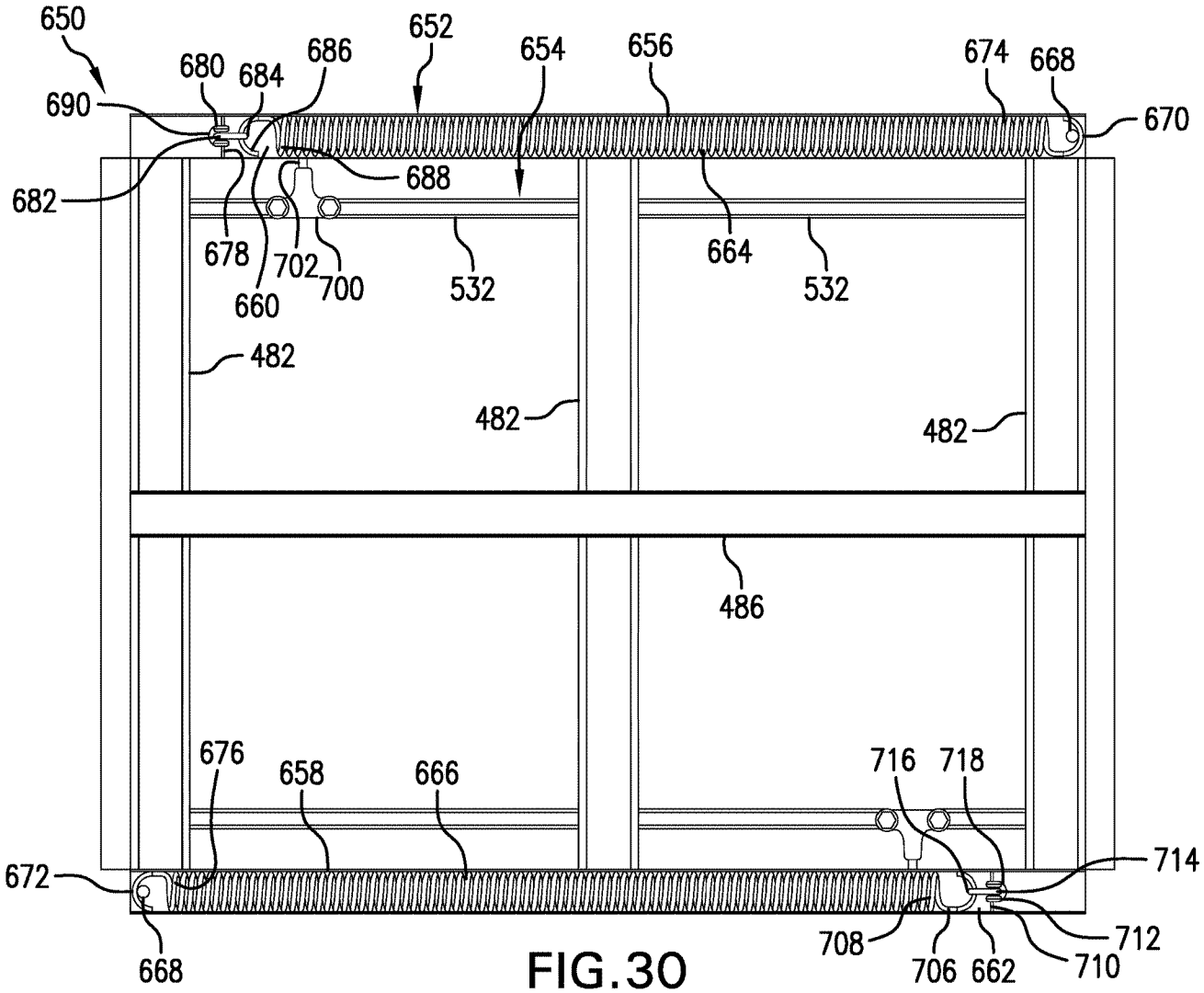
FIG. 30 shows a further view of the wall assembly of FIG. 29.
Figure 31:
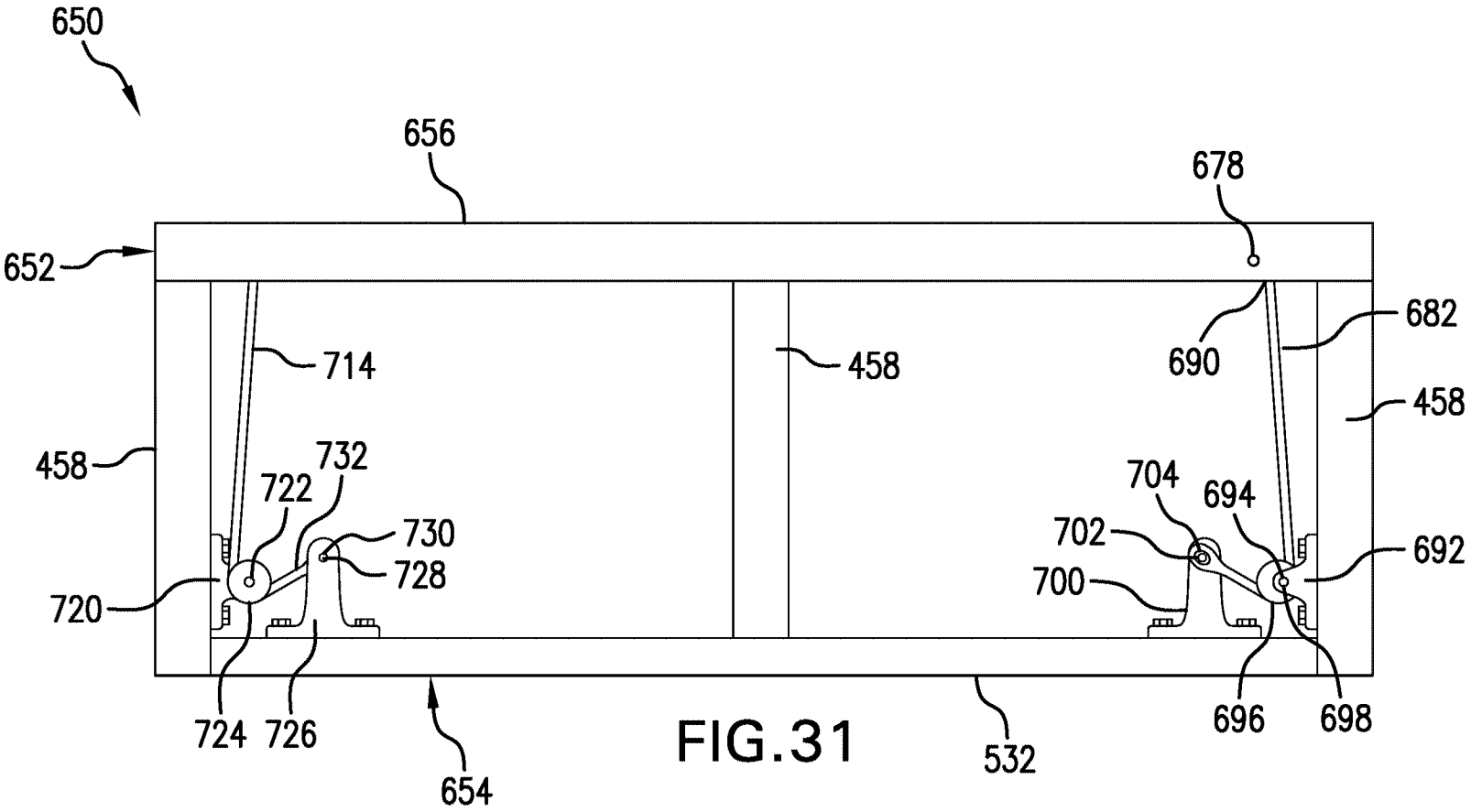
FIG. 31 shows a top view of the wall assembly of FIG. 29, looking down on the wall assembly of FIG. 29.

FIGS. 29-31 show views a wall assembly, indicated generally at 650, in accordance with yet another exemplary embodiment of the present disclosure. For ease of description, the element numbers of FIGS. 22-26 may be used to describe the elements of wall assembly 650, except to describe the shock absorber configuration of FIGS. 29 and 30. Wall assembly 650 includes a support assembly 652 and a movable board or wall assembly 654. Support assembly 652 can include a rear, upper connecting frame 656 and a rear, lower connecting frame 658. Positioned at least partially within a cavity 660 formed in rear, upper connecting frame 656 is a shock absorber or extension spring 664, and in a cavity 662 formed in rear, lower connecting frame 658 is a shock absorber or extension spring 666.

Each of extension spring 664 and extension spring 666 is secured within respective cavity 660 and cavity 662. In the exemplary embodiment of FIGS. 29 and 30, a pin 668 extends from a respective one of rear upper connecting frame 656 and rear, lower connecting frame 658 into cavity 660 and cavity 662, respectively. Extension spring 664 includes a first hook or loop 670 at a first end 674, and first hook or loop 670 is secured in cavity 660 by the engagement of first hook or loop 670 with a first one of pin 668. Similarly, extension spring 666 includes a hook or loop 672 at a first end 676, and first hook or loop 670 is secured in cavity 662 by engagement of hook or loop 672 with a second one of pin 668. Each of extension spring 664 and 666 extends from respective first pin 668 and second pin 668 across and along rear upper connecting frame 656 and rear lower connecting frame 658, respectively. The configuration of each extension spring 664 and 666 is disclosed separately.

Extension spring 664, which may also be described as first extension or upper extension spring 664, includes a second hook or loop 686 at a second end 688 that is at an opposite end of extension spring 664 from first end 674. Indeed, first end 674 and second end 688 define the ends of an extending portion of extension spring 664, meaning the location where coils of extension spring 664 transition to first hook or loop 670 and second hook or loop 686, respectively.

Support assembly 652 includes a first shaft 678 that extends vertically across rear upper connecting frame 656 from an upper part of rear upper connecting frame 656, across cavity 660, to a bottom part of rear upper connecting frame 656. Support assembly 652 also includes a first pulley 680 rotatably supported by first shaft 678. Support assembly 652 further includes a first connection cable 682 that includes a first attachment location 684, such as a loop or hook. First attachment location 684 is configured to engage to, attach to, or secure to second hook or loop 686. First connection cable 682 extends from second hook or loop 686 to first pulley 680, wrapping partially around first pulley 680, changing direction from being along and parallel to rear upper connecting frame 656 to a direction that extends from rear upper connecting frame 656 toward movable wall assembly 654. First connection cable 682 then extends from first pulley 680 through a first opening 690 formed in rear upper connecting frame 656.

Referring to FIG. 31, support assembly 652 includes a plurality of upper transverse frames 458. Support assembly 652 further includes a first pulley bracket or support 692, which can be secured or fastened to an upper transverse frame 458 positioned near an end of wall assembly 650. Support assembly 652 also includes a second shaft 694 that is secured to first pulley bracket or support 692 and a second pulley 696 rotatably positioned on second shaft 694. Second shaft 694 can be secured to first pulley bracket or support 692 by a press fit into an opening 698 formed in first pulley bracket or support 692, or by threads formed on second shaft 694 (not shown) that mate with similar threads (not shown) formed in first pulley bracket or support 692, or by way of other attachment configurations. Second shaft 694 can extend in a downward direction to position second pulley 696 at a position lower than upper transverse frame 458.

Movable wall assembly 654 further includes a first anchor bracket or support 700 that is attached to, secured to, or positioned on an upper transverse front wall support 532 that is closest to upper transverse frame 458 on which first pulley bracket or support 692 is positioned. Movable wall assembly 654 also includes a first anchor point or post 702 that is secured to, fastened to, or positioned on first anchor bracket or support 700. First anchor point or post 702 can be secured to first anchor bracket or support 700 by way of, for example, a press fit into an opening (not shown) formed in first anchor bracket or support 700, screw threads (not shown) formed on first anchor point or post 702 that mate with matching threads (not shown) on first anchor bracket or support 700, or by other attachment arrangements. First anchor point or post 702 can extend upwardly in a direction that is opposite to the direction that second shaft 694 extends from first pulley bracket or support 692. Thus, first anchor point or post 702 and second shaft 694 generally extend in directions that are toward each other.

First connection cable 682, which extends from rear upper connecting frame 656 toward movable wall assembly 654, as can be seen in, for example, FIG. 31, includes a second attachment location 704 that is formed at an opposite end of first connection cable 682 from first attachment location 684. Second attachment location 704 can be in the form of a loop, as shown in FIG. 31. Note that first attachment location 684 can similarly be in the form of a loop. First connection cable 682 extends to, and wraps partially around, second pulley 696, changing direction from a first direction that is toward movable wall assembly 654 to a second direction that is at an angle with respect to the first direction that is toward movable wall assembly 654. The second direction can be a direction that is toward rear upper connecting frame 656. After wrapping partially around second pulley 696, first connection cable 682 extends toward first anchor bracket or support 700, and second attachment location 704 of first connection cable 682 is secured to first anchor point or post 702.

Extension spring 666, which may also be described as second extension or lower extension spring 666, includes a second hook or loop 706 at a second end 708 that is at an opposite end of extension spring 666 from first end 676. Indeed, first end 676 and second end 708 define the ends of an extending portion of extension spring 666, meaning the location where coils of extension spring 666 transition to first hook or loop 672 and second hook or loop 706, respectively.

Support assembly 652 includes a third shaft 710 that extends vertically across rear lower connecting frame 658 from an upper part of rear lower connecting frame 658, across cavity 662, to a bottom part of rear lower connecting frame 658. Support assembly 652 also includes a third pulley 712 rotatably supported by third shaft 710. Support assembly 652 further includes a second connection cable 714 that includes a first attachment location 716, such as a loop or hook. First attachment location 716 is configured to engage to, attach to, or secure to second hook or loop 706. Second connection cable 714 extends from second hook or loop 706 to third pulley 712, wrapping partially around third pulley 712, changing direction from being along and parallel to rear lower connecting frame 658 to a direction that extends from rear lower connecting frame 658 toward movable wall assembly 654. Second connection cable 714 then extends from third pulley 712 through a second opening 718 formed in rear lower connecting frame 658.

Similar to FIG. 26, support assembly 652 includes a plurality of lower transverse frames 468, though not shown in FIGS. 29-31. Support assembly 652 further includes a second pulley bracket or support 720, which can be secured or fastened to a lower transverse frame 468 positioned near an end of wall assembly 650 that is at an opposite end of wall assembly 650 from first pulley bracket or support 692.

Support assembly 652 also includes a fourth shaft 722 that is secured to second pulley bracket or support 720 and a fourth pulley 724 rotatably positioned on fourth shaft 722. Fourth shaft 722 can be secured to second pulley bracket or support 720 by a press fit into an opening (not shown) formed in second pulley bracket or support 720, or by threads formed on fourth shaft 722 (not shown) that mate with similar threads (not shown) formed in second pulley bracket or support 720, or by way of other attachment configurations. It should be apparent that the opening formed in second pulley bracket or support 720 can be similar or identical to opening 698 formed in first pulley bracket or support 692. Fourth shaft 722 can extend in an upward direction from second pulley bracket or support 720 to position fourth pulley 724 at a position higher above ground than lower transverse frame 468.

Movable wall assembly 654 further includes a second anchor bracket or support 726 that is attached to, secured to, or positioned on a lower transverse front wall support 532 that is closest to lower transverse frame 468 on which second pulley bracket or support 720 is positioned. Movable wall assembly 654 also includes a second anchor point or post 728 that is secured to, fastened to, or positioned on second anchor bracket or support 726. Second anchor point or post 728 can be secured to second anchor bracket or support 726 by way of, for example, a press fit into an opening 730 formed in second anchor bracket or support 726, screw threads (not shown) formed on second anchor point or post 728 that mate with matching threads (not shown) on second anchor bracket or support 726, or by other attachment arrangements. Second anchor point or post 728 can extend downwardly in a direction that is opposite to the direction that fourth shaft 722 extends from second pulley bracket or support 720. Thus, second anchor point or post 728 and fourth shaft 722 generally extend in directions that are toward each other.

Second connection cable 714, which extends from rear lower connecting frame 658 toward movable wall assembly 654, as can be seen in, for example, FIG. 31, includes a second attachment location 732 that is formed at an opposite end of second connection cable 714 from first attachment location 716. Second attachment location 732 can be in the form of a loop, similar to second attachment location 704 of first connection cable 682 shown in FIG. 31. Note that first attachment location 716 can similarly be in the form of a loop. Second connection cable 714 extends to, and wraps partially around, fourth pulley 724, changing direction from a first direction that is toward movable wall assembly 654 to a second direction that is at an angle with respect to the first direction that is toward movable wall assembly 654. The second direction can be a direction that is toward rear lower connecting frame 658. After wrapping partially around fourth pulley 724, second connection cable 714 extends toward second anchor bracket or support 726, and second attachment location 732 of second connection cable 714 is secured to second anchor point or post 728.

When a force is applied against movable wall assembly 654, the force causes movable wall assembly 654 to move toward rear upper connecting frame 656 and rear lower connecting frame 658. Because first pulley bracket or support 692, second shaft 694, and second pulley 696 are located at a position on upper transverse frame 458 that is higher than the location of a front wall, such as front wall 330 shown in FIG. 15, movable wall assembly 654 is able to move toward rear upper connecting frame 656 and rear lower connecting frame 658 without first pulley bracket or support 692, second shaft 694, and second pulley 696 interfering with the movement of movable wall assembly 654. Similarly, because second pulley bracket or support 720, fourth shaft 722, and fourth pulley 724 are located at a position on lower transverse frame 468 that is lower than the location of a front wall, such as front wall 330 shown in FIG. 15, movable wall assembly 654 is able to move toward rear upper connecting frame 656 and rear lower connecting frame 658 without second pulley bracket or support 720, fourth shaft 722, and fourth pulley 724 interfering with the movement of movable wall assembly 654.

As movable wall assembly 654 moves further into support assembly 652 due to an applied force, first anchor bracket or support 700 and second anchor bracket or support 726 move with movable wall assembly 654 relative to support assembly 652. As movable wall assembly 654 moves further into support assembly 652, first connection cable 682 and second connection cable 714 are pulled by the connection with first anchor bracket or support 700 and the connection with second anchor bracket or support 726, respectively. The connection of first connection cable 682 to first extension spring 664 causes first extension spring 664 to expand or stretch, storing at least a portion of the energy from the impacting force. Similarly, the connection of second connection cable 714 to second extension spring 666 causes second extension spring 666 to expand or stretch, storing at least a portion of the energy from the impacting force. Once the applied force, which can be an impacting force, as disclosed elsewhere herein, is removed, then first extension spring 664 and second extension spring 666 can retract to the unexpanded or un-stretched position shown in FIG. 29. As first extension spring 664 and second extension spring 666 retract or contract, the connection of first connection cable 682 to first extension spring 664 and movable wall assembly 654 and the connection of second connection cable 714 to second extension spring 666 and movable wall assembly 654 causes movable wall assembly to move from a deflected position (not shown in FIGS. 29-31, but such deflection is shown in other figures) to the un-deflected position shown in FIG. 31.

Figure 32:
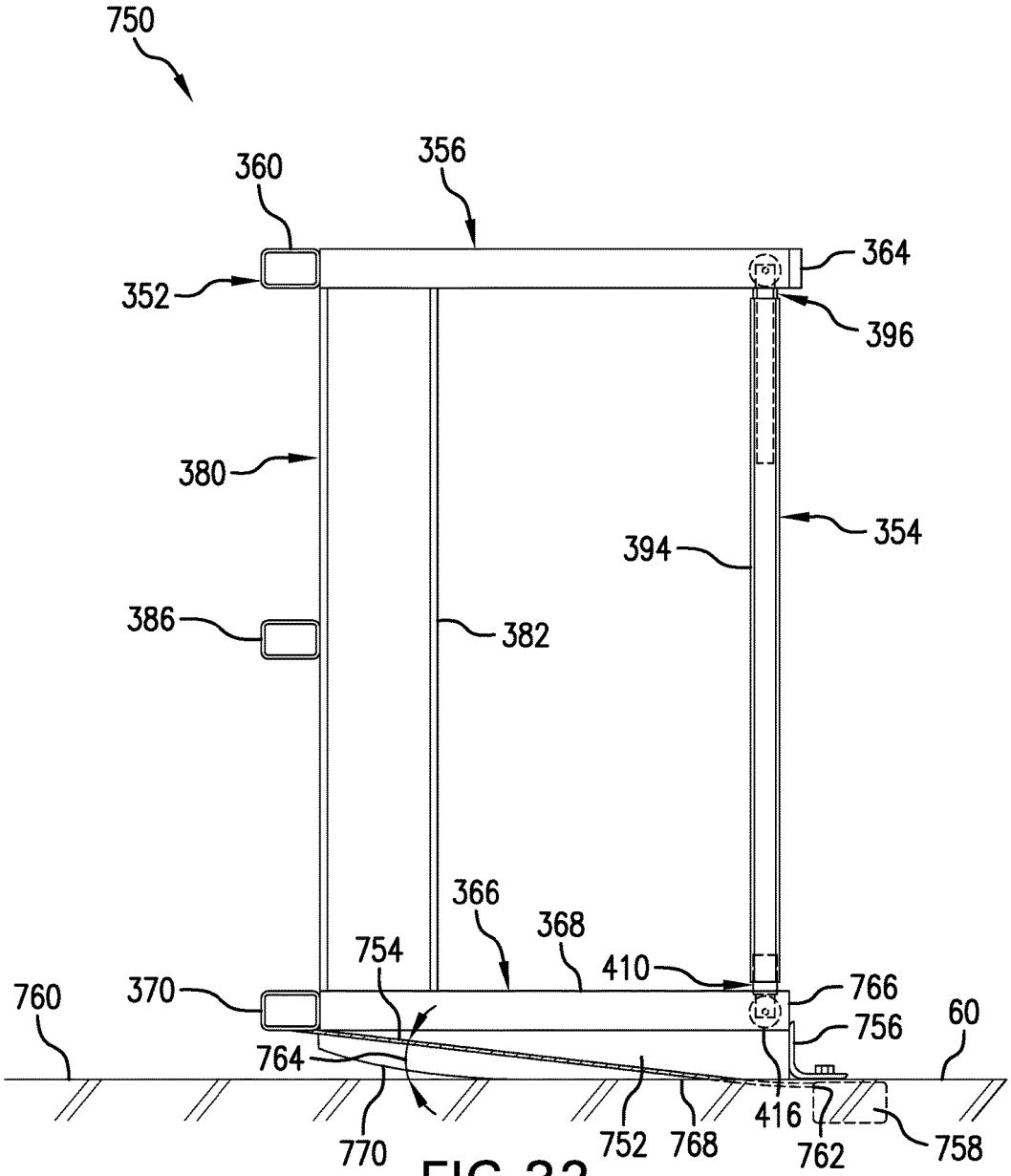
FIG. 32 shows a view of a wall assembly in accordance with a still further exemplary embodiment of the present disclosure.
Figure 33:
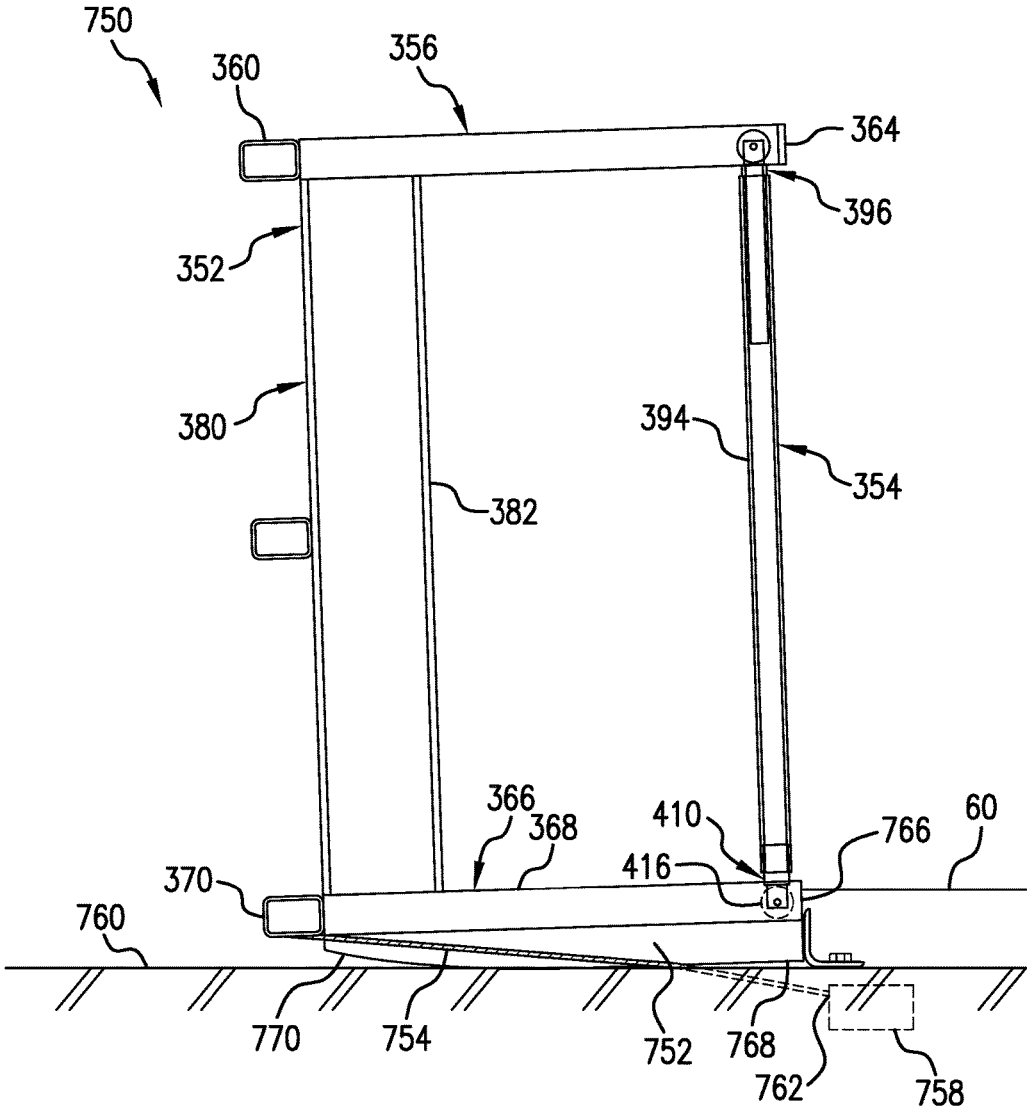
FIG. 33 shows a further view of the wall assembly of FIG. 32.

FIGS. 32 and 33 show views of a wall assembly, indicated generally at 750, in accordance with a still further exemplary embodiment of the present disclosure. Wall assembly 750 is similar in many respects to wall assembly 350 shown in FIGS. 17-21. Accordingly, where the elements are similar, the same item numbers are used to simplify explanation of the embodiment.

Wall assembly 750 includes support assembly 352 and movable wall assembly 354. Wall assembly 750 also includes a plurality of rockers 752. Each rocker 752 can be attached to one lower transverse frame 368, including being directly attached to one lower transverse frame 368. In another embodiment, rocker 752 can be integrally formed with lower transverse frame 368. In yet another embodiment, at least two rockers 752, each one positioned adjacent to the lower transverse frames 368 positioned at opposite ends of wall assembly 750.

Wall assembly 750 is positioned on a floor or support surface 760, which is adjacent to activity surface 60. Floor or support surface 760 can be formed of, for example, concrete, or other similar materials. A stop 756 is attached to floor or support surface 760, and secured to floor or support surface 760. In an exemplary embodiment, stop 756 is positioned below activity surface 60, which means that stop 756 is enclosed by the material forming activity surface 60, which can be, for example, ice, turf, artificial turf, and other materials. An anchor 758 is buried within floor or support surface 760. In an exemplary embodiment, anchor 758 can be configured to be accessible from above floor or support surface 760 when activity surface 60 and material between activity surface 60 and floor or support surface 760 is removed.

A first end 762 of a cable 754 is secured to anchor 758. Cable 754 then extends through floor or support surface 760 to engage with a back portion of wall assembly 750. Back in the context of this disclosure is a side of wall assembly 750 that positioned on an opposite side of wall assembly 750 that is away from activity surface 60. Cable 754 can be attached or otherwise secured to rear lower connecting frame 370 by way of clamps, fasteners, weldments, brackets, and the like. In an alternative embodiment, cable 754 can extend through holes formed in rear lower connecting frame 370, then extend along a length of rear lower connecting frame 370, and then extend through holes formed in rear lower connecting frame 370 at a location on rear lower connecting frame 370 that is at an opposite end of rear lower connecting frame 370 from the end shown in FIG. 32. After extending through the holes formed in rear lower connecting frame 370 at the opposite end of rear lower connecting frame 370, cable 754 can then be secured to a second anchor 758 position within floor or support surface 760.

While the embodiments disclosed hereinabove provide for a movable wall assembly that deflects under the force of an impact, portions of the support assembly, such as support assembly 352, can be subject to impacts. The support assemblies disclosed hereinabove are generally non-movable. Accordingly, the fixed position of such support assemblies presents an injury hazard. Wall assembly 750, and its attachment to a structure, which includes floor or support surface 760, provides features that reduce the risk of impacting a fixed support assembly, such as support assembly 352.

More specifically, the tension on cable 754 pulls wall assembly 750 toward stop 756, which prevents further movement of wall assembly 750 toward activity surface 60. The tension on cable 754, in combination with an angle of attachment 764 of cable 754 to support assembly 352, positions a front surface 766 of wall assembly 750 against stop 756, and a front bottom surface 768 of rocker 752 in contact with floor or support surface 760, thus positioning wall assembly approximately vertically or perpendicular to floor or support surface 760. In an exemplary embodiment, angle of attachment 764 is in the range of 4 to 7 degrees.

As should be understood from FIG. 32 and FIG. 33, rocker 752 includes a curvilinear surface 770 that contacts floor or support surface 760. Thus, when wall assembly 750 is in the position shown in FIG. 32, front bottom surface 768, which is part of curvilinear surface 770, is in contact with floor or support surface 760. However, the remainder of curvilinear surface 770 spaced toward the back of wall assembly 750, which is also a direction that is away from movable wall assembly 354 and toward vertically extending support frame assembly 380, is spaced a distance from floor or support surface 760.

When a portion of support assembly 352 is subjected to a force, such as an impact force against front upper connecting frame 364, the force causes wall assembly 750 to "rock" or move backward, aided by the contact of curvilinear surface 770 with floor or support surface 760. As wall assembly 750 rocks or tilts backward, front bottom surface 768 rises a spaced distance from floor or support surface 760, and a portion of curvilinear surface 770 spaced away from front bottom surface 768 moves downwardly to contact floor or support surface 760. The precise location of contact on curvilinear surface 770 depends on the amount of force applied to wall assembly 750. The more force, the great the spaced distance from front bottom surface 768.

As wall assembly 750 tilts or rocks away from activity surface 60, the location of the attachment of cable 754 moves further from stop 756 and anchor 758, which increases the tension in cable 754. Once the force against wall assembly 750 is removed, the tension in cable 754 pulls wall assembly 750 forward, or a direction that is toward activity surface 60, until wall assembly 750 rests against stop 756 and rests on front bottom surface 768, which is when wall assembly 750 has returned to an approximately vertical or perpendicular position with respect to floor or support surface 760.

Figure 34:
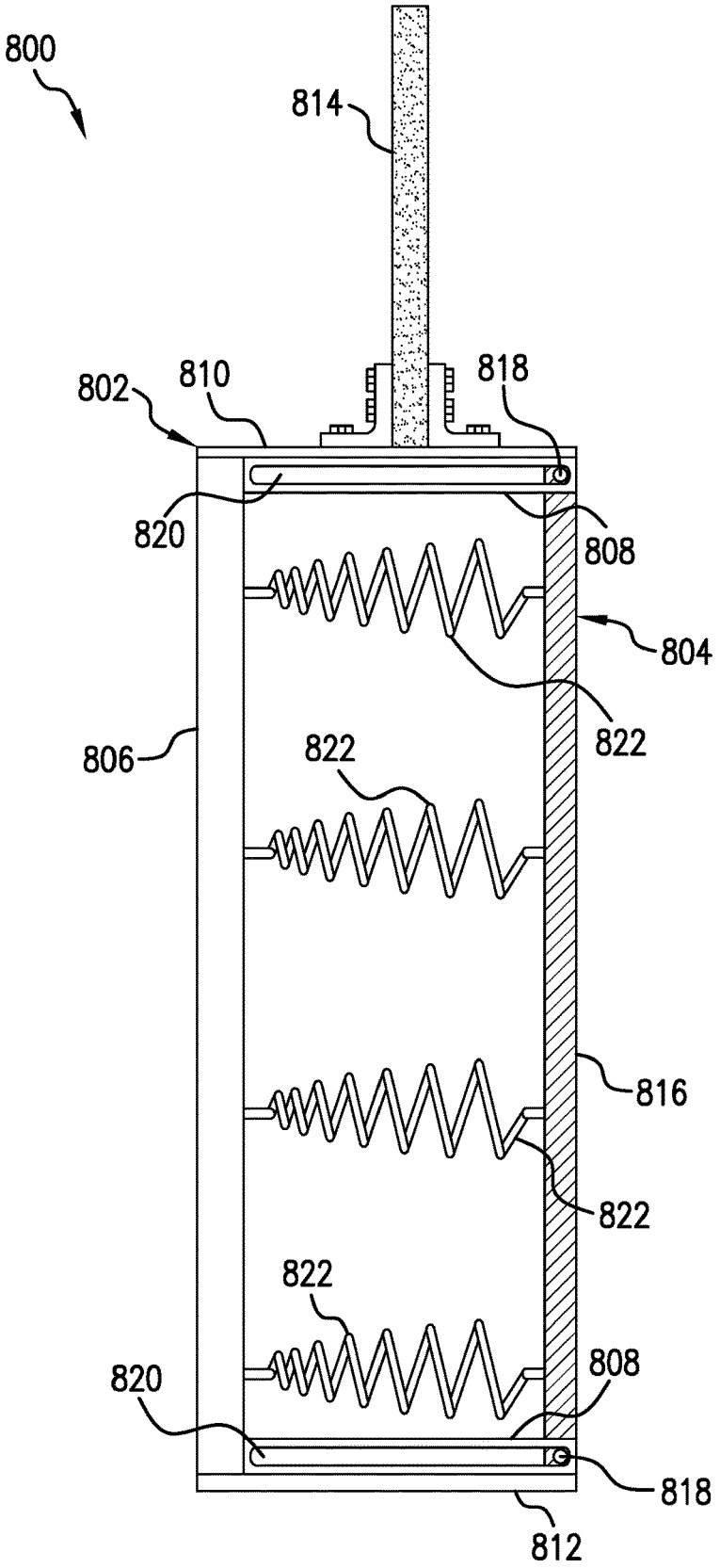
FIG. 34 shows a view of a wall assembly in accordance with an even further exemplary embodiment of the present disclosure.
Figure 35:
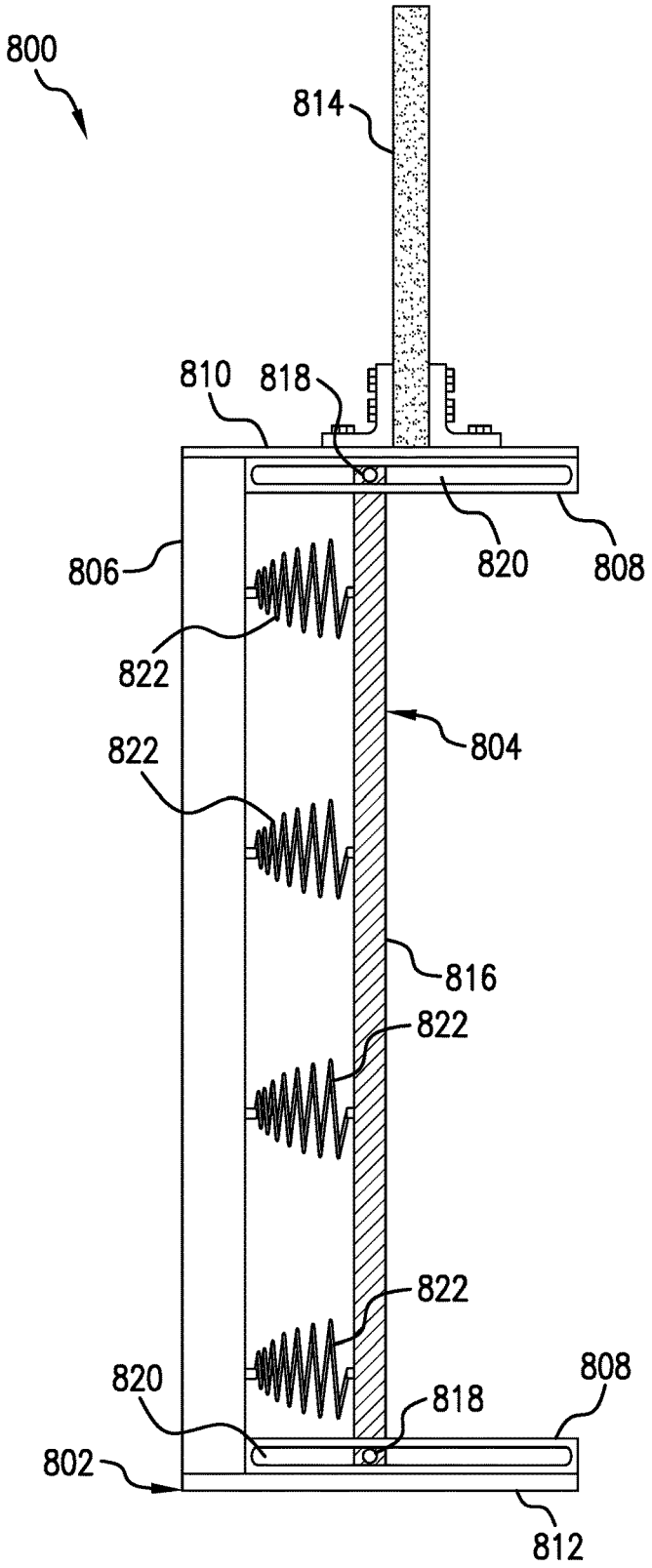
FIG. 35 shows a further view of the wall assembly of FIG. 34.

FIGS. 34 and 35 show schematic views of a wall assembly, indicated generally at 800, in accordance with an even further exemplary embodiment of the present disclosure. Wall assembly 800 includes a support assembly 802 and a movable board or wall assembly 804.

Support assembly 802 can include, for example, a back wall 806, a plurality of channel guides 808, a top cap or cover 810, and a bottom cap or cover 812. Though not shown, wall assembly 800 may include side members that connect top cap or cover 810, the plurality of channel guides 808, and bottom cap or cover 812 together. Upper channel guides 808 are attached to top cap or cover 810 and to back wall 806, and upper channel guides 808 extend approximately perpendicularly to back wall 806. Similarly, bottom channel guides 808 are attached to bottom cap or cover 812 and to back wall 806, and bottom channel guides 808 extend approximately perpendicularly to back well 806. In addition, channel guides 808 are approximately parallel to the ground. Support assembly 802 can also include a transparent shield 814 that is sufficiently transparent to view an activity on a first side of transparent shield 814 from a second opposite side of transparent shield 814. Transparent shield 814 can be attached to, and positioned on top cap or cover 810.

Movable wall assembly 804 can include a front wall 816, and a plurality of guide pins 818. Each one of the plurality of guide pins 818 is configured to slidingly engage with one of upper channel guides 808 and lower channel guides 808.

Wall assembly 800 further includes a plurality of compression springs 822 positioned directly between back wall 806 and front wall 816. Compression springs 820 can also be attached to back wall 806 and front wall 816. When a force is applied to movable wall assembly 804, movable wall assembly 804 deflects from an un-deflected position shown in FIG. 34 to a deflected position, such as that shown in FIG. 35. As movable wall assembly 804 moves from the position shown in FIG. 34 to a deflected position, each guide pin 818 slides along a slot, channel, or groove 820 formed in channel guides 808. At the same time, compression springs 822 are compressed.

After the force against movable wall assembly 804 is removed, springs 822 act to move movable wall assembly 804 from the deflected position, such as that shown in FIG. 35, to the un-deflected position shown in FIG. 34. As movable wall assembly 804 moves from the deflected position to the un-deflected position, guide pins 818 are guided by and slide along respective slots, channels, or grooves 820 until guide pins 818 are stopped by an end of slots, channels, or grooves 820, which can define the un-deflected position of movable wall assembly 804.

Figure 36:
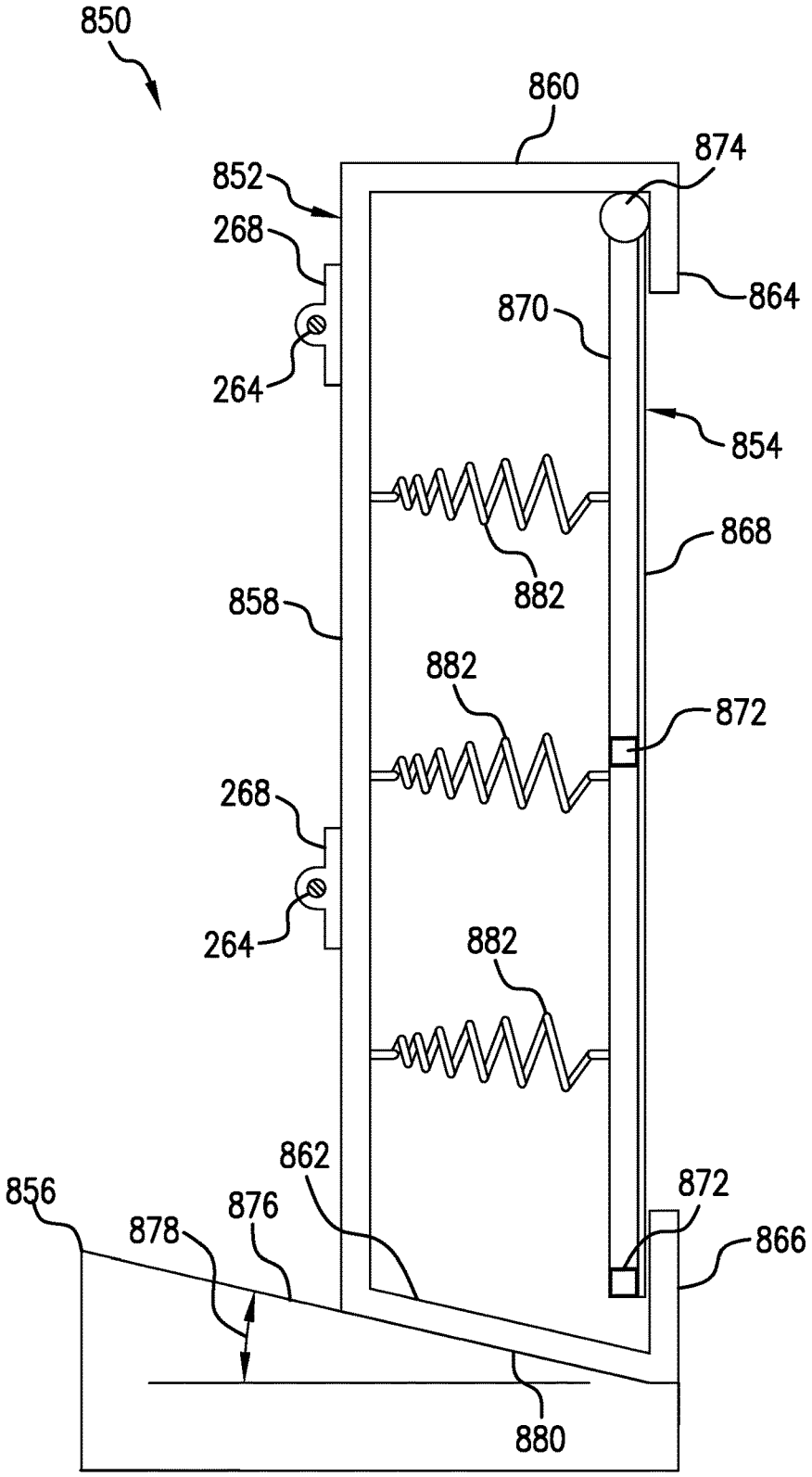
FIG. 36 shows a view of a wall assembly in accordance with a still even further exemplary embodiment of the present disclosure.
Figure 37:
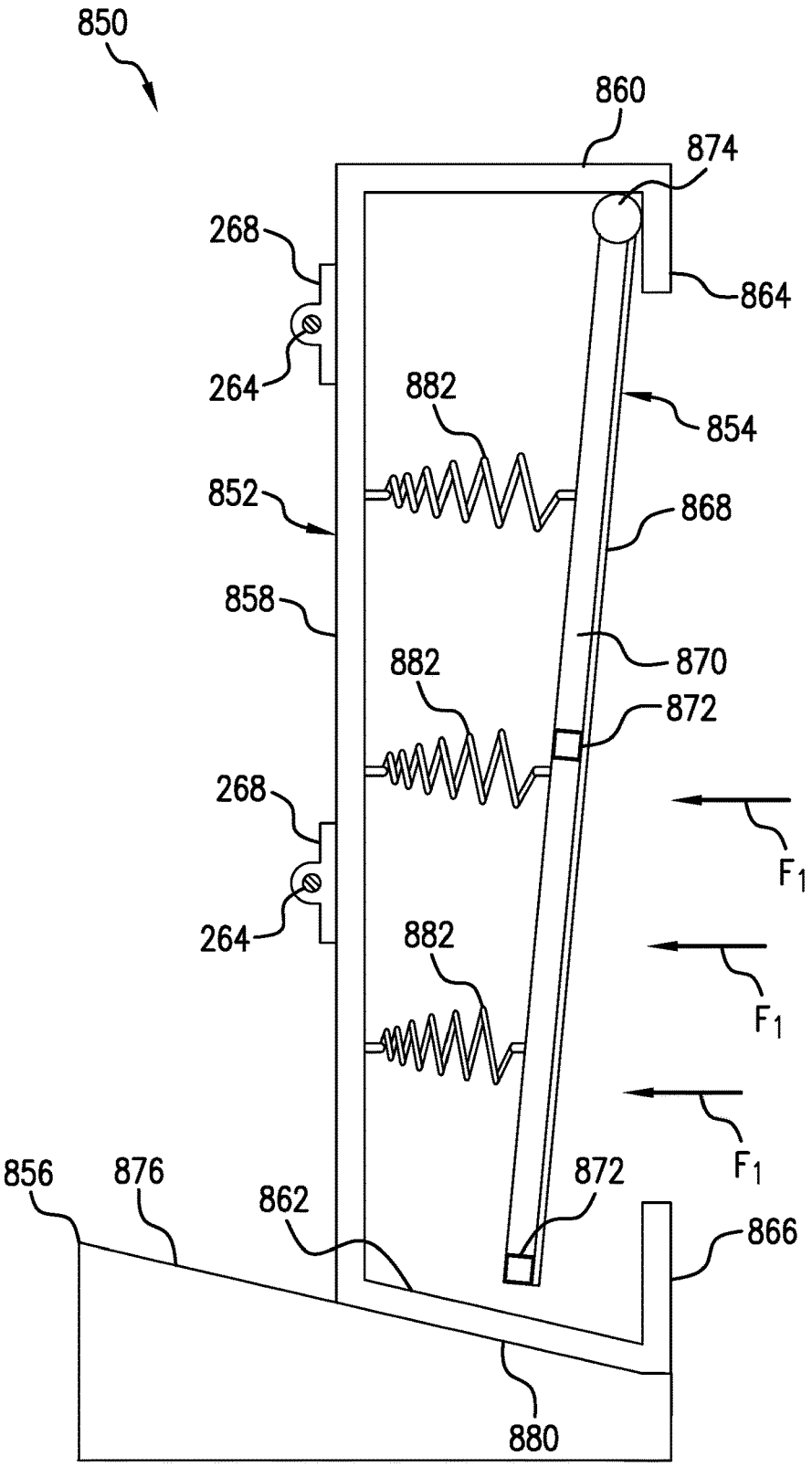
FIG. 37 shows a further view of the wall assembly of FIG. 36.
Figure 38:
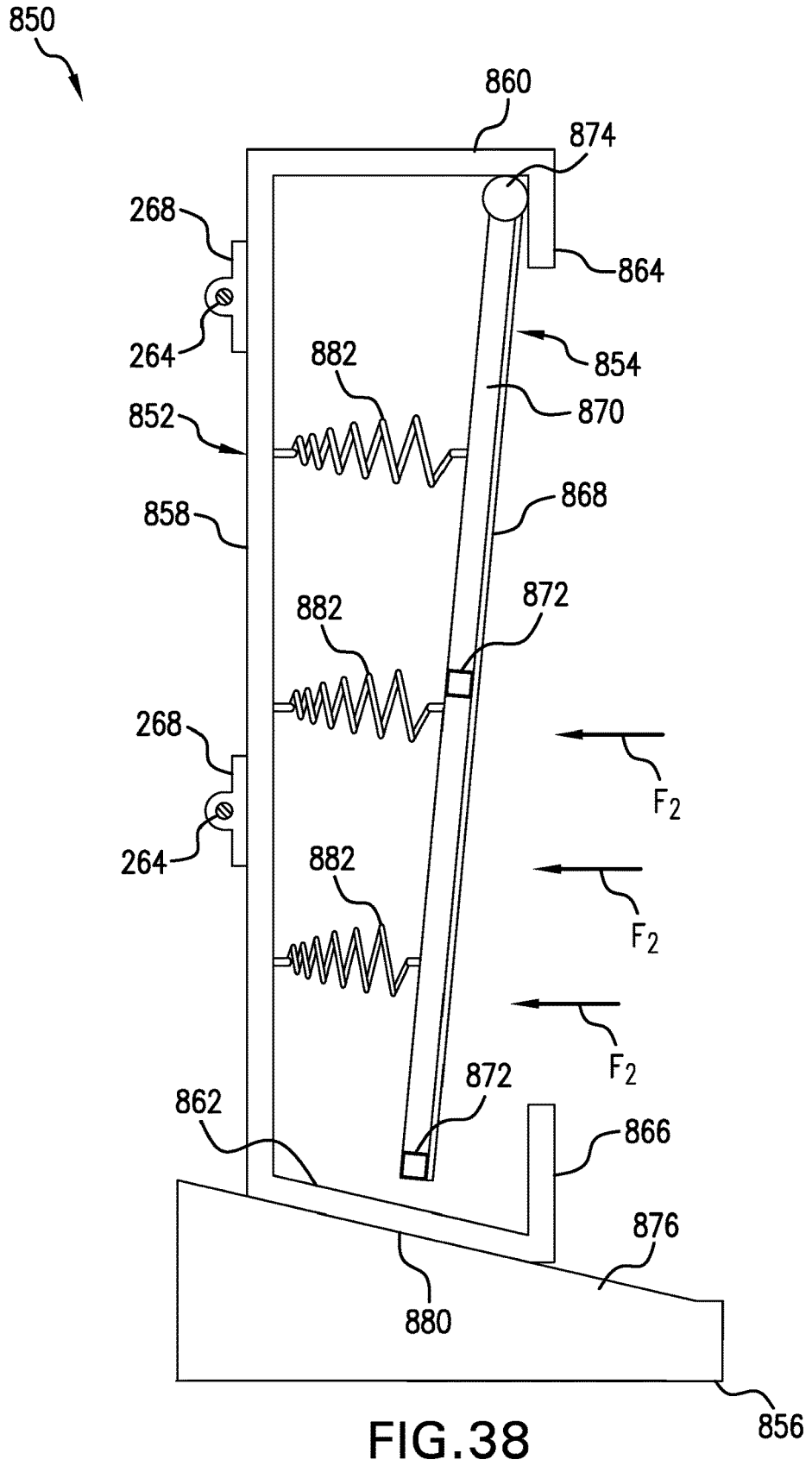
FIG. 38 shows a yet further view of the wall assembly of FIG. 36.

FIGS. 36-38 show schematic views a wall assembly, indicated generally at 850, in accordance with a still even further exemplary embodiment of the present disclosure. Wall assembly 850 includes a support assembly 852, a movable wall assembly 854 positioned on and supported by support assembly 852, and a base 856 on which is positioned support assembly 852.

Support assembly 852 can include, for example, a back wall 858, a top cap or cover 860, a bottom base interface wall 862, and front lips 864 and 866. Upper front lip 864 is attached to at least top cap or cover 860. Lower front lip 866 is attached to at least bottom base interface wall 862. Top cap or cover 860 and bottom base interface wall 862 are attached to at least back wall 858. Support assembly 852 can also include a plurality of brackets 268 attached thereto, through which cables 264 extend. The operation of cables 264 is disclosed elsewhere herein. It should be understood that FIGS. 36-38 are schematic views of wall assembly 850. Accordingly, some details may be simplified for clarity and for simplifying explanation. For example, wall assembly 850 can include side walls (not shown) for strength. Wall assembly 850 can also include frames in various locations for strength and durability.

Movable wall assembly 854 can include a front wall 868, a plurality of vertically extending front wall supports 870 that can extend along an entire height of front wall 868, a plurality of horizontally extending transverse wall supports 872 that can be similar to, for example, transverse front wall supports 532 disclosed elsewhere herein, and a hinge assembly 874 positioned along front wall 868 at a topmost location of front wall 868 in a location that is behind upper front lip 864. Hinge assembly 874 is attached to support assembly 852 in an orientation that is approximately parallel to a horizontal direction or a ground direction to enable movable wall assembly 854 to rotate or swivel away from lower front lip 866 by the action of an applied force.

A top surface 876 of base 856 can be oriented at an angle 878 with respect to a horizontal direction. In an exemplary embodiment, angle 878 is in the range of 0 to 25 degrees from horizontal, which is equivalent to 65 to 90 degrees from vertical. In a further embodiment, angle 878 is in the range of 8 to 18 degrees from horizontal, which is equivalent to 72 to 82 degrees from vertical. In an even further embodiment, angle 878 is in the range of 10 to 16 degrees from horizontal, which is equivalent to 74 to 80 degrees from vertical. A bottom surface 880 of bottom base interface wall 862 can also be oriented at angle 878 for mating with top surface 876. Note that the gap shown in the figures between bottom surface 880 and top surface 876 is for the sake of clarity in explaining the embodiments. In actuality, bottom surface 880 rides directly on top surface 876.

Wall assembly 850 can include a plurality of shock absorbers or springs 882 positioned between back wall 858 and front wall 868, and attached to back wall 858 and front wall 868. In another embodiment, shock absorbers 882 can be positioned between vertical front wall supports 870 and/or transverse front wall supports 872 and back wall 858, and attached to back wall 858 and a respective front wall support 872.

When a force $F_1$ is applied to movable wall assembly 854, movable wall assembly 854 deflects from an un-deflected position shown in FIG. 36 to a deflected position, such as that shown in FIG. 37. As movable wall assembly 854 moves from the position shown in FIG. 36 to a deflected position, movable wall assembly 854 swivels or rotates about hinge assembly 874, compressing shock absorbers or springs 882. If movable wall assembly 854 rotates to a maximum position due to a force $F_2$, or if a force $F_1$ is applied to a location on support assembly 852, wall assembly 850 can move along top surface 876 of base 856, from the position shown in FIGS. 36 and 37 to the position shown in FIG. 38. As wall assembly 850 moves, tension increases in cables 264.

After the force $F_1$ or $F_2$ against wall assembly 850 is removed, if shock absorbers or springs 882 are compressed, the spring force in shock absorbers or springs 882 will force movable wall assembly 854 from a deflected position, such as that shown in FIGS. 37 and 38, to an un-deflected position, such as that shown in FIG. 36. In the un-deflected position, movable wall assembly 854 can contact bottom lip 866, which serves to establish the un-deflected position of movable wall assembly 854. If wall assembly 850 has moved or deflected, the tension in cables 264 causes wall assembly 850 to move from the deflected position, such as that shown in FIG. 38, to the un-deflected position, such as that shown in FIGS. 36 and 37. It should be understood that a stop, such as stop 756 disclosed hereinabove, can be positioned to limit movement of wall assembly 850 toward activity surface 60 under the restoring force of cables 264.

Figure 39:
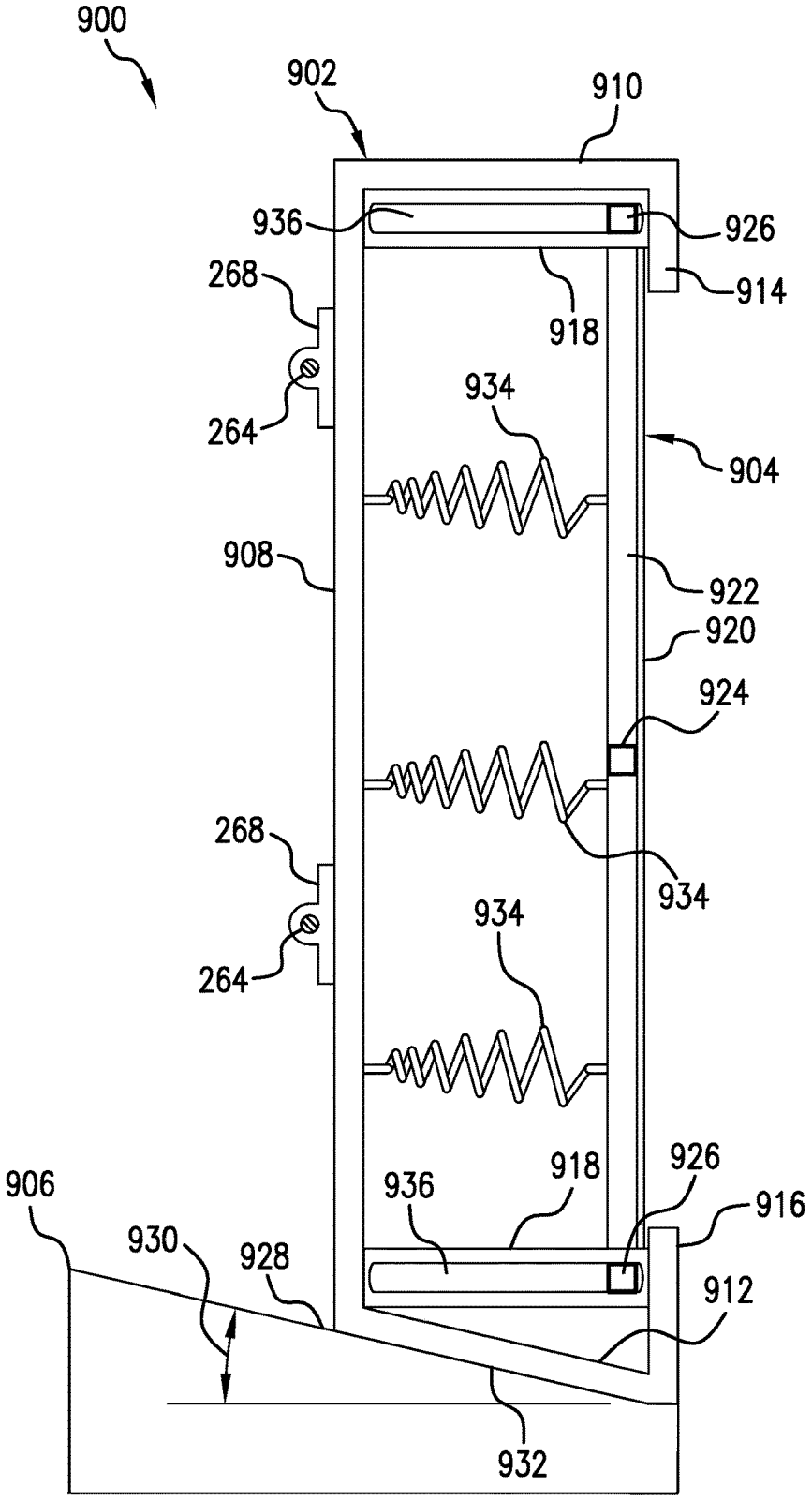
FIG. 39 shows a view of a wall assembly in accordance with an exemplary embodiment of the present disclosure.
Figure 40:
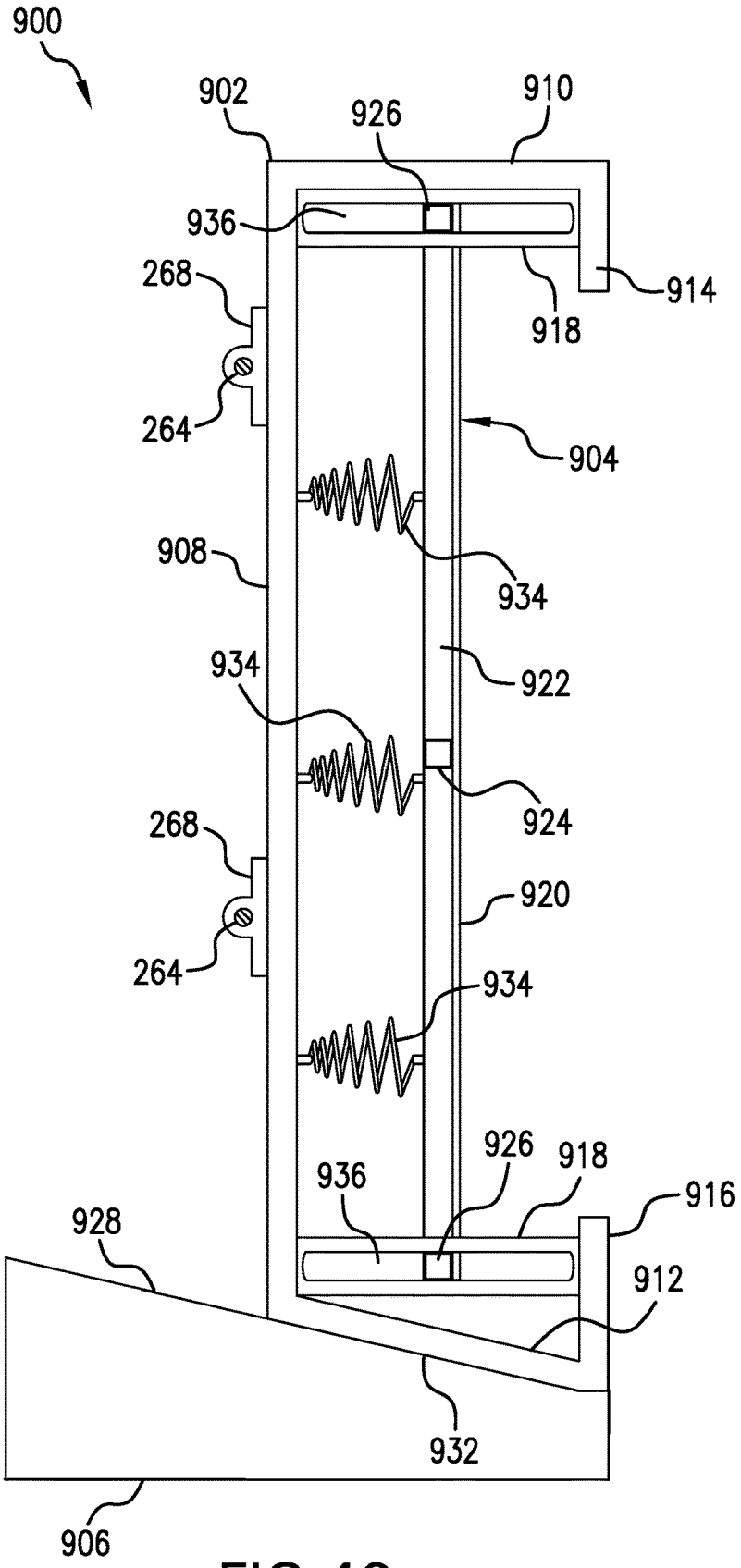
FIG. 40 shows a further view of the wall assembly of FIG. 39.
Figure 41:
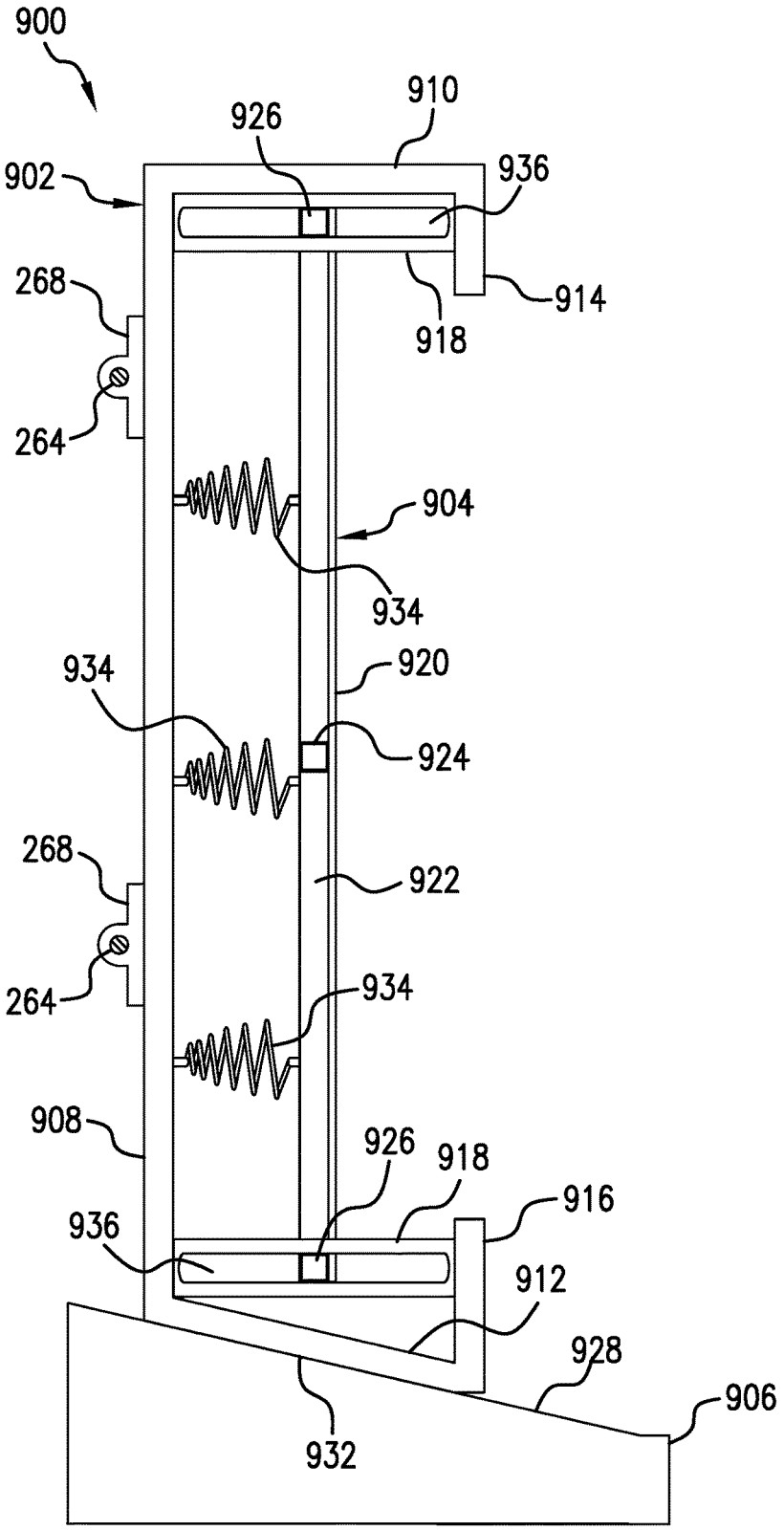
FIG. 41 shows a yet further view of the wall assembly of FIG. 39.

FIGS. 39-41 show views of a wall assembly, indicated generally at 900, in accordance with an exemplary embodiment of the present disclosure. Wall assembly 900 includes a support assembly 902, a movable wall assembly 904 positioned on and supported by support assembly 902, and a base 906 on which is positioned support assembly 902.

Support assembly 902 can include, for example, a back wall 908, a top cap or cover 910, a bottom base interface wall 912, an upper front lip 914, a lower front lip 916, and a plurality of channel guides 918. Upper front lip 914 is attached to at least top cap or cover 910. Lower front lip 916 is attached to at least bottom base interface wall 912. Top cap or cover 910 and bottom base interface wall 912 are attached to at least back wall 908. At least two upper channel guides 918 are attached to top cap or cover 910 at each end of support assembly 902. Each upper channel guide 918 can also be attached to back wall 908. Each lower channel guide 916 is attached to at least back wall 908 and lower front lip 916. Though not shown, wall assembly 900 can include side members that connect top cap or cover 910, the plurality of channel guides 808, and bottom base interface wall 912 together. Upper channel guides 918 and lower channel guides 918 can each extend approximately perpendicularly to back wall 908. In addition, all channel guides 918 can be approximately parallel to the ground. Support assembly 902 can also include a plurality of brackets 268 attached thereto, through which cables 264 extend. The operation of cables 264 is disclosed elsewhere herein. It should be understood that FIGS. 39-41 are schematic views of wall assembly 900. Accordingly, some details may be simplified for clarity and for simplifying explanation. For example, wall assembly 900 can include side walls (not shown) for strength. Wall assembly 900 can also include frames in various locations for strength and durability, including frames in place of back wall 908.

Movable wall assembly 904 can include a front wall 920, a plurality of vertically extending front wall supports 922 that can extend along an entire height of front wall 920, a plurality of horizontally extending transverse wall supports 924 that can be similar to, for example, transverse front wall supports 532 disclosed elsewhere herein, and a plurality of guide pins 926. Each one of the plurality of guide pins 926 is configured to slidingly engage with one of upper channel guides 918 and lower channel guides 918.

A top surface 928 of base 906 can be oriented at an angle 930 with respect to a horizontal direction. In an exemplary embodiment, angle 930 is in the range of 0 to 25 degrees from horizontal, which is equivalent to 65 to 90 degrees from vertical. In a further embodiment, angle 930 is in the range of 8 to 18 degrees from horizontal, which is equivalent to 72 to 82 degrees from vertical. In an even further embodiment, angle 930 is in the range of 10 to 16 degrees from horizontal, which is equivalent to 74 to 80 degrees from vertical. A bottom surface 932 of bottom base interface wall 912 can also be oriented at angle 930 for mating with top surface 928. Note that the gap shown in the figures between bottom surface 932 and top surface 928 is for the sake of clarity in explaining the embodiments. In actuality, bottom surface 932 rides directly on top surface 928.

Wall assembly 900 can include a plurality of shock absorbers or springs 934 positioned between back wall 908 and front wall 920, and attached to back wall 908 and front wall 920. In another embodiment, shock absorbers 934 can be positioned between vertical front wall supports 922 and/or transverse front wall supports 924 and back wall 908, and attached to back wall 908 and a respective front wall support 922 or transverse front wall supports 924.

When a force $F_1$ is applied to movable wall assembly 904, movable wall assembly 904 deflects from an un-deflected position shown in FIG. 39 to a deflected position, such as that shown in FIG. 40. As movable wall assembly 904 moves from the position shown in FIG. 39 to a deflected position, each guide pin 926 slides along a slot, channel, or groove 936 formed in each of channel guides 918. At the same time, shock absorbers or springs 934 compress. If movable wall assembly 904 moves to a maximum deflected position due to a force $F_2$, or if a force $F_1$ is applied to a location on support assembly 902, wall assembly 900 can move along top surface 928 of base 906, from the position shown in FIGS. 39 and 40 to the position shown in FIG. 41. As wall assembly 900 moves, tension increases in cables 264.

After the force $F_1$ or $F_2$ against wall assembly 900 is removed, if shock absorbers or springs 934 are compressed, the spring force in shock absorbers or springs 934 will force movable wall assembly 904 from a deflected position, such as that shown in FIGS. 40 and 41, to an un-deflected position, such as that shown in FIG. 39. In the un-deflected position, movable wall assembly 904 can contact bottom lip 916, which serves to establish the un-deflected position of movable wall assembly 904. If wall assembly 900 has moved or deflected, the tension in cables 264 causes wall assembly 900 to move from the deflected position, such as that shown in FIG. 41, to the un-deflected position, such as that shown in FIGS. 39 and 41. As movable wall assembly 904 moves from the deflected position to the un-deflected position, guide pins 926 are guided by and slide along respective slots, channels, or grooves 936 until guide pins 926 are stopped by an end of slots, channels, or grooves 936, which can define the un-deflected position of movable wall assembly 904. It should be understood that a stop, such as stop 756 disclosed hereinabove, can be positioned to limit movement of wall assembly 900 toward activity surface 60 under the restoring force of cables 264.

Figure 42:
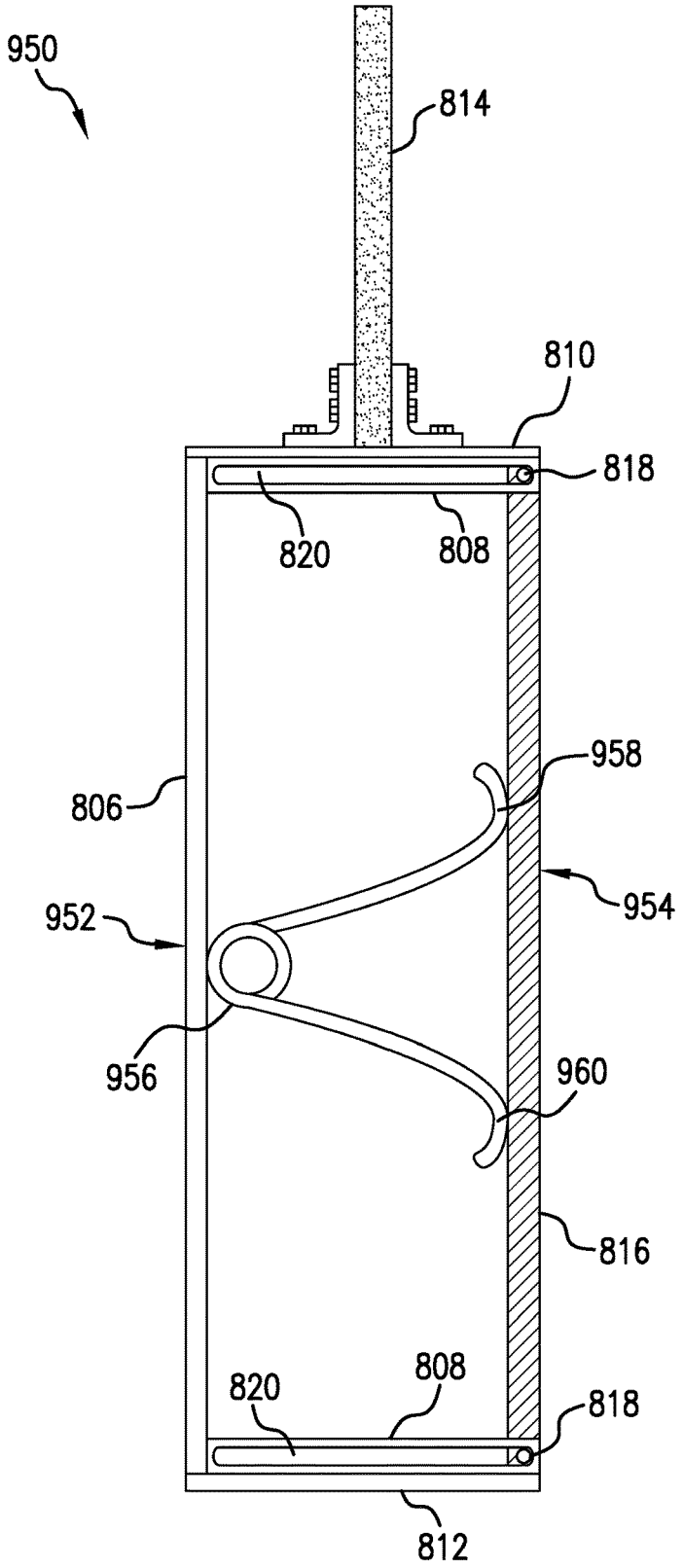
FIG. 42 shows a view of a wall assembly in accordance with another exemplary embodiment of the present disclosure.
Figure 43:
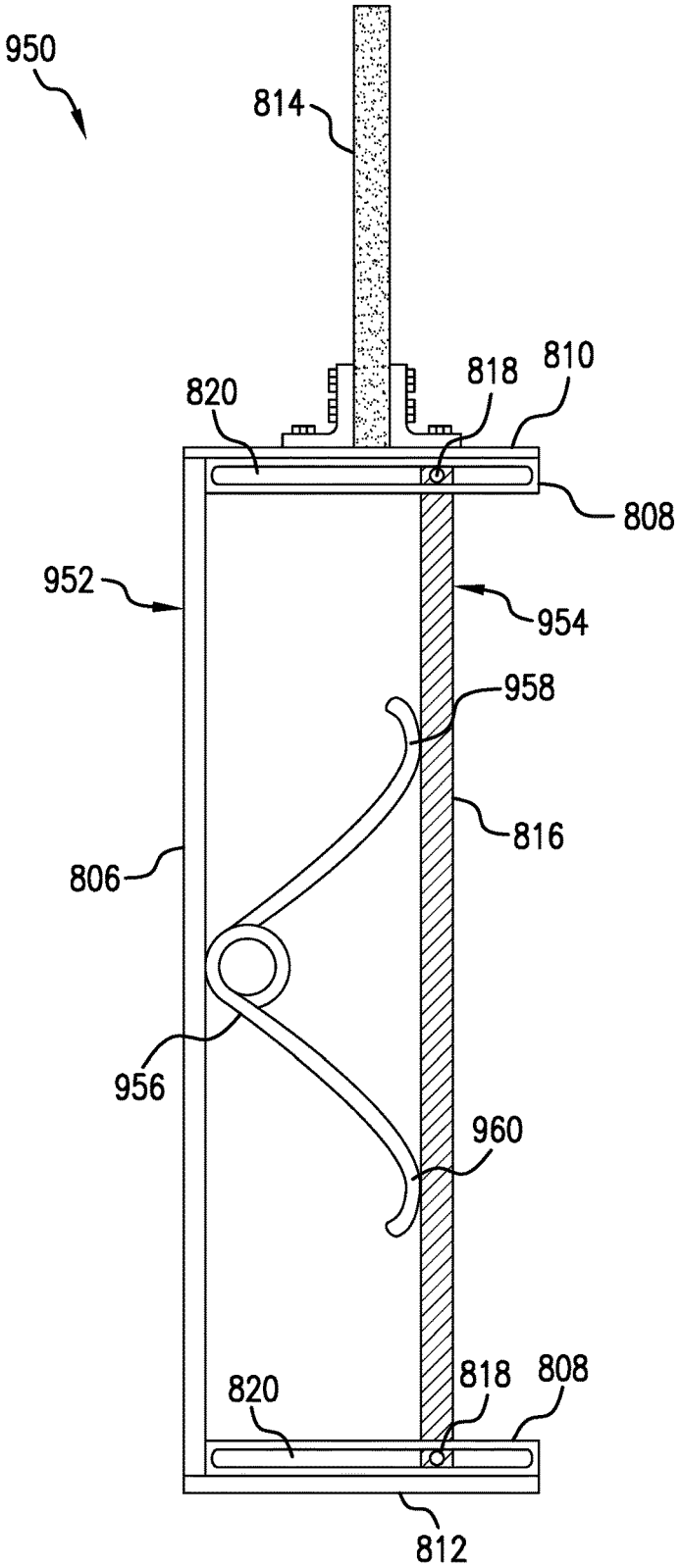
FIG. 43 shows a further view of the wall assembly of FIG. 42.
Figure 44:
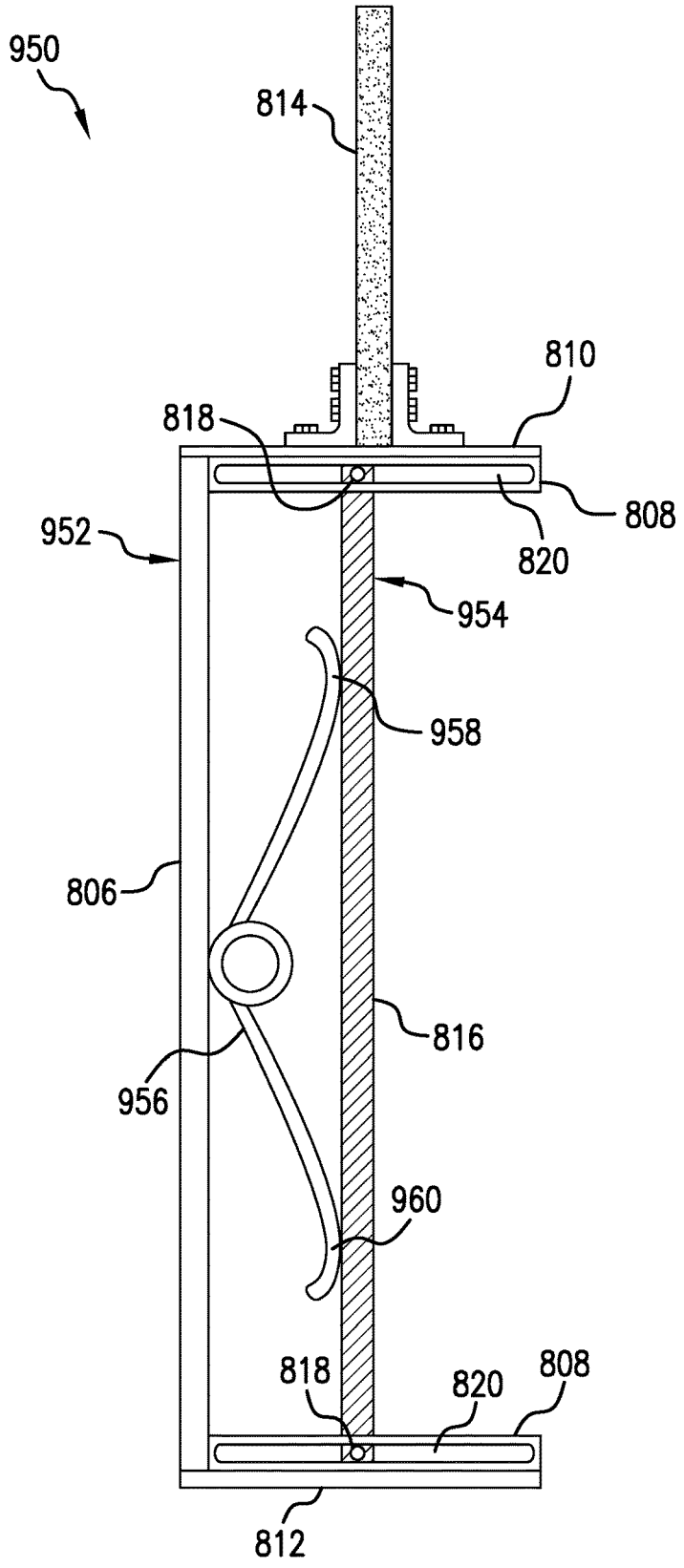
FIG. 44 shows a yet further view of the wall assembly of FIG. 42.

FIGS. 42-44 show views of a wall assembly, indicated generally at 950, in accordance with another exemplary embodiment of the present disclosure. Wall assembly 950 includes a support assembly 952 and a movable wall assembly 954. Wall assembly 950 is similar in many respects to wall assembly 800 shown in FIGS. 34 and 25. Accordingly, similar features are labelled with the same item number.

While wall assembly 800 includes a plurality of compression springs 822 positioned between support assembly 802 and movable wall assembly 804, wall assembly 950 includes a single centrally positioned torsion spring 956 positioned between support assembly 802 and movable wall assembly 804. As movable wall assembly 804 is moved or deflected from the un-deflected position shown in FIG. 42 to one of a plurality of deflected positions, two of which are shown in FIGS. 43 and 44, a first end 958 and a second end 960 of torsion spring 956 move away from each other. In the configuration of FIGS. 43 and 44, first end 958 and second end 960 move vertically away from each other. While a back side of torsion spring 956 is shown in direct contact with back wall 806, and first end 958 and second end 960 are shown in direct contact with front wall 816, wall assembly 950 can include one or more brackets, holders, spacers, fasteners, and the like to secure torsion spring 956 to support assembly 802 and to movable wall assembly 804.

One advantage to a torsion spring is that as first end 958 and second end 960 move away from each other, front wall 804 becomes more stable because a torsion spring inherently balances the force applied by first end 958 and second end 960 as long as torsion spring 956 is permitted to rotate during compression of torsion spring 956 by front wall 804.

Figure 45:
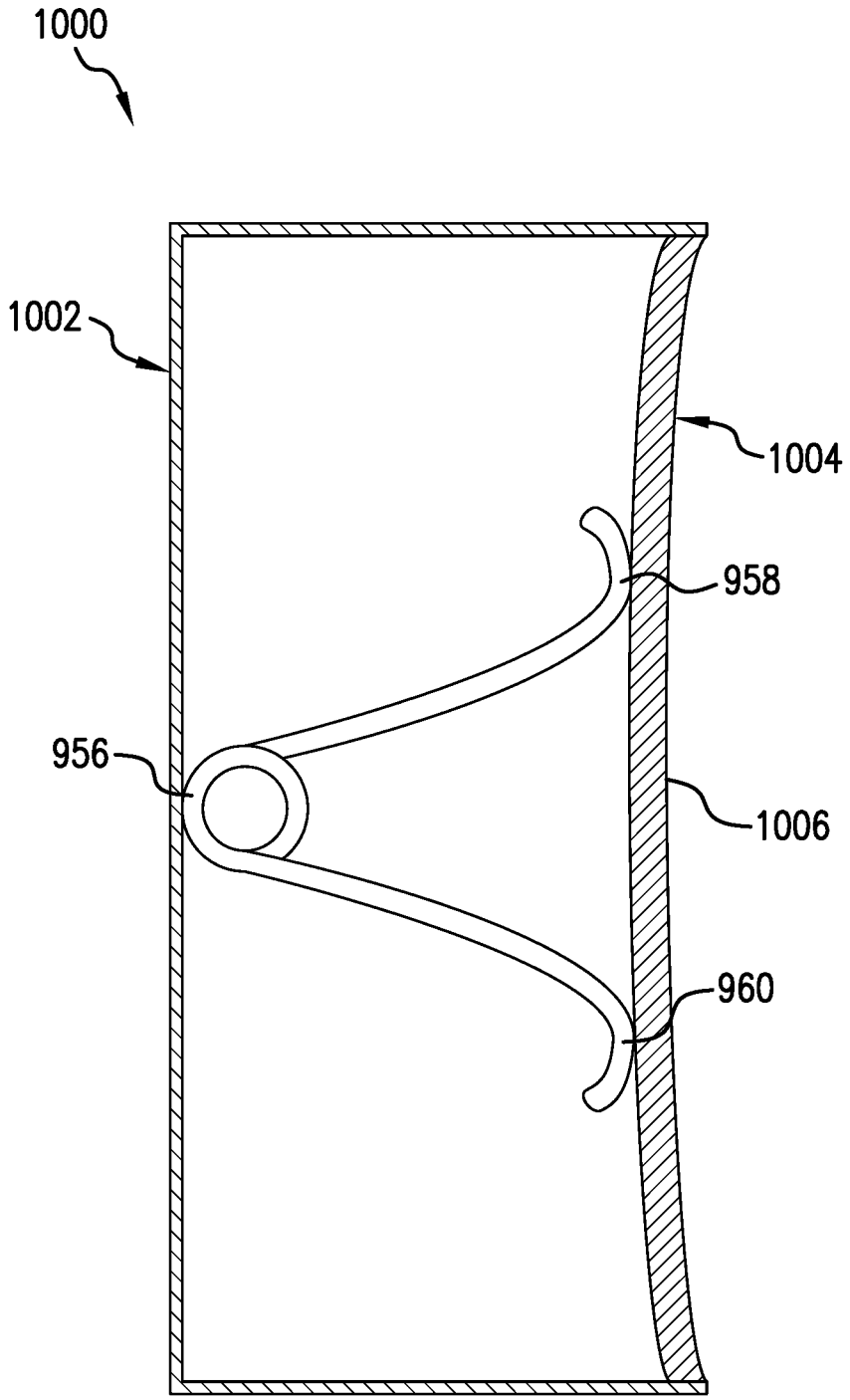
FIG. 45 shows a view of a wall assembly in accordance with yet another exemplary embodiment of the present disclosure.
Figure 46:
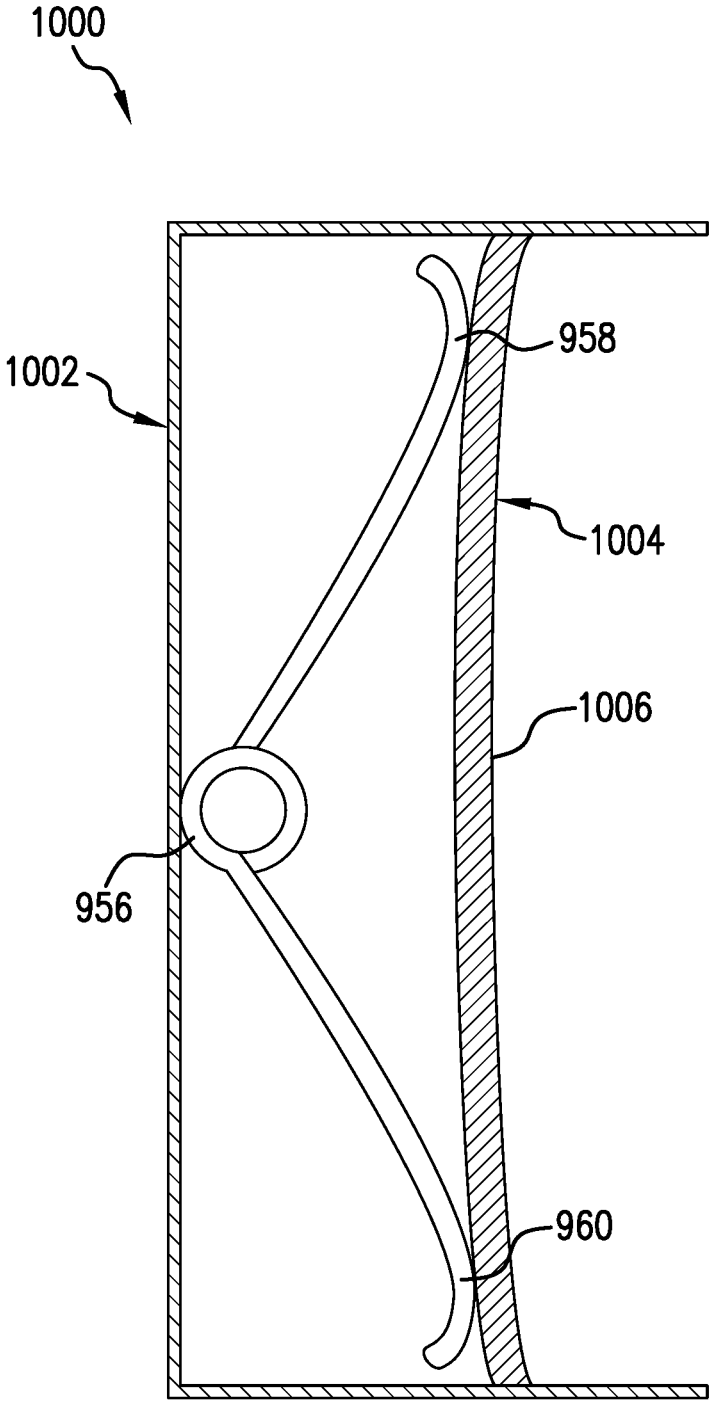
FIG. 46 shows a further view of the wall assembly of FIG. 45.

FIGS. 45 and 46 show schematic views of a wall assembly, indicated generally at 1000, in accordance with yet another exemplary embodiment of the present disclosure. Wall assembly 1000 includes a support assembly 1002, a movable wall assembly 1004, and a torsion spring, such as torsion spring 956, positioned between support assembly 1002 and movable wall assembly 1004. Torsion spring 956 operates as disclosed hereinabove with respect to the embodiment of FIGS. 42-44.

Movable wall assembly 1004 includes a curvilinear front wall 1006. The curvature of front wall 1006 can enhance the rolling of the participant's head upon impact with front wall 1006, reducing the risk of injury. It should be understood that curvilinear front wall 1006 can be incorporated into any of the embodiments disclosed herein.

Figure 47:
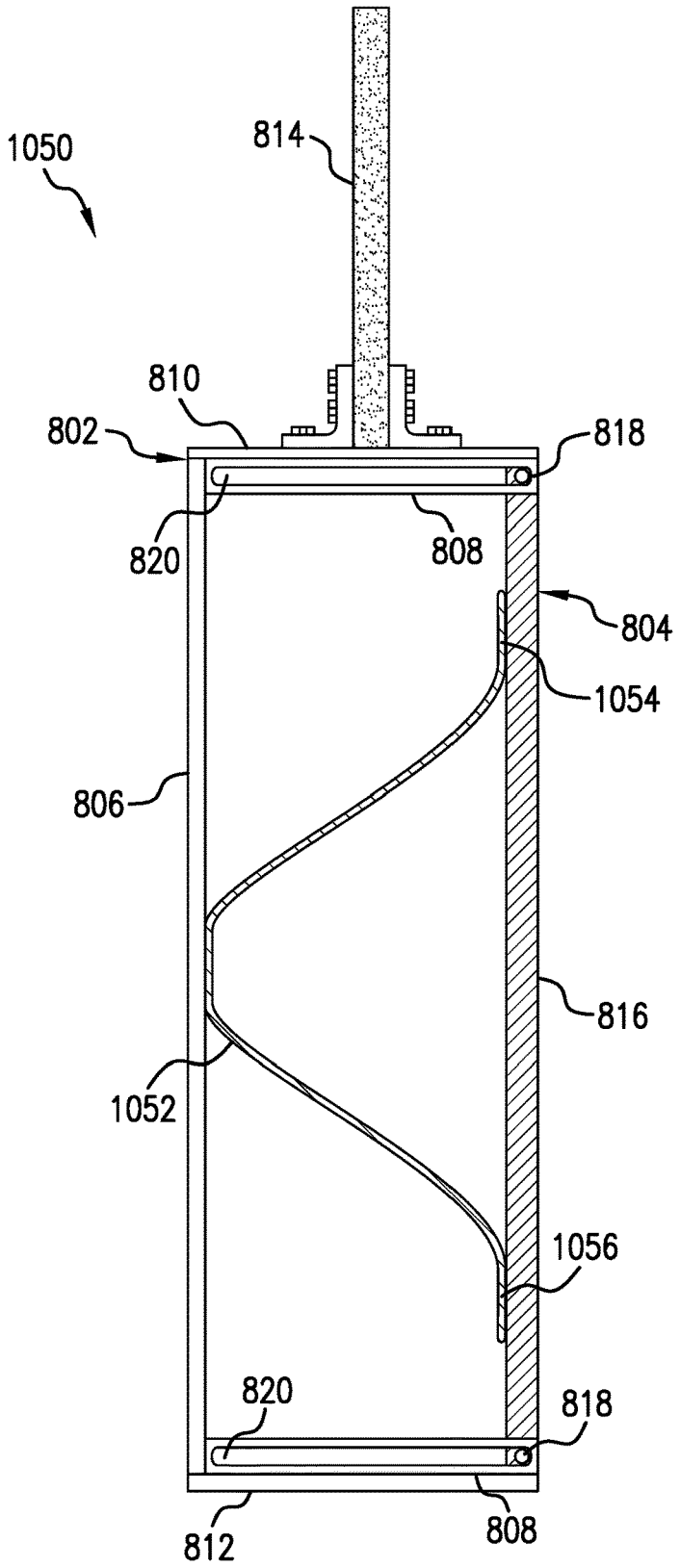
FIG. 47 shows a view of a wall assembly in accordance with a still further exemplary embodiment of the present disclosure.
Figure 48:
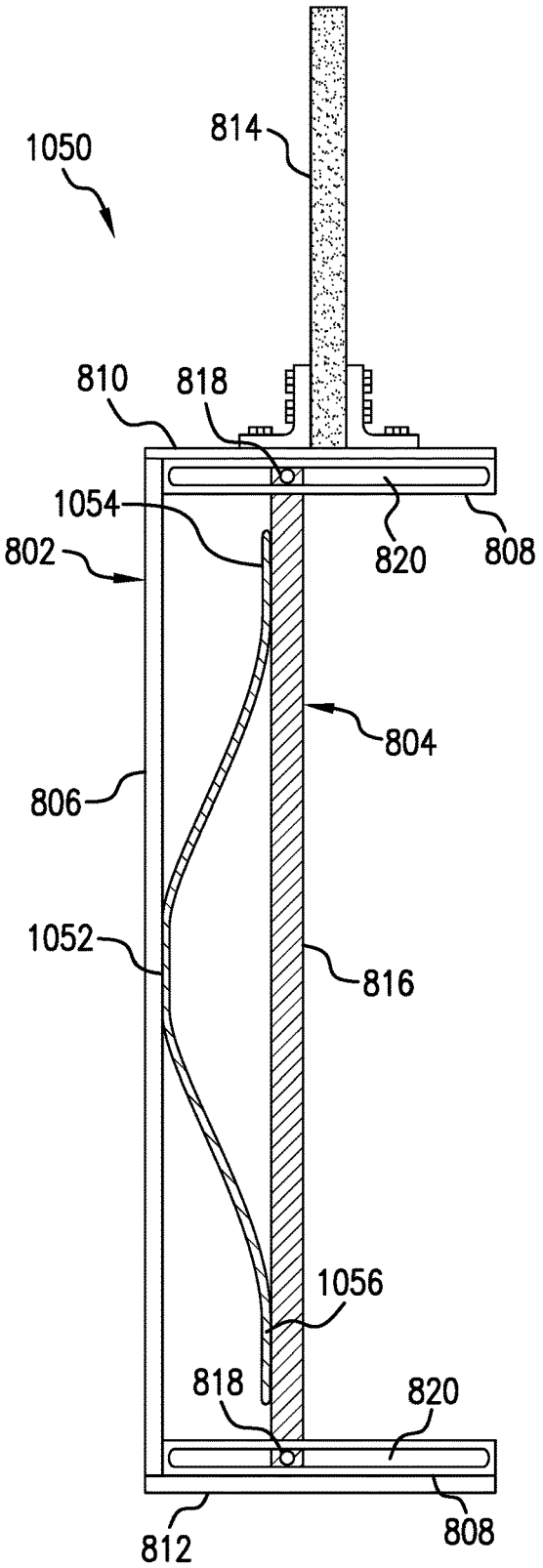
FIG. 48 shows a further view of the wall assembly of FIG. 47.

FIGS. 47 and 48 show views of a wall assembly, indicated generally at 1050, in accordance with a still further exemplary embodiment of the present disclosure. Wall assembly 1050 can include a support assembly such as support assembly 802 shown in FIGS. 34 and 35, and wall assembly 1050 can include a movable wall assembly, such as movable wall assembly 804 shown in FIGS. 34 and 35. Elements in FIGS. 47 and 48 that function similar to elements shown in FIGS. 34 and 35 are given the same items numbers, and the discussion presented hereinabove with respect to those item numbers is applicable to this embodiment.

In place of the plurality of compression springs 822 shown in FIGS. 34 and 35, wall assembly 1050 includes a flat spring 1052 positioned between support assembly 802 and movable wall assembly 804. Flat spring 1052 is a different type of spring from the torsion spring of, for example, wall assembly 950 shown in FIGS. 42-44. Flat spring 1052 includes a first end 1054 and a second end 1056 positioned a spaced distance apart. While FIGS. 47 and 48 show that first end 1054 and second end 1056 are spaced vertically apart, first end 1054 and second end 1056 can also be space horizontally apart.

FIGS. 49-53 show views of a wall assembly, indicated generally at 1100, in accordance with an even further exemplary embodiment of the present disclosure. Wall assembly 1100 includes a support assembly that can be similar to support assembly 852 shown in FIGS. 36-38, a movable wall assembly that can be similar to movable wall assembly 854 shown in FIGS. 36-38, and wall assembly 1100 can be supported by a base such as base 856 shown in FIGS. 36-38. Accordingly, elements in FIGS. 49-53 that are similar to elements of FIGS. 36-38 are labeled with the same items numbers as the embodiment of FIGS. 36-38.

Wall assembly 1100 includes a plurality of extension springs 1102, a pulley shaft 1104, and a pulley 1106. Pulley shaft 1104 is attached to support assembly 852 and extends in a generally horizontal direction. Pulley shaft 1104 can be positioned directly between movable wall assembly 854 and bottom interface wall 862 when movable wall 854 is in an un-deflected position. Pulley 1106 is rotatably supported on pulley shaft 1104. A first end 1108 of extension spring 1102 is attached to support assembly 852, which can be to back wall 858. Extension spring 1102 then extends to pulley 1106 at a location that is directly vertically between pulley 1106 and bottom interface wall 862. Extension spring 1102 then wraps at least partially around pulley 1106, changing from a first, slightly downwardly angled direction to a second, approximately vertical direction. A second end 1110 of extension spring 1102 then extends upwardly to attach to movable wall assembly 854.

It should be understood that wall assembly 1100 can include a plurality of extension springs, though only one is shown. It should also be understood that extension spring 1102 includes a plurality of coils 1112, and coils 1112 can be positioned in a location that is between pulley 1106 and back wall 858 of support assembly 852. Extending from coils 1112 can be a first extension 1114 that extends to first end 1108, and a second extension 1116 that extends to pulley 1106 and then to second end 1110.

Figure 49:
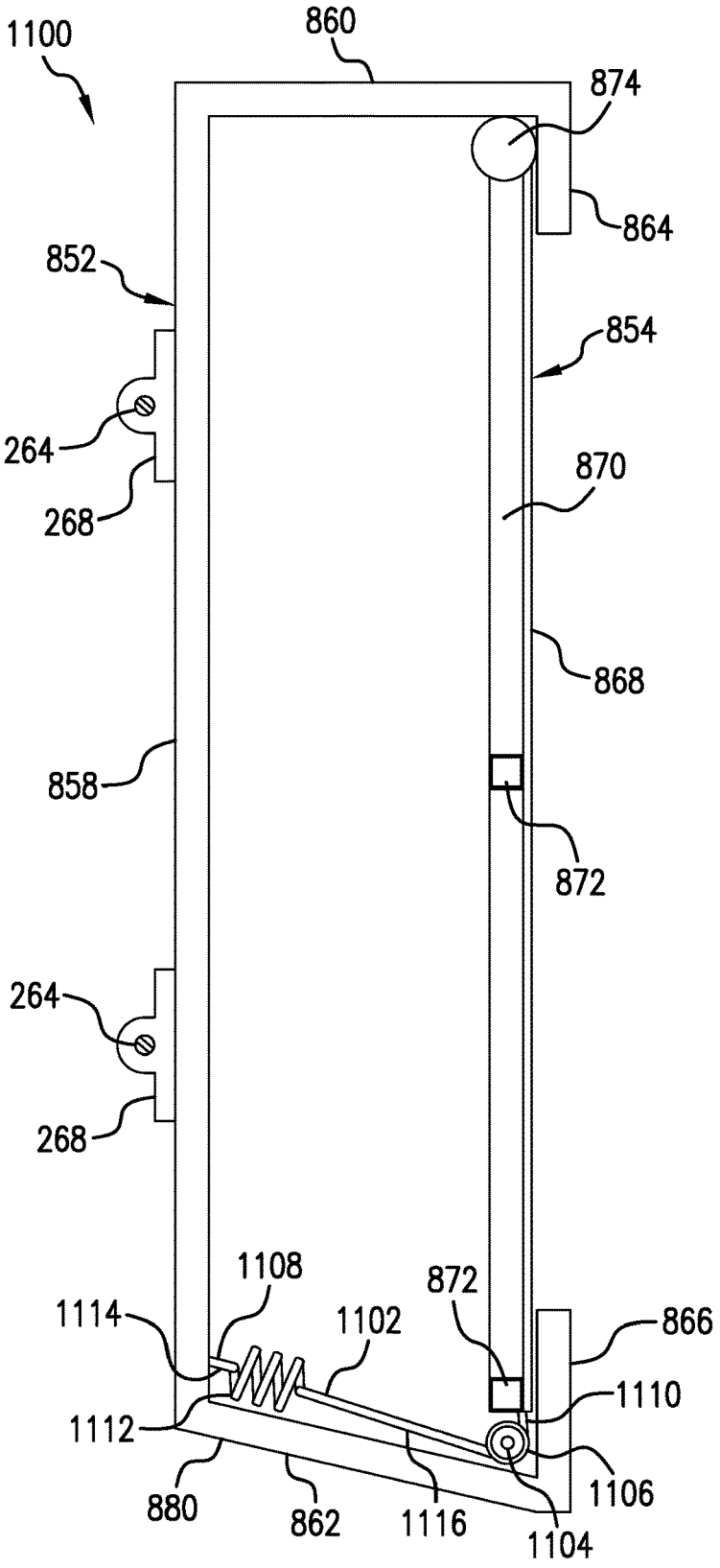
FIG. 49 shows a view of a wall assembly in accordance with an even further exemplary embodiment of the present disclosure.
Figure 50:
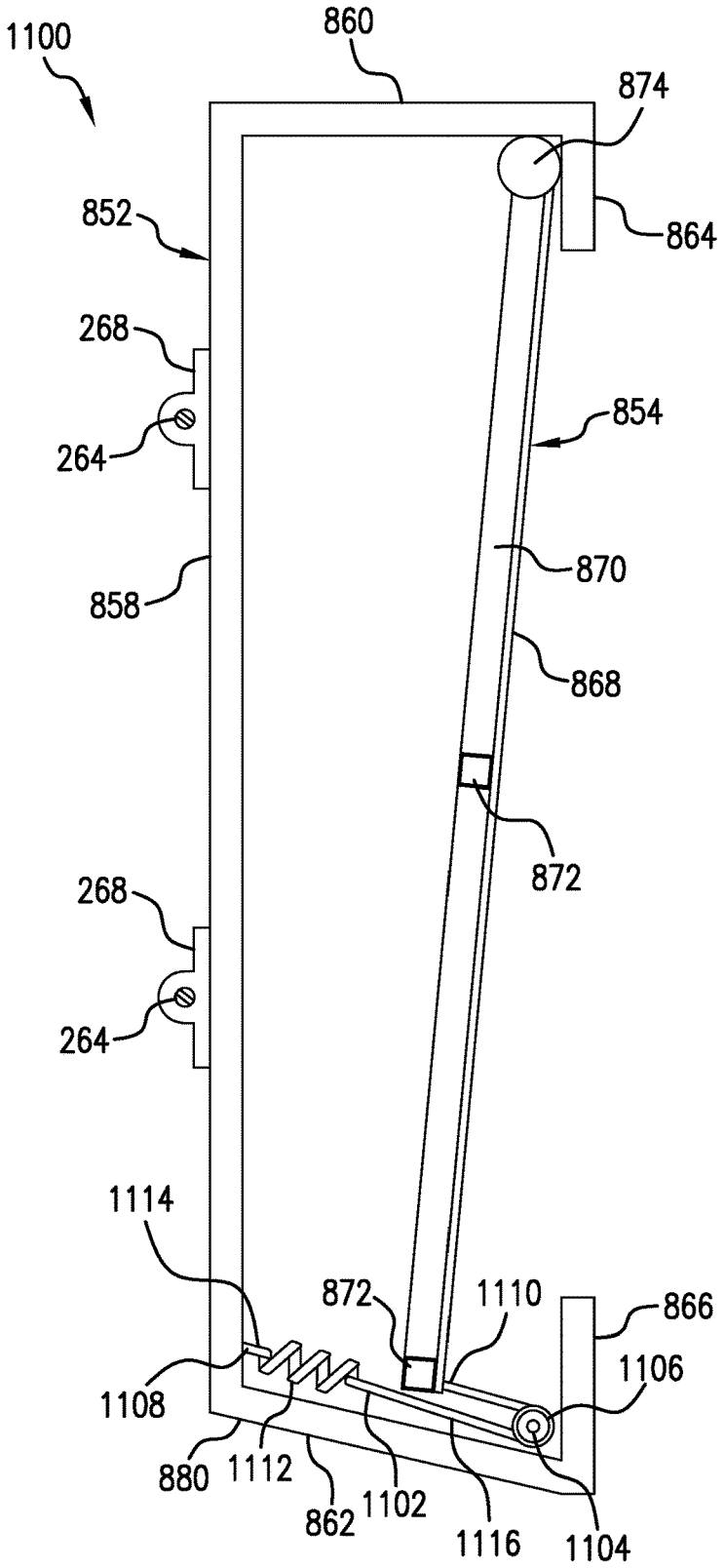
FIG. 50 shows a further view of the wall assembly of FIG. 49.
Figure 51:
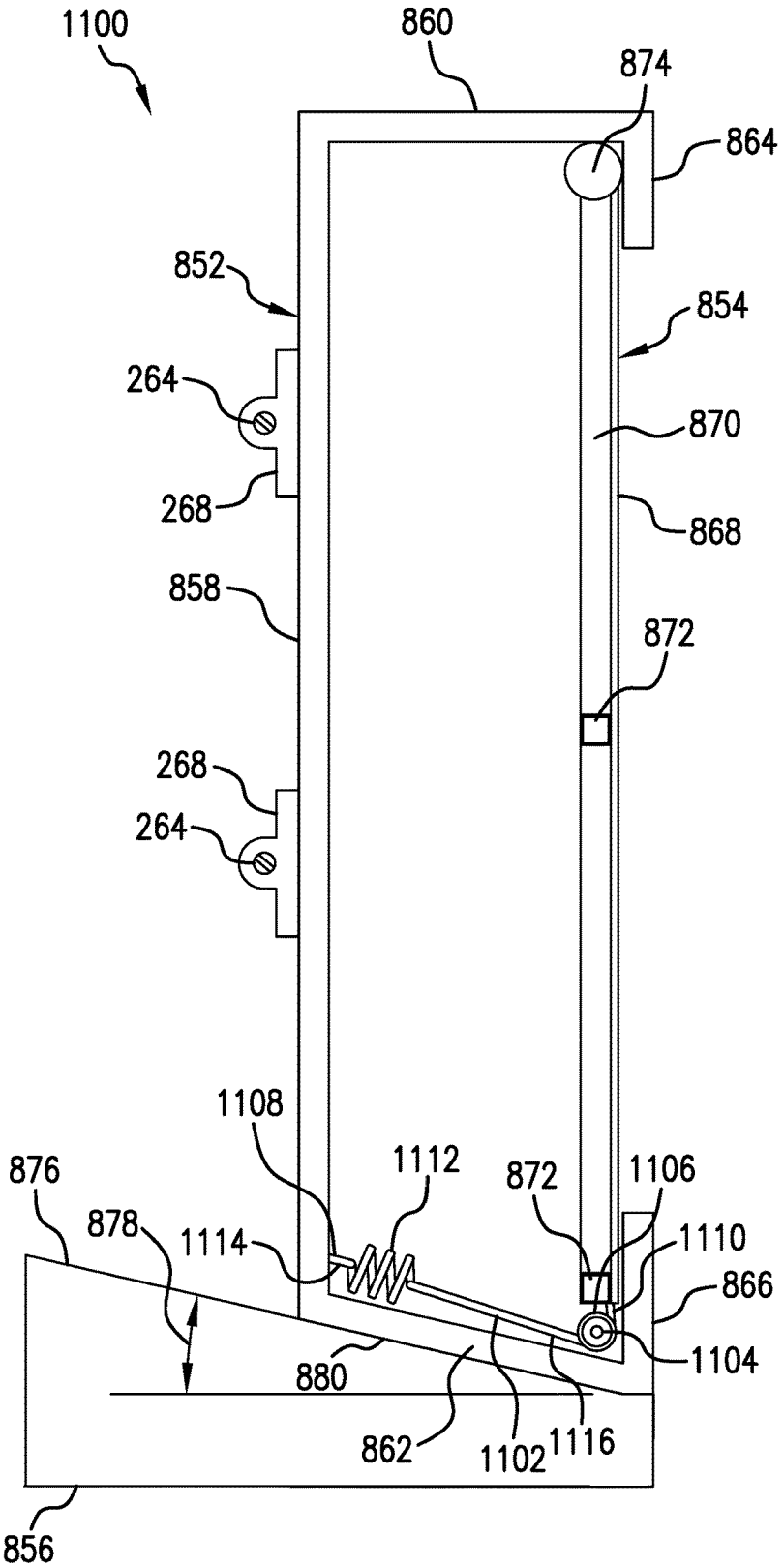
FIG. 51 shows a view of the wall assembly of FIG. 49 positioned on a base in accordance with an exemplary embodiment of the present disclosure.
Figure 52:
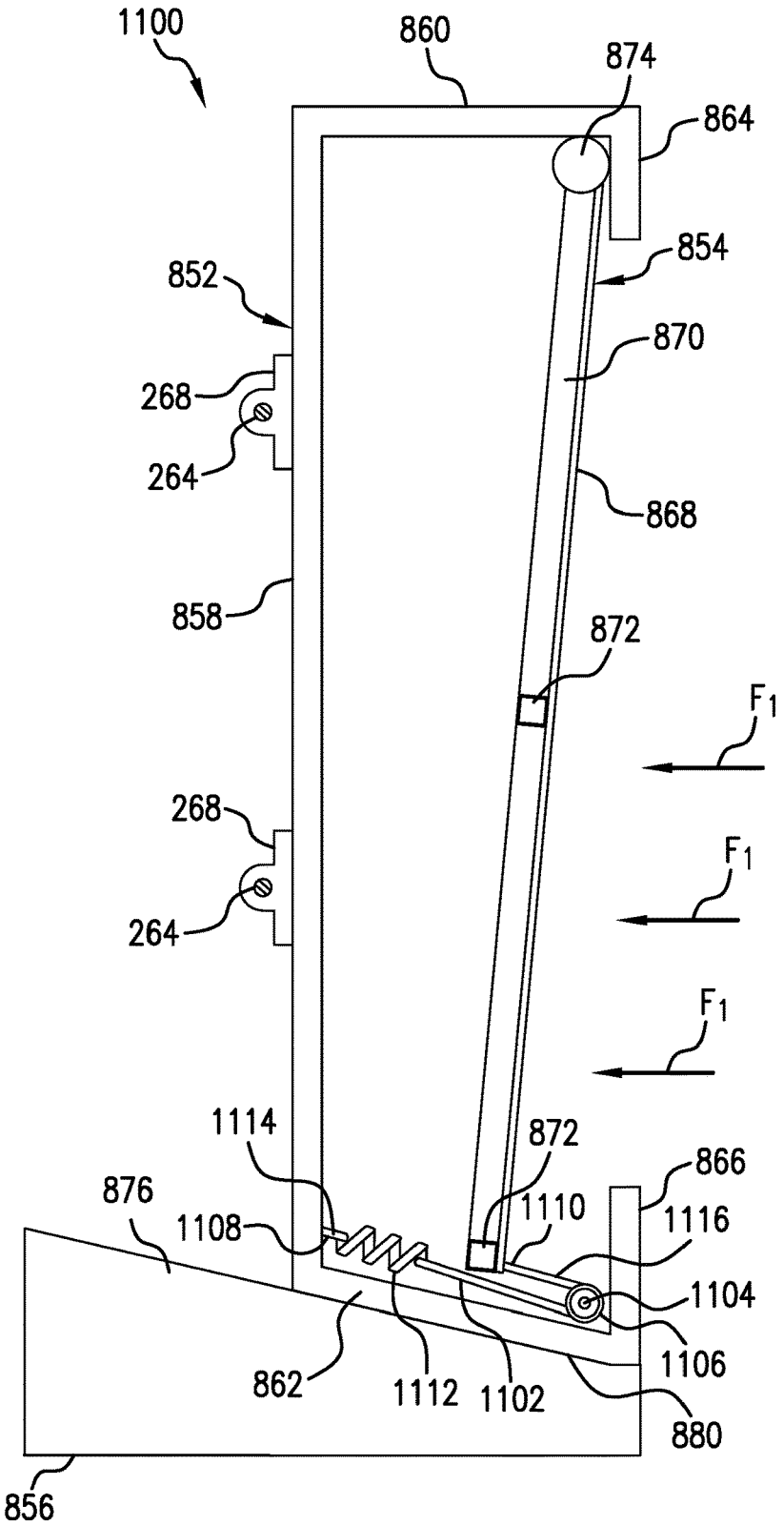
FIG. 52 shows another view of the wall assembly of FIG. 51.

When a force $F_1$ is applied to movable wall assembly 854, movable wall assembly 854 deflects from an un-deflected position shown in FIGS. 49 and 51 to a deflected position, such as that shown in FIGS. 50 and 52. As movable wall assembly 854 moves from the position shown in FIGS. 49 and 51 to a deflected position, movable wall assembly 854 swivels or rotates about hinge assembly 874. As movable wall assembly 854 swivels or rotates about hinge assembly 874, movable wall 854 pulls on second end 1110 of second extension 1116. As second extension 1116 is pulled, coils 1112 of extension spring 1102 are stretched because first end 1108 is fixed to support assembly 852 and first end 1108 is thus unable to move. As coils 1112 are stretched, the tension in coils 1112 increases. If movable wall assembly 854 rotates to a maximum position due to a force $F_2$, or if a force $F_1$ is applied to a location on support assembly 852 instead of on movable wall assembly 854, wall assembly 850 can move along top surface 876 of base 856, from the position shown in FIGS. 51 and 52 to the position shown in FIG. 53. As wall assembly 850 moves, tension increases in cables 264.

Figure 53:
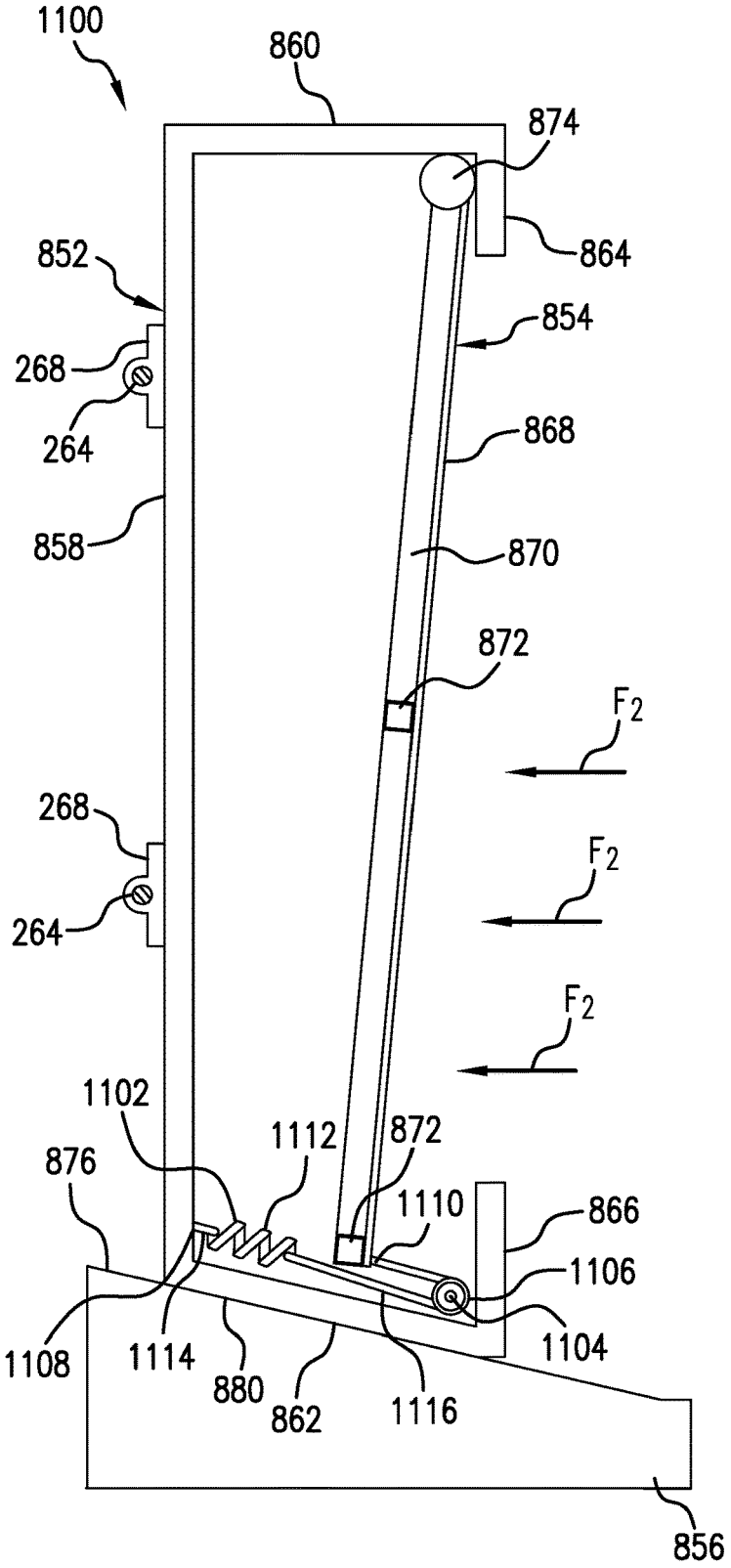
FIG. 53 shows a further view of the wall assembly of FIG. 51.

After the force $F_1$ or $F_2$ against wall assembly 850 is removed, if extension spring(s) 1102 are extended, the tension in extension spring(s) 1102 pulls on second extension 1116, and the force on second extension 1116 is transferred around pulley 1106 to second end 1110, which pulls movable wall assembly 854 from a deflected position, such as that shown in FIGS. 50, 52, and 53, to an un-deflected position, such as that shown in FIGS. 49 and 51. In the un-deflected position, movable wall assembly 854 can contact bottom lip 866, which serves to establish the un-deflected position of movable wall assembly 854 with respect to support assembly 852. If wall assembly 850 has moved or deflected, the tension in cables 264 causes wall assembly 850 to move from the deflected position, such as that shown in FIG. 52, to the un-deflected position, such as that shown in FIGS. 51 and 52. It should be understood that a stop, such as stop 756 disclosed hereinabove, can be positioned to limit movement of wall assembly 850 toward activity surface 60 under the restoring force of cables 264.

Figure 54:
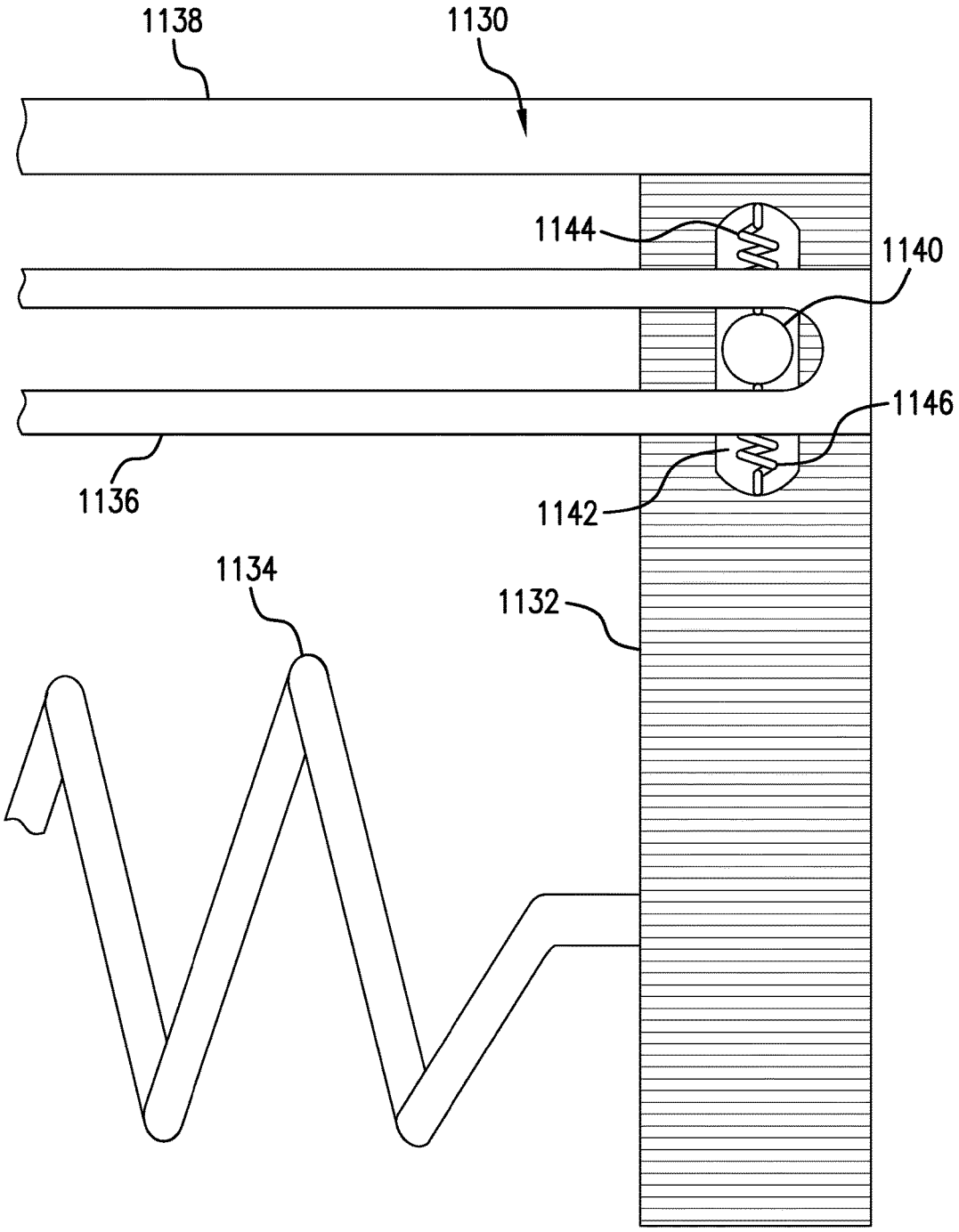
FIG. 54 shows a view of a guide pin assembly in accordance with an exemplary embodiment of the present disclosure.

Several embodiments disclosed herein use guide pins, such as guide pins 818 and guide pins 926 disclosed elsewhere herein. FIG. 54 shows a view of a guide pin assembly, indicated generally at 1130, in accordance with an exemplary embodiment of the present disclosure that can be used in any embodiment disclosed herein. Because of unequal distribution of an impacting force, the movable wall assemblies disclosed herein may attempt to tilt with respect to a perfect or true vertical orientation. In such circumstances, the vertical position of a pin positioned in a movable wall assembly may deviate sufficiently to cause increased friction with a corresponding channel guide, which can also be described as a pin guide. The pin assembly disclosed in FIG. 54 provides a pin configuration that enables tilt of a movable wall assembly while reducing the risk of the pin binding with the channel guide in which the pin is positioned.

FIG. 54 shows a portion of a movable wall assembly 1132, a portion of a compression spring 1134, a portion of a pin or channel guide 1136, and a portion of a top cover or cap 1138. Pin assembly 1130 includes a guide pin 1140, which is positioned within a slot, groove, or channel 1142 formed in movable wall assembly 1132, and a pair of centering springs 1144 and 1146. To maintain pin 1140 within slot, groove, or channel 1142, upper centering spring 1144 is positioned in slot, groove, or channel 1142 and fastened to movable wall assembly 1132 and to pin 1140, and lower centering spring 1146 is positioned in slot, groove, or channel 1142 and fastened to movable wall assembly 1132 and to pin 1140. Upper centering spring 1144 can be positioned in slot, groove, or channel 1142 in a location that is directly between pin 1140 and movable wall assembly 1132. Lower centering spring 1146 can be positioned in slot, groove, or channel 1142 in a location that is directly between pin 1140 and movable wall assembly 1132.

In a circumstance where movable wall assembly 1132 tilts with respect to its un-deflected or non-deflected position, which is nominally approximately perpendicular to the ground, if pin 1140 were solidly affixed to movable wall assembly 1132, pin 1140 would move vertically up or down as movable wall assembly 1132 tilts. In the embodiment of FIG. 54, if movable wall assembly 1132 tilts in a way that causes pin 1140 to move downwardly, which can happen as movable wall assembly 1132 moves from an un-deflected position to a deflected position, pin 1140 would be permitted to remain in the approximately same horizontal location by compressing upper centering spring, and reducing tension on lower centering spring 1146. When movable wall assembly 1132 returns to the un-deflected position, movable wall assembly 1132 would return to its original tilt angle, which can be approximately perpendicular to the ground. As movable wall assembly 1132 returns to its original tilt angle, movable wall assembly 1132 can move vertically with respect to channel guide 1136. However, pin 1140 is unable to move vertically because channel guide 1136 prevents pin 1140 from moving vertically. To maintain its relative position with respect to channel guide 1136, pin 1140 moves downwardly with respect to slot, channel, or groove 1142, reducing compression on upper centering spring 1144, and increasing compression on lower centering spring 1146.

Figure 55:
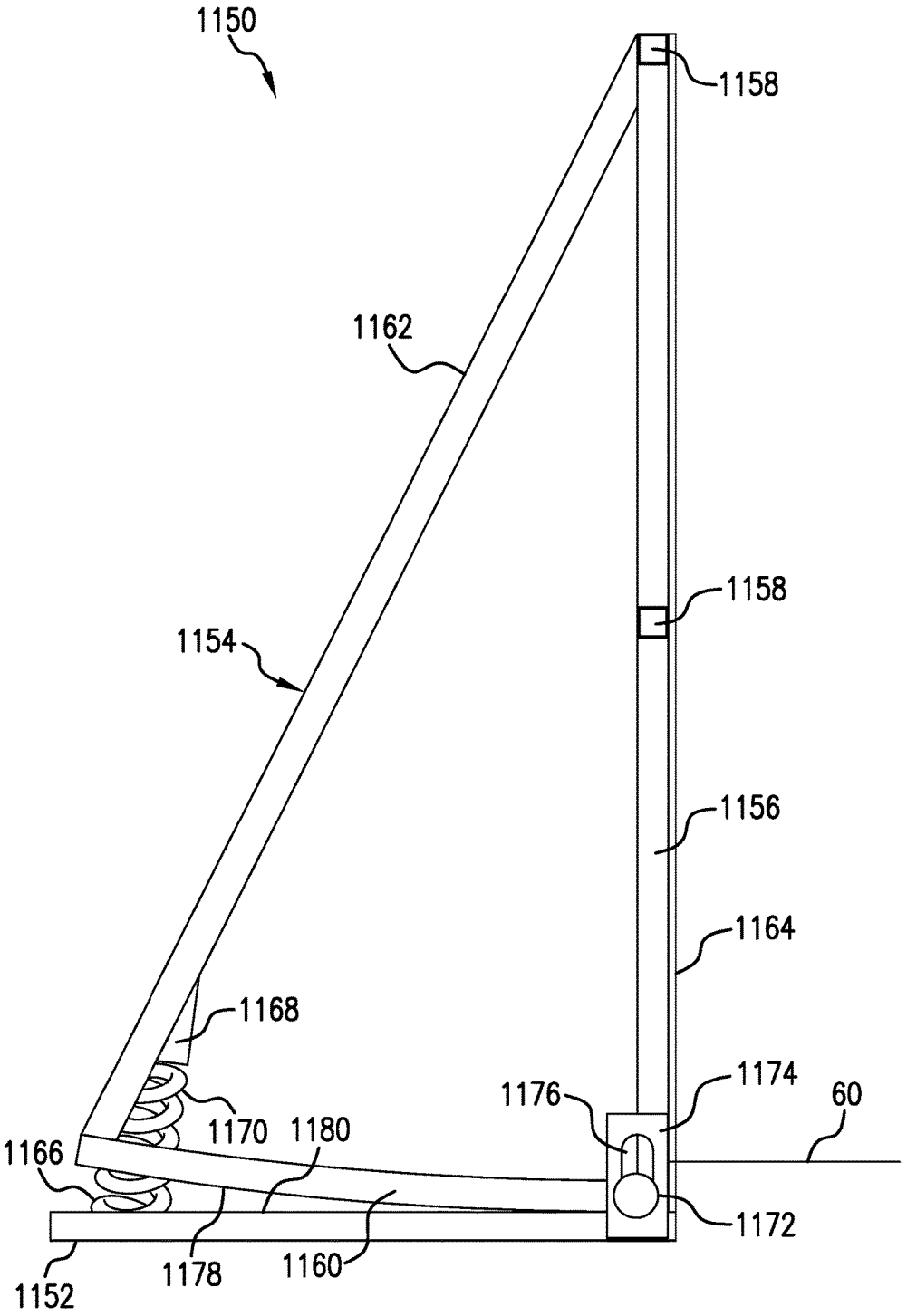
FIG. 55 shows a view of a wall assembly in accordance with a still even further exemplary embodiment of the present disclosure.
Figure 56:
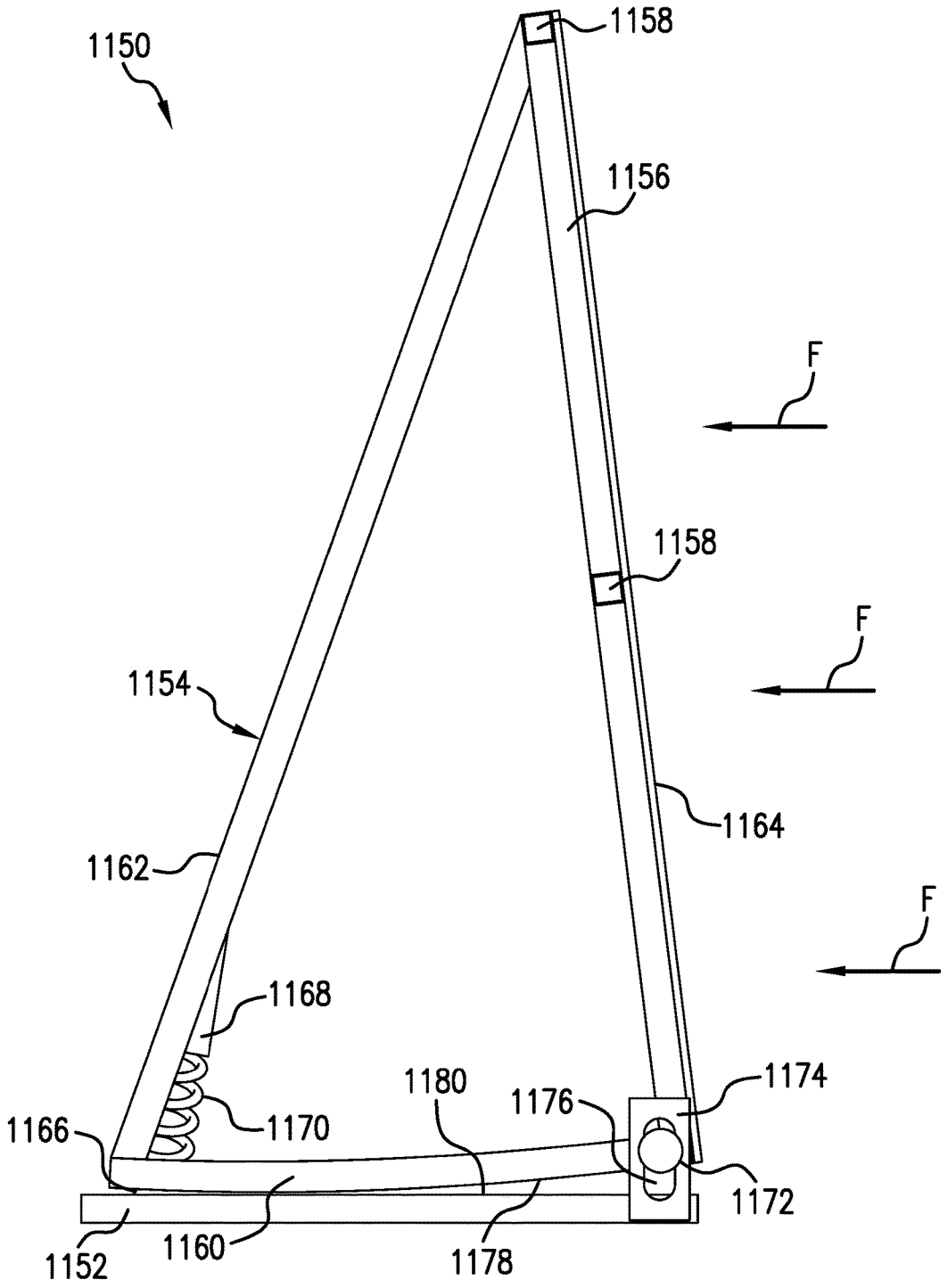
FIG. 56 shows another view of the wall assembly of FIG. 55.

FIGS. 55 and 56 show views of a wall assembly, indicated generally at 1150, in accordance with a still even further exemplary embodiment of the present disclosure. Wall assembly 1150 includes a base 1152 and a movable wall assembly 1154. Base 1152 can be secured to, for example, a floor or the ground.

Movable wall assembly 1154 can include a plurality of vertically extending frames 1156, a plurality of transverse frames 1158 extending between each adjacent pair of vertically extending frames 1156, a plurality of rocking interface frames 1160, each of which is connected to a bottom end of at least one vertically extending frame 1156, a plurality of angled support frames 1162, each of which connects an upper end of one vertically extending frame 1156 to an end of rocking interface frame 1160 that is spaced away from the connection of rocking interface frame 1160 with a respective vertically extending frame 1156, and a horizontally extending guide pin 1172 that can be attached or connected to rocking interface frame 1160. Rocking interface frame 1160 includes a curvilinear lower surface 1178 for interfacing with an upper surface 1180 of base 1152. Movable wall assembly 1154 can also include a spring base 1168, which can be positioned on angled support frame 1162.

The connection of each angled support frame 1162 with a respective rocking interface frame 1160 can be at the opposite end of rocking interface frame 1160 from the connection of rocking interface frame 1160 with the respective vertically extending frame 1156. The plurality of angled support frames 1162 provides strength and rigidity to movable wall assembly 1154. A front wall 1164 can be attached to at least some of the plurality of vertically extending frames 1156 and the plurality of transverse frames 1158.

Base 1152 can include a plurality of fixed spring bases 1166, which are positioned in positions that are approximately in opposition to a respective movable wall spring base 1168 when movable wall assembly 1154 is positioned or mounted on base 1152. Base 1152 can also include a plurality of pin or channel guides 1174, each of which includes a slot or channel 1176. Each pin or channel guide can be attached at an end of base 1152 that is adjacent to, near to, alongside, in proximity to, or close to a respective pin 1172 when movable wall assembly 1154 is positioned or mounted on base 1152. Each pin 1172 extends into a respective slot or channel 1176 to restrain and guide movable wall assembly 1154 with respect to base 1152.

Wall assembly 1150 further includes a compression spring 1170 that is positioned between fixed spring base 1166 and movable wall spring base 1168. Compression spring 1170 can be affixed or attached to fixed spring base 1166 and movable wall spring base 1168.

When a force F is applied to movable wall assembly 1154, as shown in FIG. 56, the force causes movable wall assembly 1154 to tilt or rock backward or away from activity surface 60, which is enabled by curvilinear lower surface 1178. As movable wall assembly 1154 tilts or rocks backward, compression spring 1170 is compressed by the decreasing distance between movable wall spring base 1168 and fixed spring base 1166. At the same time as compression spring 1170 is compressed, pin 1172 moves along slot or channel 1176, preventing movable wall assembly 1154 from sliding backwardly away from activity surface 60.

After force F is removed from movable wall assembly 1154, the compressive force stored in compression spring 1170 forces movable wall spring base 1168 away from fixed spring base 1166, causing movable wall assembly 1154 to return to its original, un-deflected position shown in FIG. 55.

In an alternative embodiment, movable wall assembly 1154 can be weighted such that movable wall assembly 1154 returns to an upright position once the collision terminates. In another alternative embodiment, cables 264 disclosed elsewhere herein can function to restore movable wall assembly 1154 to an un-deflected position. Adjacent wall assemblies 1154 can be connected to any particular movable wall assembly 1154 to help return movable wall assembly 1154 to an upright position and to avoid holes, openings, or gaps between adjacent movable wall assemblies 1154. Such a design may serve as a complement to base 222, depending on the required deceleration lengths to reduce injury.

Figure 58:
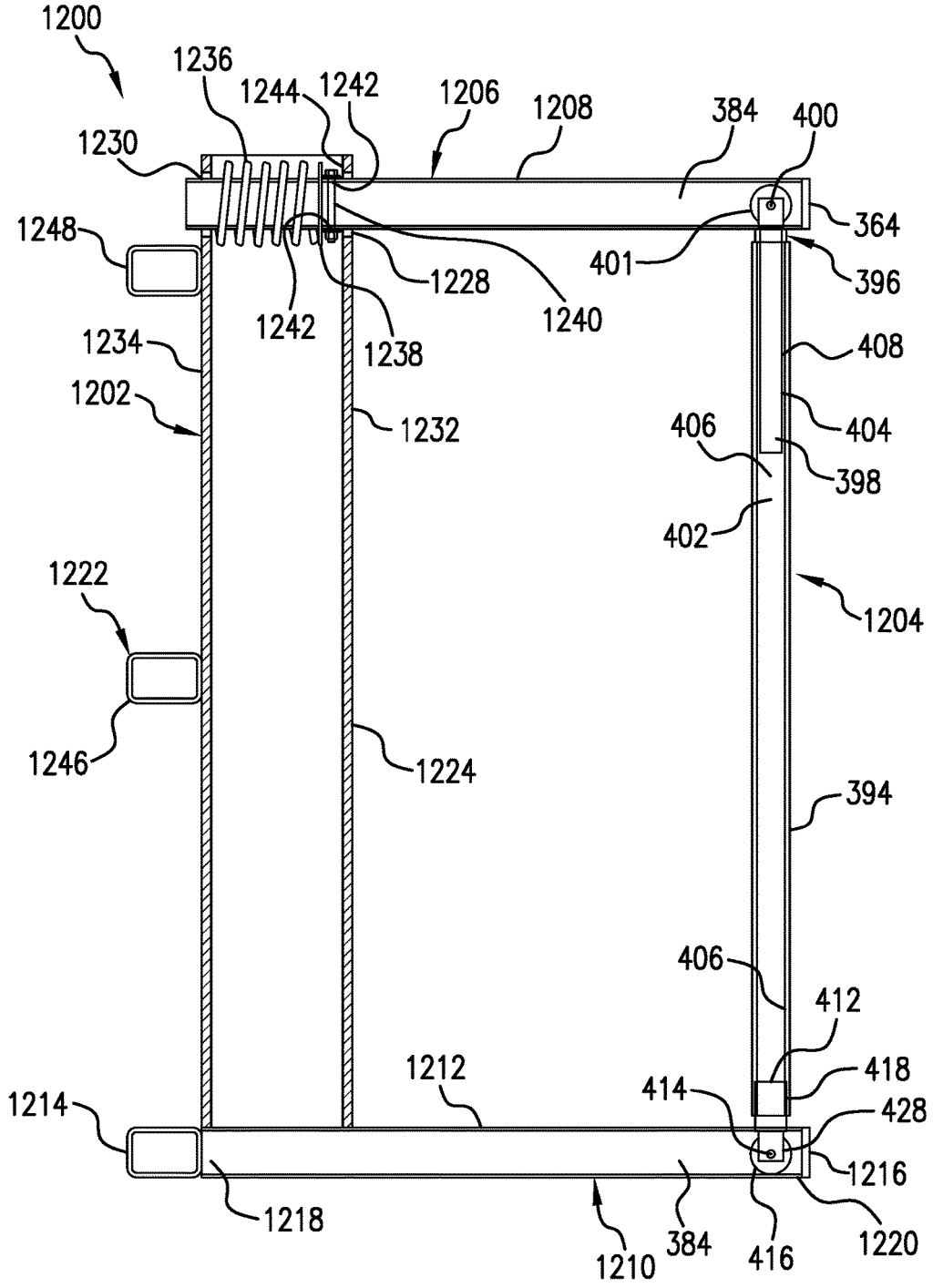
FIG. 58 shows a view of a wall assembly in accordance with an exemplary embodiment of the present disclosure.
Figure 59:
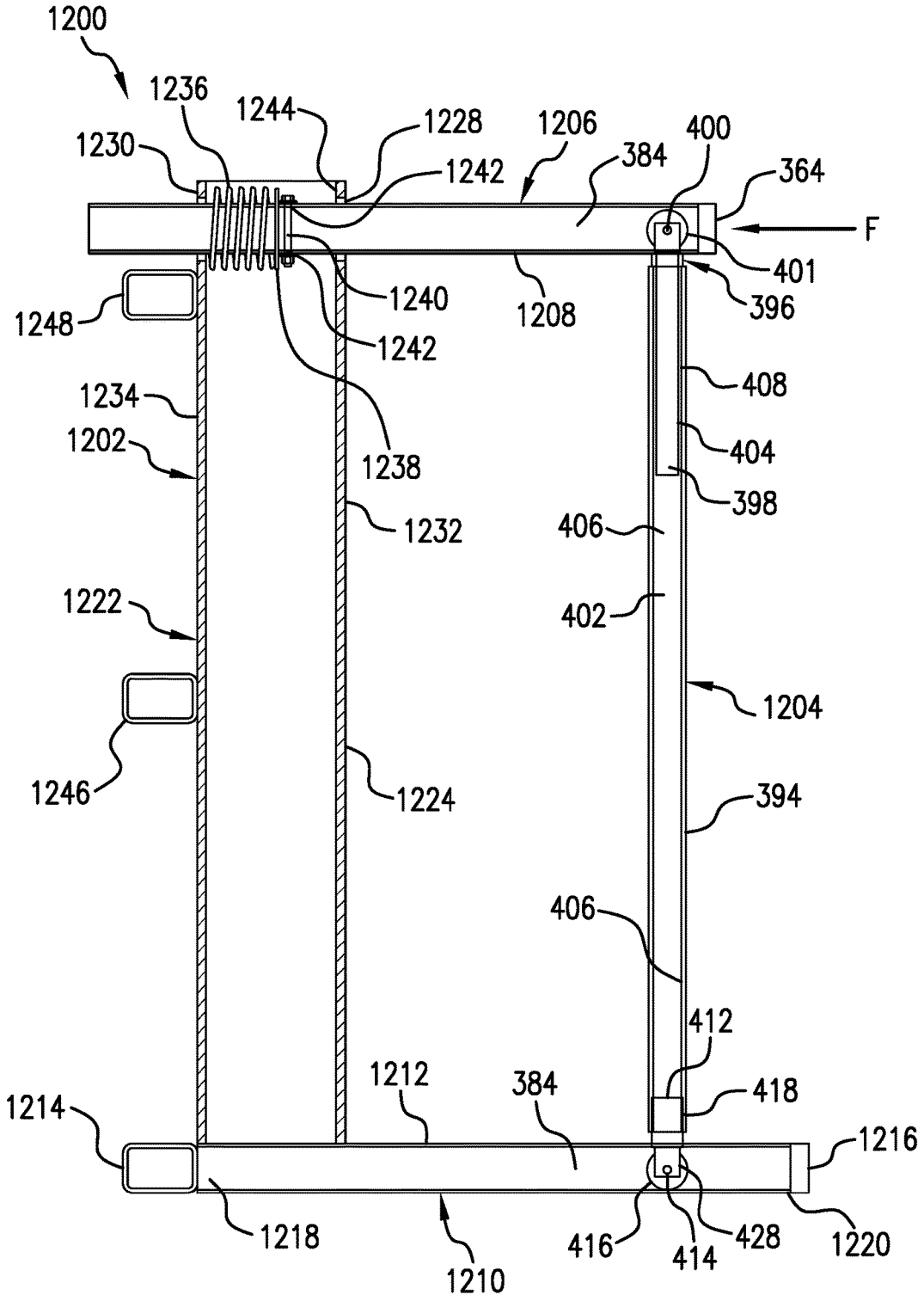
FIG. 59 shows another view of the wall assembly of FIG. 58.

FIGS. 58 and 59 show views of a wall assembly, indicated generally at 1200, in accordance with an exemplary embodiment of the present disclosure. In the views of FIGS. 58 and 59, covers or caps, shields, and some shock absorbers are removed to simplify explanation of the figures. In many of the embodiments disclosed herein, the upper or top support frame, including the upper transverse frames, is generally fixed. Thus, if a participant in a sports activity were to apply force against the upper or top support frame or one or more of the upper transverse frames, the non-moving frame would cause rapid deceleration of the participant, which could cause significant injuries, especially when the participant is moving at a high speed at the time the participant impacts with or hits the non-moving frame. Wall assembly 1200 includes features to reduce the rate of deceleration, and the reduced rate of deceleration reduces the level or amount of potential injury to the participant as compared to a fixed or non-moving frame. Wall assembly 1200, which can also be described as wall segment 1200 or board 1200, includes a support assembly 1202 and a movable board or wall assembly 1204.

Support assembly 1202 can include a plurality of elements, including, for example, a transverse or horizontally extending upper or top frame support 1206, which can include a plurality of upper transverse frames 1208 that extend in a direction that is approximately perpendicular to a major surface of movable wall assembly 1204. Support assembly 1002 can also include a transverse or horizontally extending lower or bottom support frame 1210, which can include a plurality of lower transverse frames 1212 that extend in a direction that is approximately perpendicular to a major surface of movable wall assembly 1204, at least one rear, lower, connecting frame 1214 that extends approximately parallel to a front or outer surface, i.e., a major surface, of movable wall assembly 1204, and at least one front, lower, connecting frame 1216 that also extends approximately parallel to the front, outer, or major surface of movable wall assembly 1204. Rear, lower, connecting frame 1214 can be connected to respective ends 1218 of each lower transverse frame 1212, each end 1218 positioned at a location that is at an opposite end of a respective lower transverse frame 1212 from the un-deflected position of movable wall assembly 1204. Rear, lower, connecting frame 1214 helps to provide strength and stability to lower transverse frames 1212. The attachment of rear, lower, connecting frame 1214 to each respective lower transverse frame 1212 can be, for example, by way of fasteners and brackets (not shown), welding, or other attachment devices and mechanisms.

Front, lower, connecting frame 1216 can be connected to respective ends 1220 of each lower transverse frame 1212, each end 1220 positioned at a location that is at, near to, close to, adjacent to, alongside to, or in proximity to, movable wall assembly 1204 when movable wall assembly 1204 is in the un-deflected position shown in FIG. 58. Each end 1220 is also at an opposite end of a respective lower transverse frame 1212 from end 1218. Front, lower, connecting frame 1216 helps to provide strength and stability to lower transverse frames 1212, particularly in conjunction with rear, lower, connecting frame 1214. The attachment of front, lower, connecting frame 1216 to each respective lower transverse frame 1212 can be, for example, by way of fasteners and brackets (not shown), welding, or other attachment devices and mechanisms.

Support assembly 1202 can also include a vertically extending support frame assembly 1222 that is positioned between upper or top support frame 1206 and lower or bottom support frame 1210. Support frame assembly 1222 can include a plurality of vertically extending connecting frames 1224, each of which is attached or connected to upper or top support assembly 1206 and lower or bottom support assembly 1210 by way of fasteners, brackets, welding, and the like. Such connection of each connecting frame 1224 can be directly to, for example, a respective lower transverse frame 1212. In addition, the connection of each connecting frame 1224 to the respective lower transverse frame 1212 can be at a location at a location on lower transverse frame 1212 that is near to, close to, alongside to, adjacent to, in proximity to, or at end 1218 of lower transverse frame 1212. Each connecting frame 1224 can be in a conventional beam configuration, can be an extruded square or rectangular tube, can be a welded assembly, and the like. As shown in FIGS. 58 and 59, each connecting frame 1224, which is sectioned to shown an interior of connecting frame 1224, is preferably hollow to conserve weight.

Each upper transverse frame 1208 is movably or slidably supported by a respective vertically extending connecting frame 1224. As shown in FIGS. 58 and 59, each upper transverse frame 1208 can extend through a first opening 1228 and a second opening 1230 formed in vertically extending connecting frame 1224. First opening 1228 is formed on a first, front wall 1232 of vertically extending connecting frame 1224, and second opening 1230 is formed on a second, back wall 1234 of vertically extending connecting frame 1224. In the context of FIGS. 58 and 59, first, front wall 1232 is on a side of vertically extending connecting frame 1224 that faces toward movable wall assembly 1204, and second, back wall 1234 is on a side of vertically extending connecting frame 1224 that faces away from movable wall assembly 1204. First opening 1228 and second opening 1230 can be oriented along a line that extends approximately perpendicularly to movable wall assembly 1204.

Each upper transverse frame 1208 is movably or slidably captured by a respective vertically extending connecting frame 1224. In the embodiment shown in FIGS. 58 and 58, upper or top support frame 1206 includes a spring 1236, a washer 1238, and a fastener 1240. During assembly, upper transverse frame 1208 is inserted into first opening 1228, then through a center or central opening of washer 1238, then through an interior of spring 1236, and then through second opening 1230. After upper transverse frame 1208 is positioned as described, washer 1238 can be compressed to compress spring 1236. While washer 1238 and spring 1236 are compressed, fastener 1240 is inserted through openings 1242 formed in upper transverse frame 1208, after which washer 1238 is released, permitting spring 1236 to expand, which forces fastener 1240 toward an interior surface 1244 of upper transverse frame 1208. The uncompressed force of spring 1236 against interior surface 1244 is set to minimize incidental movement such as when someone leans against movable wall assembly 1204. For example, the spring constant of spring 1236 may be approximately 8 pounds/inch, so that using four springs 1236 would produce a total spring force on movable wall assembly 14 of about 800 pounds with a stroke of 10 inches. In such an embodiment, four elastomer springs 1236 may be wound to have an initial tension of approximately 100 pounds, such that the preloaded force on the panel is approximately 400 pounds. As should be understood, when a participant imparts a force on upper or top support frame 1206, such as on upper transverse frames 1208, upper or top support frame 1206 moves under the effect of the force, compressing spring 1236, reducing the deceleration to which the participant would otherwise be subjected, decreasing injuries that the participant might otherwise receive from a fixed or non-moving upper or top support frame 1206.

Each disclosed element of wall assembly 1200 that is labeled with an identical number can be identically configured, or each element can be different from each other. For example, some vertically extending connecting frames 1224 can be square or rectangular tubes, and other frames 1224 can be U-shaped or V-shaped.

Each upper transverse frame 1208 and each lower transverse frame 1212 can include track 384 that is approximately parallel to a respective upper transverse frame 1208 and/or lower transverse frame 1212. Track 384 has been described elsewhere herein, and that description of track 384 is applicable to FIGS. 58 and 59 with respect to movable wall assembly 1204, upper transverse frame 1208, and lower transverse frame 1212, as appropriate.

Wall assembly 1200 can further include a plurality of walls or caps to cover portions of support assembly 1202 and movable wall assembly 1204 to prevent access to internal locations of wall assembly 1200. For example, wall assembly 1200 can include a front wall such as front wall 330 shown in FIGS. 15 and 16 that can be fabricated from a strong, lightweight plastic, composite, or wood material. Though not shown in FIGS. 58 and 59, wall assembly 1200 can also include a top cap or cover that may be similar to, for example, top cap or cover 44 shown in FIGS. 1 and 2, which connects or attaches to one or more of the subcomponents included in support assembly 1202 and or upper or top support assembly 1206. Unlike the embodiment of FIGS. 1 and 2, top cap or cover 44 in the embodiment of FIGS. 58 and 59 can permit the movement of upper or top support assembly 1206 relative to top cap or cover 44, or top cap or cover 44 can including a plurality of elements to permit top cap or cover 44 to collapse or compress with the movement of upper transverse frames 1208.

Wall assembly 1200 can also include a back cap or cover (not shown) that may be similar to, for example, back cap or cover 46 shown in FIGS. 1 and 2, which connects or attaches to one or more of the subcomponents included in lower or bottom support assembly 1210, and/or vertically extending support frame assembly 1222, such as rear lower, connecting frame 1214, and/or vertical connecting frames 1224.

Vertically extending support frame assembly 1222 can further include an intermediate transverse frame 1246 that can be positioned at or near a vertically central location of each vertical connecting frame 1224, which can thus be approximately a mid-point of each vertical connecting frame 1224. Vertically extending support frame assembly 1222 can also include a rear upper connecting frame 1248 that extends approximately parallel to a front wall or surface of movable wall assembly 1204. Intermediate transverse frame 1246 can be positioned at a location that is directly between rear upper connecting frame 1248 and lower connecting frame 1214. Intermediate transverse frame 1248 can attach or connect to each vertically extending connecting frame 1224 by way of fasteners, welding, sintering, one or more brackets, and the like. Such attachment of intermediate transverse frame 1248 can be directly to each vertical connecting frame 1224.

Movable wall assembly 1204 can be configured similar to movable wall assembly 354 shown in FIGS. 17-21. Accordingly, elements of FIGS. 58 and 59 that are similar to or the same as elements of movable wall assembly 354 are similarly labelled, and the description of those elements in FIGS. 17-21 are applicable to the embodiment of FIGS. 58 and 59.

After a force is removed from front upper connecting frame 364, upper or top support frame 1206, or upper transverse frames 1208, which can occur after a sport participant moves away from wall assembly 1200, the force of spring 1236 against the interior surface of a back wall of vertical connecting frame 1224 pushes washer 1238 toward fastener 1240, which pushes fastener 1240 toward the interior front surface of vertical connecting frame 1224, restoring upper top support frame 1206 from the deflected position shown in FIG. 59 to the undeflected position shown in FIG. 58.

Figure 62:
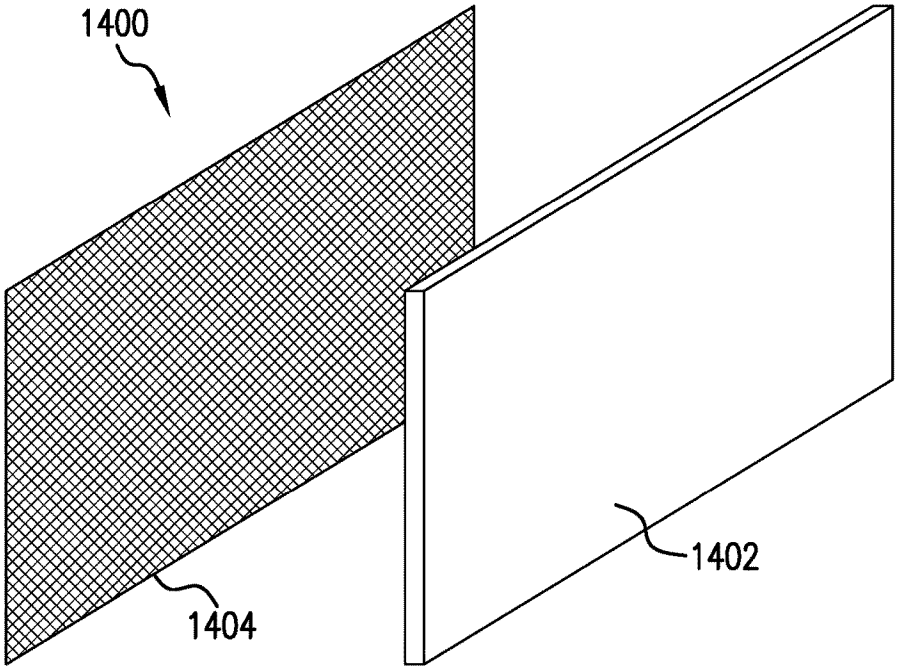
FIG. 62 shows an exploded view of the front wall of FIG. 60.
Figure 60:
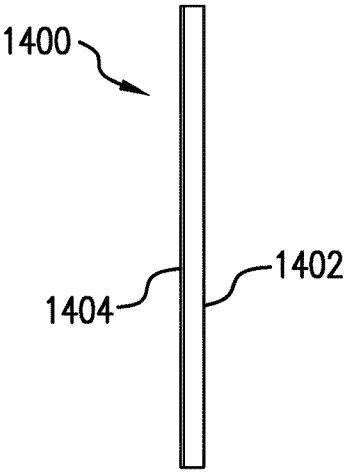
FIG. 60 shows a side view of a front wall of a movable wall assembly in accordance with an exemplary embodiment of the present disclosure.
Figure 61:
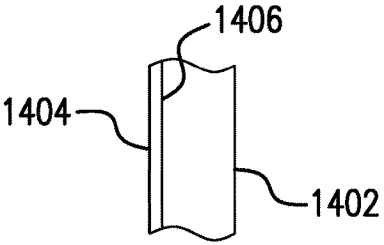
FIG. 61 shows an enlarged view of the front wall of FIG. 60.

FIGS. 60-62 show views of a front wall of a movable wall assembly, indicated generally at 1400, in accordance with an exemplary embodiment of the present disclosure. Front wall 1400 can be used as the front wall of any of the exemplary embodiments presented herein. In addition, all other surfaces used to enclose the structure of a wall assembly, including the structure of an associated support assembly and an associated movable wall assembly, such as various top caps or cover, back caps or covers, end caps or covers, and the like, can be constructed in the manner of front wall 1400.

Front wall 1400 can be described as a front wall assembly because front wall 1400 can include a plurality of components. For example, front wall 1400 can include a wall panel 1402 and a fiber layer 1404. Front wall panel 1402 can be formed of a light weight plastic, such as polyethylene or high density polyethylene (HDPE), and can be formed in a matrix or honeycomb configuration to obtain a combination of relatively low weight with relatively high strength. While front wall 1400 can be in the form of a composite, in an exemplary embodiment, front wall panel 1402 is a plastic for resiliency, i.e., the ability to flexibly absorb impacts and to restore without permanent deformation. To provide strength and durability, i.e., to reinforce or provide reinforcement, fiber layer 1404 can be adhered by an adhesive or glue layer 1406 to front wall panel 1402. Fiber layer 1404 can also be a spun layer where fibers are adhered directly to front wall panel 1402 in a plurality of orientations to avoid shear effects. Such direct adherence can be by way of resin bonding, where a layer of resin, which has adhesive properties, is applied to front wall panel 1402, and fibers are applied to the resin while the resin is fluid. Fiber layer 1404 can be a woven fabric, and fiber layer 1404 can be formed of a plurality of materials, such as fiberglass, glass, carbon fiber, and Kevlar. In an exemplary embodiment, fiber layer 1404 can be approximately 0.05 inches thick. In another exemplary embodiment, the thickness of fiber layer 1404 can be 0.04 to 0.06 inches thick. In yet another exemplary embodiment, the thickness of fiber layer 1404 can be 0.04 to 0.10 inches thick.

In addition to being formed as a front wall panel and a fiber layer, a front wall can be formed as a single piece with a fiber layer integrally formed in a front wall panel. Such construction can be by insert molding a fiber layer into the front wall panel, or fabricating the wall panel as a plurality of layers with fibers incorporated into the layers.

FIGS. 63-71 show views of a wall assembly, indicated generally at 1450, in accordance with a further exemplary embodiment of the present disclosure. In the views of FIGS. 63-68, covers or caps, shields, and shock absorbers are removed to simplify explanation of the figures. Wall assembly 1450, which can also be described as wall segment 1450 or board 1450, includes a support assembly 1452 and a movable board or wall assembly 1454.

Support assembly 1452 can include a plurality of elements, including, for example, a transverse or horizontally extending upper or top frame support 1456, which can include a plurality of upper transverse frames 1458 that extend in a direction that is approximately perpendicular to a major surface of movable wall assembly 1454, and at least one rear upper connecting frame 1460 that extends approximately parallel to movable wall assembly 1454. Rear upper connecting frame 1460 is attached to and extends along respective ends 1462 of upper transverse frames 1458 to provide strength and stability to upper transverse frames 1458. Such attachment can be, for example, by way of fasteners and brackets (not shown), welding, or other attachment devices and mechanisms. Each end 1462 is located at an opposite end of a respective upper transverse frame 1458 from movable wall assembly 1454 when movable wall assembly 1454 is in an un-deflected position.

Support assembly 1452 can also include a front upper connecting frame 1464 (as shown partially removed in FIG. 65) that extends approximately parallel to movable wall assembly 1454 and approximately parallel to rear upper connecting frame 1460. Front upper connecting frame 1464 is attached to and extends along respective ends 1472 of upper transverse frames 1458 to provide strength and stability to upper transverse frames 1458. Such attachment can be, for example, by way of fasteners and brackets (not shown), welding, or other attachment devices and mechanisms. Each end 1472 is located at an opposite end of a respective upper transverse frame 1458 from end 1462. In addition, each end 1472 is near to, adjacent to, close to, alongside of, or proximate to movable wall assembly 1454 when movable wall assembly 1454 is in an un-deflected position.

Support assembly 1452 can also include a transverse or horizontally extending lower or bottom support frame 1466, which can include a plurality of lower transverse frames 1468 that extend in a direction that is approximately perpendicular to a major surface of movable wall assembly 1454, at least one rear, lower, connecting frame 1470 that extends approximately parallel to a front or outer surface of movable wall assembly 1454, and at least one front, lower, connecting frame 1474 (as shown partially removed in FIG. 65) that also extends approximately parallel to a front, outer, or major surface of movable wall assembly 1454. Rear, lower, connecting frame 1470 can be connected to respective ends 1476 of each lower transverse frame 1468, each end 1476 positioned at a location that is at an opposite end of a respective lower transverse frame 1468 from the undeflected position of movable wall assembly 1454. Rear, lower, connecting frame 1470 helps to provide strength and stability to lower transverse frames 1468. The attachment of rear, lower, connecting frame 1470 to each respective lower transverse frame 1468 can be, for example, by way of fasteners and brackets (not shown), welding, or other attachment devices and mechanisms.

Figure 63:
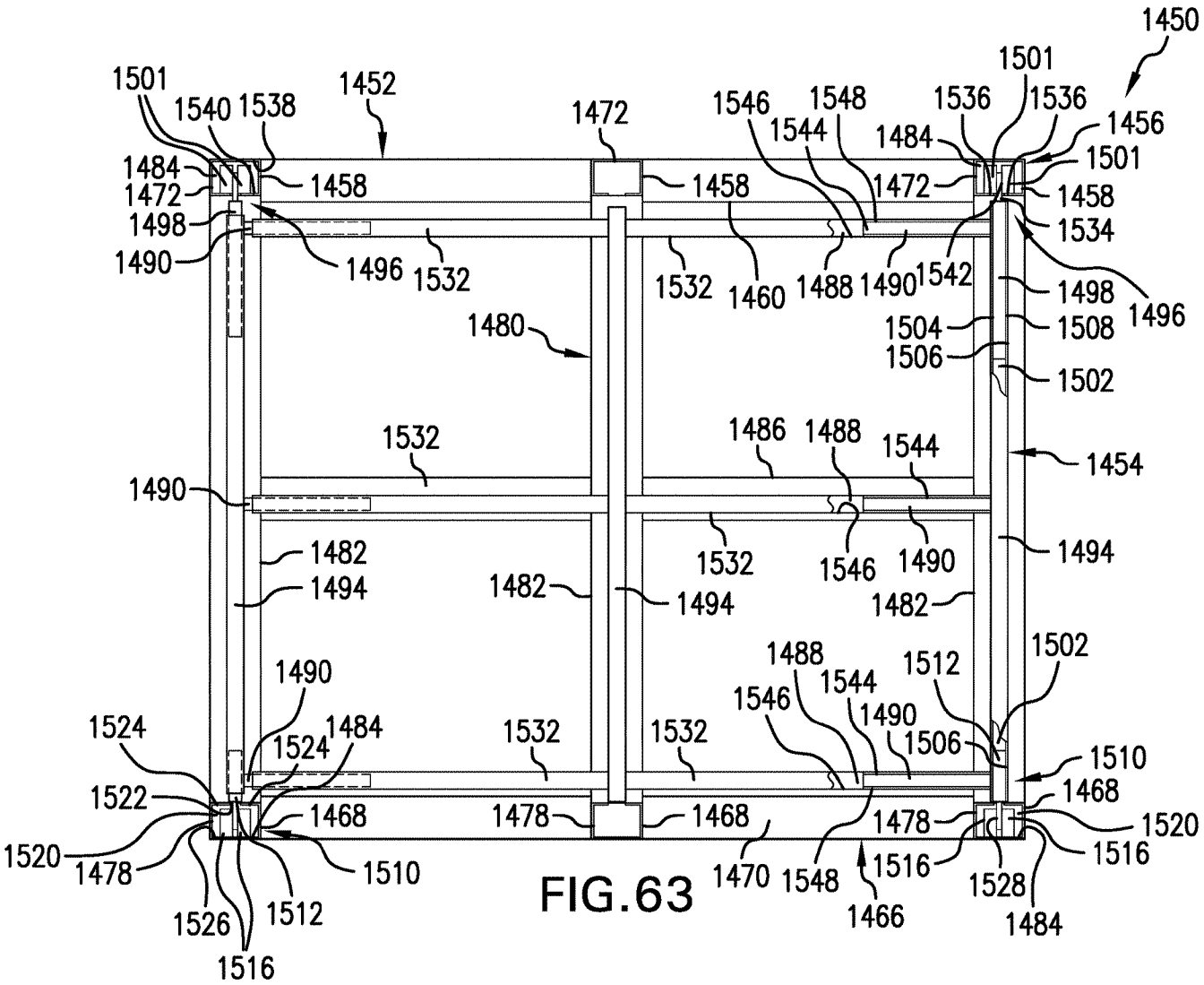
FIG. 63 shows a view of a wall assembly in accordance with another exemplary embodiment of the present disclosure.
Figure 64:
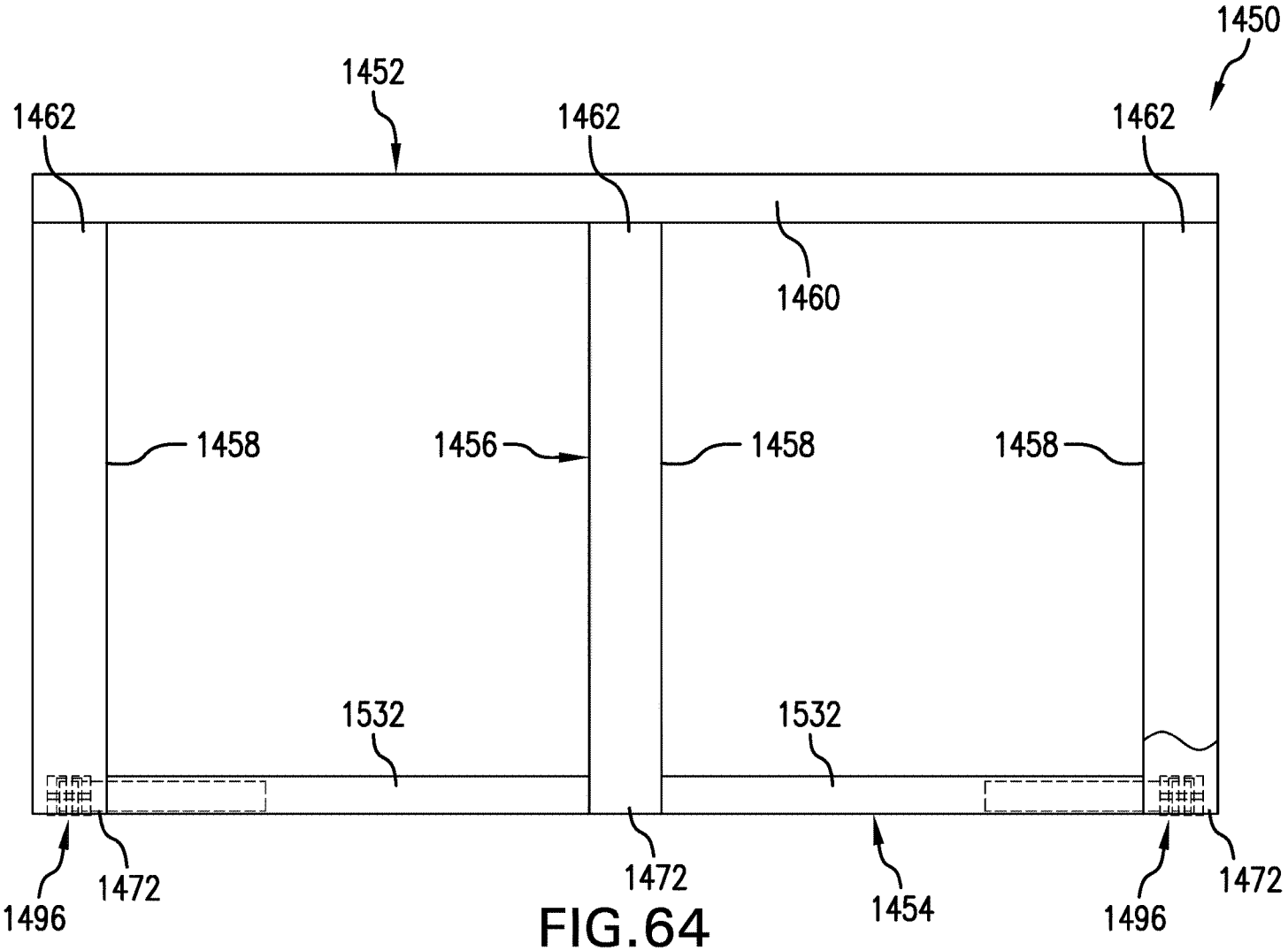
FIG. 64 shows a further view of the wall assembly of FIG. 63.
Figure 65:
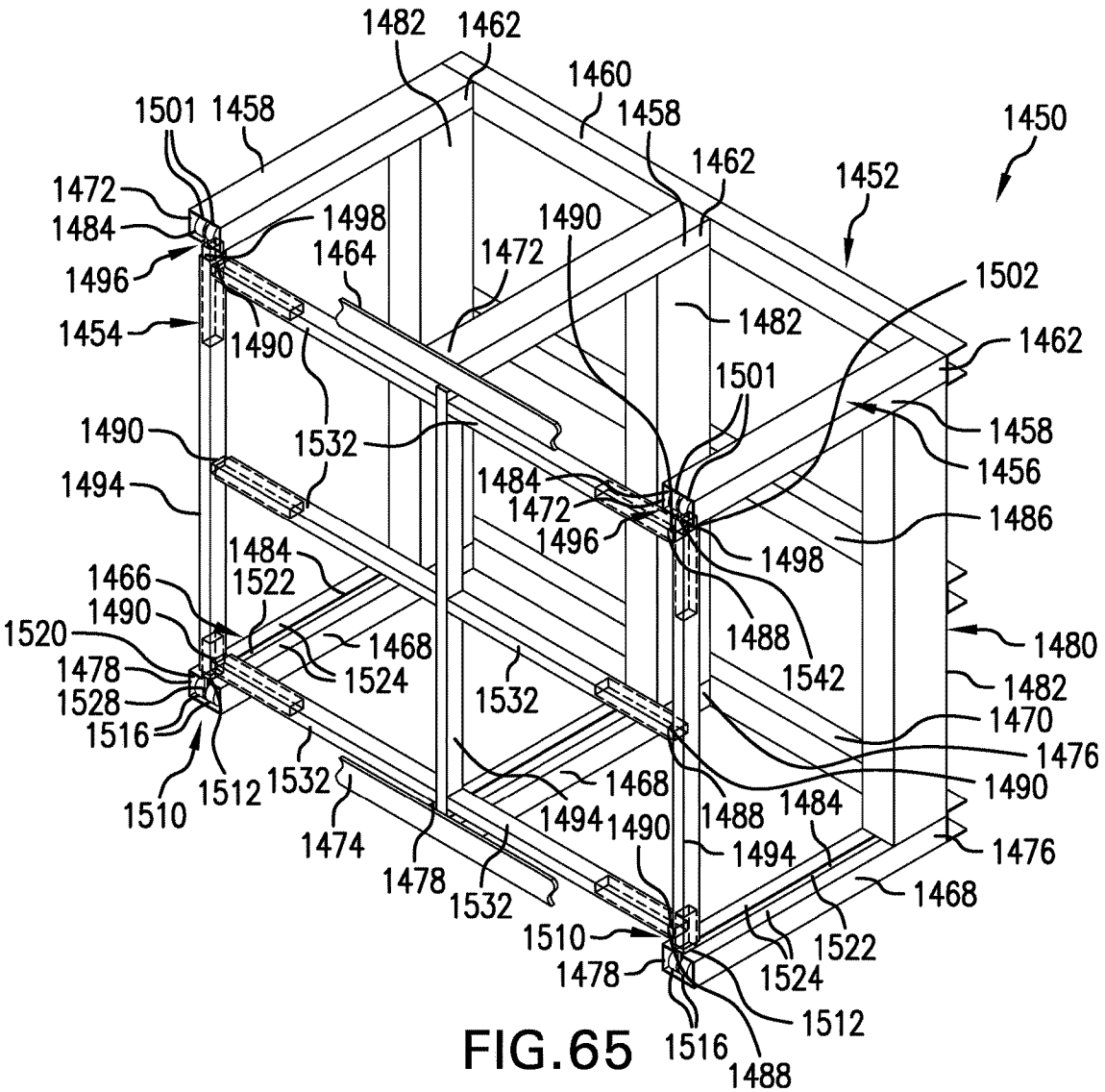
FIG. 65 shows a perspective view of the wall assembly of FIG. 63.

Front, lower, connecting frame 1474 can be connected to respective ends 1478 of each lower transverse frame 1468, each end 1478 positioned at a location that is at, near to, close to, adjacent to, alongside to, or in proximity to, movable wall assembly 1454 when movable wall assembly 1454 is in the un-deflected position shown in FIGS. 63-65. Each end 1478 is also at an opposite end of a respective lower transverse frame 1468 from end 1476. Front, lower, connecting frame 1474 helps to provide strength and stability to lower transverse frames 1468, particularly in conjunction with rear, lower, connecting frame 1470. The attachment of front, lower, connecting frame 1474 to each respective lower transverse frame 1468 can be, for example, by way of fasteners and brackets (not shown), welding, or other attachment devices and mechanisms.

Support assembly 1452 can also include a vertically extending support frame assembly 1480 that is positioned between upper or top support frame 1456 and lower or bottom support frame 1466. Support frame assembly 1480 can include a plurality of vertically extending connecting frames 1482, each of which is attached or connected to upper or top support frame 1456 and lower or bottom support frame 1466 by way of fasteners, brackets, welding, and the like. Such connection of each connecting frame 1482 can be directly to, for example, a respective upper transverse frame 1458 and directly to a respective lower transverse frame 1468. In addition, the connection of each connecting frame 1482 to the respective upper transverse frame 1458 and the respective lower transverse frame 1468 can be at a location on upper transverse frame 1458 near to, close to, alongside to, adjacent to, in proximity to, or at end 1462 and at a location on lower transverse frame 1468 that is near to, close to, alongside to, adjacent to, in proximity to, or at end 1476. Each connecting frame 1482 can be in a conventional beam configuration, can be an extruded square or rectangular tube, can be a welded assembly, and the like. Though not shown in FIGS. 63-68, each connecting frame 1482 is preferably hollow to conserve weight.

Each disclosed element of wall assembly 1450 that is labeled with an identical number can be identically configured, or each element can be different from each other. For example, some vertically extending connecting frames 1482 can be square or rectangular tubes, and other frames 1482 can be U-shaped or V-shaped.

Each upper transverse frame 1458 and each lower transverse frame 1468 can include a track 1484 that is approximately parallel to a respective upper transverse frame 1458 and/or lower transverse frame 1468. Thus each track 1484 is also approximately perpendicular to movable wall assembly 1454. Each track 1484 can be integrally formed with each respective upper transverse frame 1458 or lower transverse frame 1468, or each track 1484 can be a separate piece attached, fastened, connected, or otherwise affixed to each respective upper transverse frame 1458 or lower transverse frame 1468.

Wall assembly 1450 can further include a plurality of walls or caps to cover portions of support assembly 1452 and movable wall assembly 1454 to prevent access to internal locations of wall assembly 1450. For example, wall assembly 1450 can include a front wall such as front wall 330 shown in FIGS. 15 and 16 that can be fabricated from a strong, lightweight plastic, composite, or wood material. Though not shown in FIGS. 63-68, wall assembly 1450 can also include a top cap or cover that may be similar to, for example, top cap or cover 44 shown in FIGS. 1 and 2, which connects or attaches to one or more of the sub-components included in upper or top support frame 1456, such as one or more upper transverse frames 1458. Wall assembly 1450 can also include a back cap or cover (not shown) that may be similar to, for example, back cap or cover 46 shown in FIGS. 1 and 2, which connects or attaches to one or more of the subcomponents included in upper or top support frame 1456, lower or bottom support frame 1466, and/or vertically extending support frame assembly 1480, such as rear upper connecting frame 1460, rear, lower, connecting frame 1470, and/or vertical connecting frames 1482.

Vertically extending support frame assembly 1480 can further include an intermediate transverse frame 1486 that can be positioned at or near a vertically central location of each vertical connecting frame 1482, which can thus be approximately a mid-point of each vertical connecting frame 1482. More broadly, intermediate transverse frame 1486 can be positioned at a location that is directly between rear upper connecting frame 1460 and lower connecting frame 1470. Intermediate transverse frame 1486 can attach or connect to each vertical connecting frame 1482 by way of fasteners, welding, sintering, one or more brackets, and the like. Such attachment of intermediate transverse frame 1486 can be directly to each vertical connecting frame 1482.

Movable wall assembly 1454 can include a plurality of front wall supports 1494 to which a front wall, such as front wall 330 shown in FIGS. 15 and 16, is attached. Such attachment of the front wall to each front wall support 1494 can be by way of a fastener, brackets, and other attachment devices. Movable wall assembly 1454 can also include a plurality of transverse front wall supports 1532, such as is shown in FIG. 21.

Transverse front wall supports 1532 can extend approximately perpendicularly to front wall supports 1494, and connect front wall supports 1494 to each other to provide strength to front wall supports 1494. The attachment of transverse front wall supports 1532 to front wall supports 1494 can be by, for example, welding, fasteners, brackets, adhesives, and other fastening apparatus and methods. Transverse front wall supports 1532 can be positioned vertically along front wall supports 1494 in a first, lower or bottom location that is closer to a bottom end of front wall supports 1494 than to a top end, which is also close to lower or bottom support frame 1466. Transverse front wall supports 1532 can also be positioned vertically along front wall supports 1494 in a second, upper or top location that is closer to a top end of front wall supports than to a bottom end, which is also close to upper or top support frame 1456. Transverse front wall supports 1532 can also be positioned at or near a mid-point of the plurality of front wall supports 1494, which is a location that is directly between transverse front wall supports 1532 that are located near a top of the plurality of front wall supports 1494 and transverse front wall supports 1532 that are located near a bottom of the plurality of front wall supports 1494. It should be understood that because a front wall, such as front wall 330 disclosed elsewhere herein, provides strength to movable wall assembly 1454, the number of transverse front wall supports 1532 can be more or less than the number disclosed herein depending on the strength of the front wall.

For example, in an exemplary embodiment the top transverse wall supports 1532 can be shifted downwardly away from the top end of front wall supports 1494 and the bottom transverse wall supports 1532 can be shifted upwardly away from the bottom end of front wall supports 1494, and in this configuration only four transverse wall supports 1532 are part of a movable wall assembly. In yet another exemplary embodiment, the two transverse wall supports 1532 near the mid-point of front wall supports 1494 can be shifted upwardly or downwardly, and additional transverse wall supports 1532 can be added in the space provided by the shifting of the transverse wall supports. It should be understood that transverse wall supports 1532 can be approximately equally spaced from each other, or the distances between transverse wall supports 1532 can be different to modify weight distribution and thus the movement responsiveness of an upper or lower part of movable wall assembly 1454.

Each front wall support 1494, the rightmost of which is shown partially cutaway in FIG. 63, includes at least one interior cavity 1502. Interior cavity 1502 can be in the form of a cylinder, a rectangle, or a square. Thus, interior cavity 1502 can be defined by a diameter, a width and a length, or other dimensions that define the size and shape of interior cavity 1502. Each transverse front wall support 1532, three of which are shown partially cutaway in FIG. 63, includes at least one interior cavity 1488. Each interior cavity 1488 can be in the form of a cylinder, rectangle, or a square. Thus, each interior cavity 1488 can be defined by a diameter, a width and a length, or other dimensions that define the size and shape of interior cavity 1488.

As can be seen in, for example, FIG. 63, there can be three front wall supports 1494. These three front wall supports 1494, when viewed from a movable wall side of wall assembly 1450, can be described as a left front wall support 1494, a right front wall support 1494, and a middle front wall support 1494. Each of left front wall support 1494 and right front wall support 1494 include a plurality of lateral or transverse interface supports 1490 attached thereto. Each of the plurality of lateral or transverse interface supports 1490 is oriented at an angle that is approximately perpendicular to a respective front wall support 1494 to which each lateral or transverse interface supports 1490 is attached. It should be understood that attachment of each lateral or transverse interface supports 1490 to a respective front wall support 1494 can be by, for example, welding, fasteners and brackets (not shown), or other attachment devices and mechanisms. In addition, lateral or transverse interface supports 1490 can be integrally formed with the respective front wall support 1494.

It should be understood that each lateral or transverse interface support 1490 is oriented to be approximately parallel to a the ground or a ground plane, particular since each front wall support 1494 can be oriented to be approximately perpendicular to the ground or a ground plane. In addition, each lateral or transverse interface support 1490 extending from left front wall support 1494 extends to a right of left front wall support 1494 when viewing wall assembly 1450 from a front or movable wall assembly 1454 side of wall assembly 1450, and each lateral or transverse interface support 1490 extending from right front wall support 1494 extends to a left of right front wall support 1494 when viewing wall assembly 1450 from a front or movable wall assembly 1454 side of wall assembly 1450.

Each front wall support 1494 can further support an upper wheel assembly 1496. Each upper wheel assembly 1496 is sized and dimensioned to ride along a respective track 1484. Wheel assembly 1496 is described as "upper" because each wheel assembly 1496 is positioned at a location that is vertically spaced or separated from, for example, lower or bottom support frame 1466, which is configured to be positioned on base 16 (e.g., see FIGS. 1 and 2) or on an edge or periphery of activity surface 60, disclosed elsewhere herein.

Each upper wheel assembly 1496 can include a wheel assembly support 1498, a support shaft 1500 positioned in wheel assembly support 1498, and one or more wheels 1501 rotatably positioned on support shaft 1500. Each wheel assembly support 1498 includes an exterior surface 1504 that is approximately a same shape as an interior wall 1506 of front wall supports 1494, with a clearance or gap 1508 between interior wall 1506 and exterior surface 1504. Clearance or gap 1508, which in an exemplary embodiment can be in a range from, for example, 0.02 inches to 0.10 inches, enables relatively easy sliding movement between front wall support 1494 and a respective wheel assembly support 1498, as disclosed in more detail hereinbelow.

Each lateral or transverse interface support 1490 includes an exterior surface 1544 that is approximately a same shape as an interior wall or surface 1546 transverse front wall supports 1532, with a clearance or gap 1548 between interior wall 1546 and exterior surface 1544. Clearance or gap 1548, which in an exemplary embodiment can be in a range from, for example, 0.02 inches to 0.10 inches, enables relatively easy sliding movement between front wall support 1494 and a respective lateral or transverse interface support 1490, as disclosed in more detail hereinbelow.

Each front wall support 1494 can further support a lower wheel assembly 1510. Each lower wheel assembly 1510 is sized and dimensioned to ride along respective track 1484. Wheel assembly 1510 is described as "lower" because each wheel assembly 1510 is positioned at a location that is vertically closer to the ground than, for example, upper wheel assembly 1496. In addition, lower wheel assembly 1510 would typically be adjacent to, next to, close to, alongside, near to, or in proximity to base 16, as well as lower or bottom support frame 1466.

Each lower wheel assembly 1510 can include a wheel assembly support 1512, an axle or shaft support 1528 attached to formed as a part of wheel assembly support 1512, a wheel support shaft 1514 positioned in axle or shaft support 1528, and one or more wheels 1516 rotatably positioned on support shaft 1514. Each wheel assembly support 1512 includes an exterior surface 1518 that is approximately a same shape as interior wall 1506 of front wall supports 1494. However, the outer dimensions of each wheel assembly support 1512 are larger than the interior dimensions of interior wall 1506 of front wall supports 1494. Thus, mating of each lower wheel assembly 1510 with a respective front wall support 1494 can be an interference or friction fit to minimize relative movement or motion between lower wheel assembly 1510 and respective front wall support 1494. Except as otherwise described, the features and description of FIG. 20 are applicable to similar features of the embodiment of FIGS. 63-68.

Track 1484 can be formed at least partially or entirely within lower transverse frame 1468. Lower transverse frame 1468 can be formed as an extrusion, by stamping, by welding separate pieces together, or by other techniques. Lower transverse frame 1468 can include an opening 1520 at each end, and wheel assembly 1510 can be inserted or positioned in track 1484 by way of opening 1520. After insertion of wheel assembly 1510, front, lower connecting frame 1474 can be attached to lower transverse frame 1468 to cover opening 1520 and to prevent removal of wheel assembly 1510.

Lower transverse frame 1468 can also include an opening 1522 that extends from end 1478 to end 1476 of lower transverse frame 1468 to enable wheel assembly support 1512 to extend from an exterior of lower transverse frame 1468 to an interior of lower transverse frame 1468. Opening 1522 is formed by a pair of lips 1524 that extend toward each other to capture wheels 1516 within track 1484 during operation. Wheels 1516 can ride on an interior surface 1526 of lower transverse frame 1468 as movable wall assembly 1454 is deflected by force against movable wall assembly 1454. As can be seen in FIG. 63, lower wheel assembly 1510 can include axle or shaft support 1528 that extends away from front wall support 1494. Axle support 1528 includes an opening that can be similar to opening 430 shown in FIG. 20 that is approximately perpendicular to a longitudinal axis of axle support 1528. Opening 430 can extend entirely through axle support 1528, and support shaft 1514 extends through opening 430 so that wheel support shaft 1514 is engaged to axle support 1528. In an exemplary embodiment, axle support 1528 can include a bearing to support wheel support shaft 1514. By extending wheel support shaft 1514 through axle support 1528, movable wall assembly 1454 is supported by a plurality of wheels 1516 located in a plurality of tracks 1484. It should be apparent that movable wall assembly 1454 is thus supported within support assembly 1452 by wheels 1516, and wheel 1516 supports support shafts 1514, which support axle supports 1528, which support front walls supports 1494, along with a front wall such as front wall 330, along with the other elements of movable wall assembly 1454.

Upper transverse frame 1458 can also include an opening 1534 that extends from end 1472 to end 1462 of upper transverse frame 1458 to enable wheel assembly support 1498 to extend from an exterior of upper transverse frame 1458 to an interior of upper transverse frame 1458. Opening 1534 is formed by a pair of lips 1536 that extend toward each other to capture wheels 1516 within track 1484 during operation. Upper transverse frame 1458 also includes an upper interior surface 1538 and a lower interior surface 1540 formed on an upper side of each of lips 1536. It should be understood that each wheel assembly support 1498 "floats" within respective front wall support 1494. Thus, when movable wall assembly 1454 deflects as shown in FIG. 18 due to a force F applied to movable wall assembly 1454, the contact between wheels 1516 and lower interior surface 1540 of respective upper transverse frame 1458 prevents wheels 1516 from moving downwardly as respective front wall support 1494 moves away from respective transverse frame 1458, and respective front wall support 1494 slides along wheel assembly support 1498 during movement away from respective transverse frame 1458. During this motion, due to the force of gravity and/or the friction between wheel assembly support 1498 and respective transverse frame 1458, wheels 1516 connected to wheel assembly support 1498 will contact and roll along lower interior surface 1540.

Figure 66:
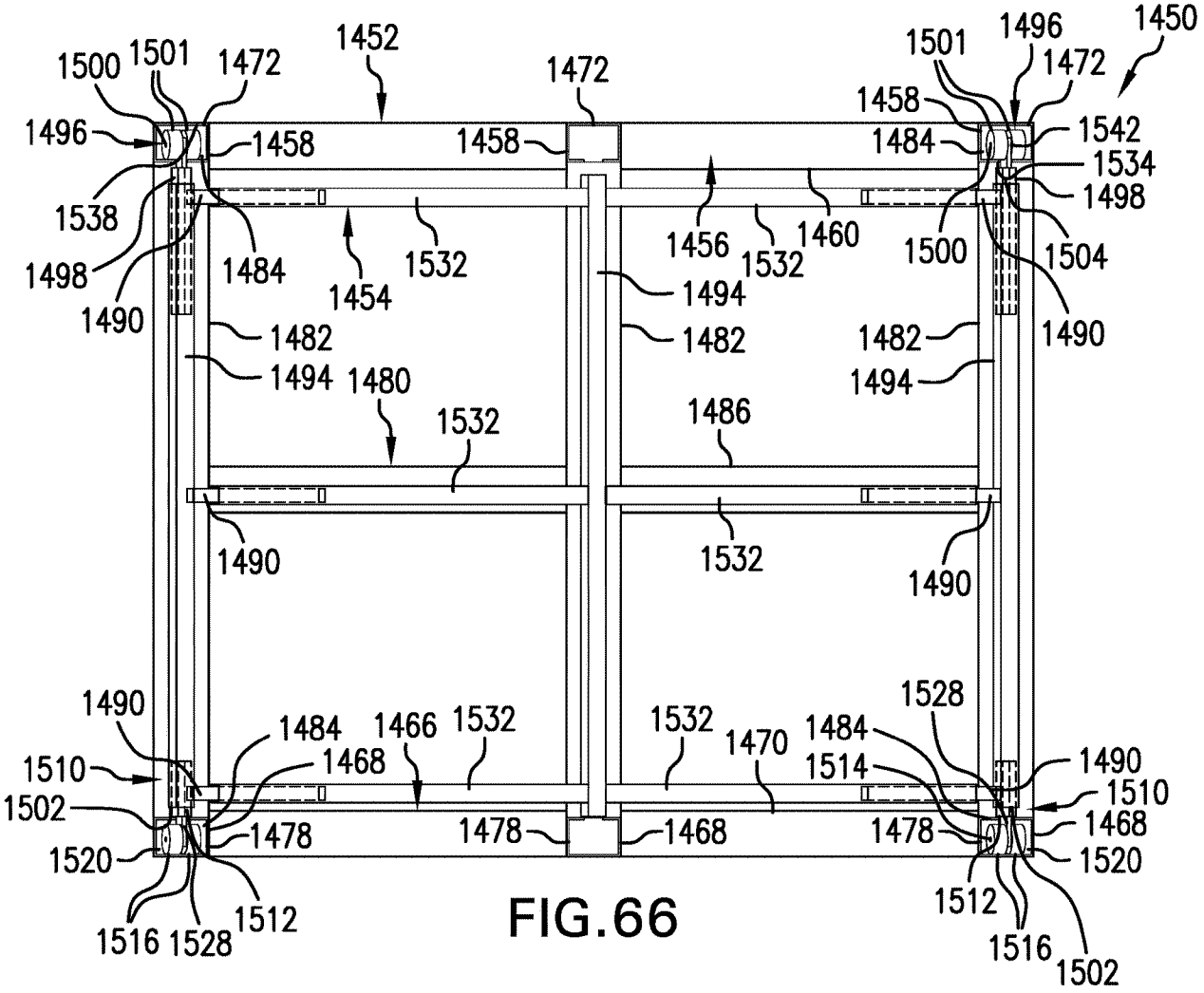
FIG. 66 shows a view of the wall assembly of FIG. 63 after deflection by a force.
Figure 67:
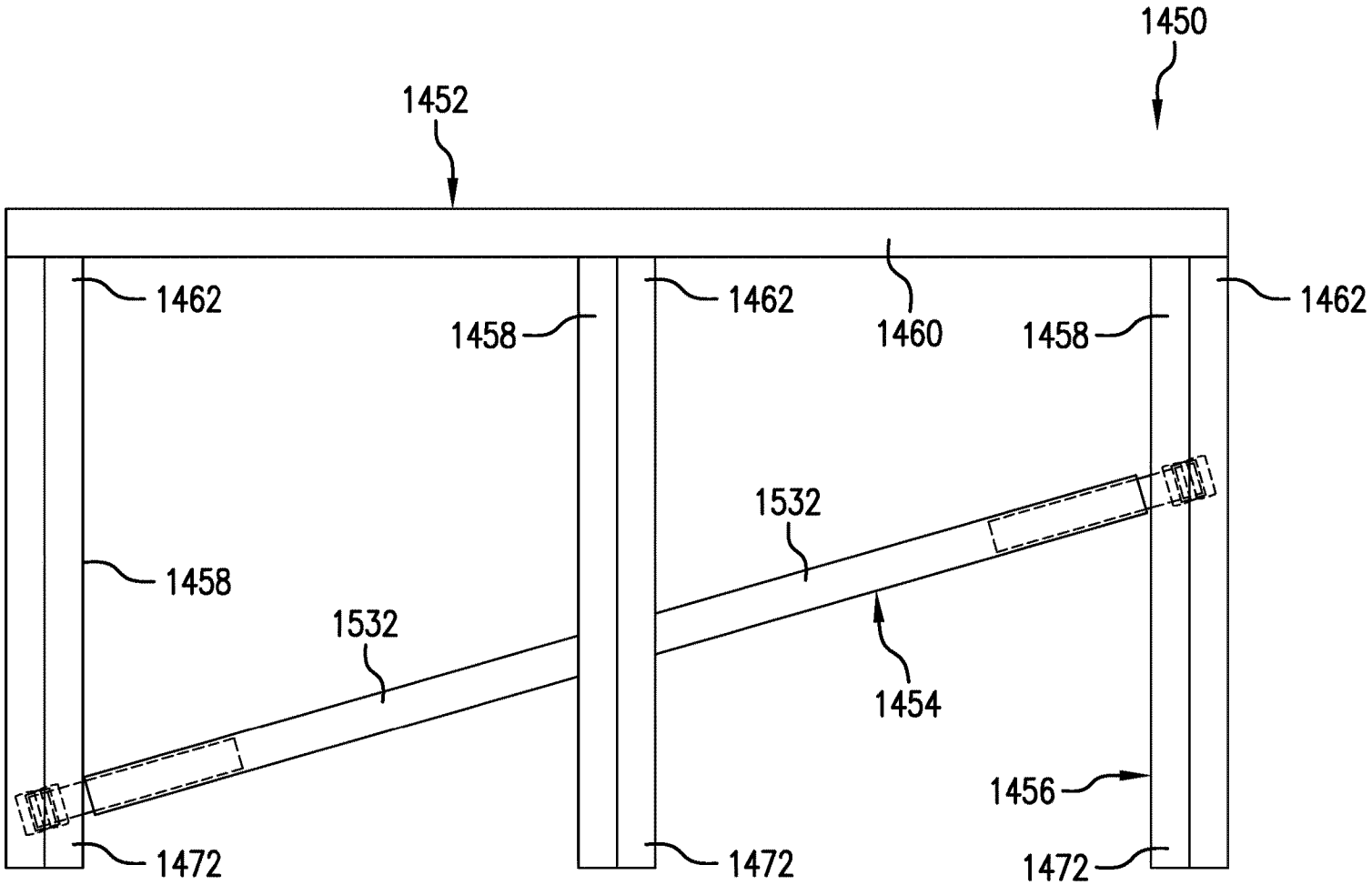
FIG. 67 shows another view of the deflected wall assembly of FIG. 66.
Figure 68:
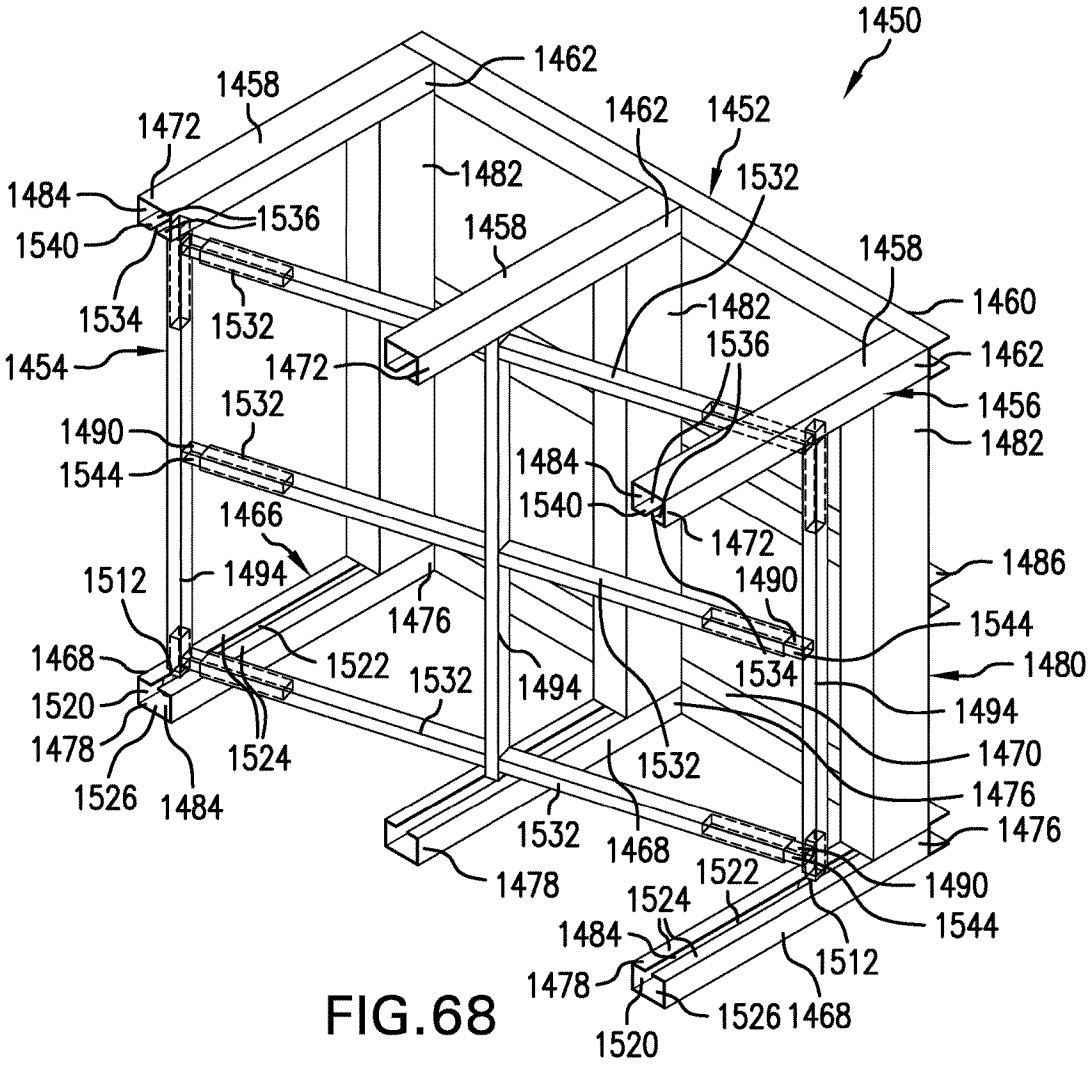
FIG. 68 shows a perspective view of the deflected wall assembly of FIG. 66.

After force F is removed, shock absorbers, which are not shown in FIGS. 63-68, but which are shown elsewhere herein, restore movable wall assembly 1454 from the deflected position shown in FIGS. 66-68 to the un-deflected position shown in FIGS. 63-65. As movable wall assembly 1454 returns to the un-deflected position near a front side of wall assembly 1450 that is adjacent to activity surface 60, movable wall assembly 1454 moves from the angled orientation shown in FIGS. 66-68 to the orientation shown in FIGS. 63-65. As movable wall assembly 1454 returns to the vertical orientation, the upper or top end of each front wall support 1494 moves toward the respective upper transverse frame 1458. As front wall support 1494 moves toward upper transverse frame 1458, upper wheel assembly 1496 can move upwardly due to friction between wheel assembly support 1498 and front wall support 1494. Thus, as movable wall assembly 1454 moves from the position shown in FIGS. 66-68 to the position shown in FIGS. 63-65, wheels 1516 positioned in upper transverse frame 1458 can move upwardly to contact and roll along upper interior surface 1538 of upper transverse frame 1458. Also as movable wall assembly 1454 moves from the position shown in FIGS. 66-68 to the position shown in FIGS. 63-65, wheel assembly support 1498 can no longer move upwardly due to the contact between wheels 1516 and upper interior surface 1538. Accordingly, front wall support 1494 slides along exterior surface 1504 of wheel assembly support 1498 to decrease the portion of wheel assembly support 1498 that extends outside front wall support 1494. The relative movement of upper wheel assembly 1496 as it extends with respect to front wall support 1494 can be described as "telescoping," since one element moves into and out from the other element. More specifically, wheel assembly support 1498 telescopes with respect to wall support 1494. As shown in FIGS. 63-68, wheel assembly support 1498 telescopes or extends outwardly or away from wall support 1494 as wall assembly 1454 deflects from a first position shown in FIGS. 63-65 to a second position, such as that shown in FIGS. 66-68.

In the embodiment of FIGS. 63-68, wheel 1501 and/or wheel assembly support 1498, in addition to moving vertically with respect to respective front wall support 1494, is configured to move transversely with respect to movable wall assembly 1454 during deflection of movable wall assembly 1454 as movable wall assembly 1454 deflects from the first position to the second position. In the context of FIGS. 63-68, transversely is in a direction that is approximately parallel to a front wall of movable wall assembly 1454. As movable wall assembly 1454 moves from the first position to the second position, the left side or the right side of movable wall assembly 1454 may not deflect a same amount. Accordingly, a situation exists where friction between wheels 1501 and/or wheels 1516 and tracks 1484 increases as one of the left side and the right side deflects an increasingly greater amount than the other of the left side and the right side.

The embodiment of FIGS. 63-68 minimizes an increase in friction by permitting each lateral or transverse interface support 1490 to slidingly move away from respective transverse front wall support 1494 because each lateral or transverse interface support 1490 is configured to slide within interior cavity 1488, thus extending or telescoping from respective transverse front wall support 1494. Thus, as movable wall assembly 1454 deflects at complex angles in three dimensions, wheel assembly support 1498 and lateral or transverse interface supports 1490 are configured to extend varying amounts to prevent binding of movable wall assembly 1454 within support assembly 1452. The prevention of binding is accomplished because each lateral or transverse interface support 1490 is configured to move or extend an amount consistent with deflection at that location, and wheel assembly support 1498 telescopes or extends an amount consistent with angular deflection of movable wall assembly 1454 with respect to the vertical. As with other embodiments, shock absorbers, disclosed in other embodiments but removed from the embodiment of FIGS. 63-68 for clarity of explanation, restore movable wall assembly 1454 to the undeflected first position shown in FIGS. 63-65 after a deflecting force F is removed from movable wall assembly 1454. As movable wall assembly 1454 moves from the second, deflected position shown in FIGS. 66-68 to the first, undeflected position shown in FIGS. 63-65, lateral or transverse interface support 1490 moves back into interior cavity 1502 of front wall support 1494 and lateral or transverse interface support 1490 moves back into respective interior cavity 1488 of respective transverse front wall support 1532.

It should be apparent that the weight and materials of movable wall assembly 1454 are preferably the weight and materials described elsewhere herein with respect to other embodiments. It should also be apparent that embodiment of FIGS. 63-68 is combinable with other, similar configurations described herein to provide the advantages of this embodiment. It should also be apparent that other configurations than that disclosed with respect to FIGS. 63-68 can provide the transverse motion described in the embodiment of FIGS. 63-68.

As can be seen in, for example, FIG. 66, upper wheel assembly 1496 can include an axle or shaft support 1542 that extends upwardly away from front wall support 1494. Axle support 1542 includes an opening similar to opening 430 disclosed elsewhere herein that is approximately perpendicular to a longitudinal axis of axle support 1542. Similar to opening 430, the opening in axle support 1542 can extend entirely through axle support 1542, and support shaft 1500 extends through the opening in axle support 1542 so that wheel support shaft 1500 is engaged to axle support 1542. In an exemplary embodiment, axle support 1542 can include a bearing to support wheel support shaft 1500. By extending wheel support shaft 1500 through axle support 1542, the upper portion of movable wall assembly 1454 is positioned by the plurality of wheels 1501 located in the plurality of tracks 1484 located above movable wall assembly 1454.

Except as otherwise noted herein, the terms generally parallel, approximately parallel, generally perpendicular, approximately perpendicular, generally vertical, approximately vertical, generally horizontal, and approximately horizontal, are preferably in the range of plus or minus 5 degrees from nominally parallel, perpendicular, vertical, and horizontal, are more preferably in the range of plus or minus 3 degrees from nominally parallel, perpendicular, vertical, and horizontal, are even more preferably in the range of plus or minus 1 degree from nominally parallel, perpendicular, vertical, and horizontal, and are most preferably in the range of plus or minus 0.5 degrees from nominally parallel, perpendicular, vertical, and horizontal.

It should be understood from the description herein that elements of the disclosed embodiments, such as ramps, sliders, hinges, springs, etc., are positioned on or in a wall assembly. It should also be understood that various embodiments can be combined to produce one single embodiment. For example, an embodiment can include combining the features of the first and second embodiments, which function independently, to a produce a single embodiment that more abundantly reduces the risk of injury for participants colliding with a wall assembly.

It should further be understood that any parts of any embodiments, or any modifications thereof, can be combined to produce one single embodiment, and for sake of brevity these combinations of embodiments were not repeated in the disclosure.

While various embodiments of the disclosure have been shown and described, it is understood that these embodiments are not limited thereto. The embodiments can be changed, modified, and further applied by those skilled in the art. Therefore, these embodiments are not limited to the detail shown and described previously, but also include all such changes and modifications.

What is claimed is:

1. A wall assembly, comprising:

a support assembly;

a vertically extending transparent shield fixedly attached to an upper end of the support assembly;

a movable wall assembly;

a plurality of shock absorbers positioned between the support assembly and the movable wall assembly, each of the plurality of shock absorbers stores energy when a force is exerted upon the movable wall assembly by an object such that the movable wall assembly moves from a first position to one of a plurality of second positions to cause deceleration of the object over a distance, and the plurality of shock absorbers move the movable wall assembly from the one of the plurality of second positions to the first position by releasing energy when the force is removed.

2. The wall assembly of claim 1, wherein the support assembly includes a groove, and the movable wall assembly includes a vertical plate, and the vertical plate is sized and dimensioned to extend into the groove, and the vertical plate is guided by the groove during movement of the movable wall assembly.

3. The wall assembly of claim 2, including a horizontal plate positioned directly between the groove and the movable wall assembly, the horizontal plate including an opening sized and dimensioned for the vertical plate to extend through the opening and into the groove.

4. The wall assembly of claim 2, wherein the vertical plate is attached at a first end to the movable wall assembly and at least one carriage wheel is attached to a second, opposite end of the plate, and the support assembly includes a carriage track that guides the carriage wheels during movement of the movable wall assembly.

5. The wall assembly of claim 1, including a plurality of hinge assemblies positioned to attach the movable wall assembly to the support assembly, and movement of the wall from the first position to the second position includes a rotation about the plurality of hinge assemblies.

6. The wall assembly of claim 1, wherein the shock absorbers have a spring constant of approximately 8 lb./inch.

7. The wall assembly of claim 1, wherein the movable wall assembly is configured to move from the first position to the second position in a distance having a range of up to at least 8 inches.

8. The wall assembly of claim 1, wherein the movable wall assembly is configured to move from the first position to the second position in distance having a range of up to at least 12 inches.

9. The wall assembly of claim 1, wherein the support assembly is positioned on a rocker having a curvilinear surface, and when a force is applied to the support assembly, the applied force causes the support assembly to move from a first position along the curvilinear surface to one of a plurality of second positions that causes a tilt to the support assembly.

10. The wall assembly of claim 9, further including a cable secured to the support assembly, and when the force applied to the support assembly is removed, a bias force from the cable moves the support assembly from the one of a plurality of second positions to the first position.

11. The wall assembly of claim 1, further including a base, a friction modifying element positioned on the base and movable with respect to the base when the force is exerted upon the wall assembly by an object such that the wall assembly moves from a first position to one of a plurality of second positions to cause deceleration of the object over a distance, and the wall assembly is biased to move from the one of the plurality of second positions to the first position when the force is removed.

12. The wall assembly of claim 1, wherein the support assembly includes a vertically extending support frame assembly and a plurality of upper transverse frames, and the plurality of upper transverse frames are movably secured to the support frame assembly such that when the force is applied to at least one of the plurality of upper transverse frames, the upper transverse frames move with respect to the vertically extending support frame assembly.

13. The wall assembly of claim 12, further including a compression spring positioned between a respective one of the plurality of upper transverse frames and the vertically extending support frame assembly, the compression spring secured to the vertically extending support frame assembly, and movement of the respective one of the plurality of upper transverse frames from a first position to a one of a plurality of second positions caused by the force compresses the spring, and when the force is removed, the spring moves the one of the plurality of upper transverse frames from the one of the plurality of second positions to the first position.

14. The wall assembly of claim 1, wherein the movable wall assembly weighs a maximum of 50 pounds.

15. The wall assembly of claim 1, wherein the movable wall assembly includes a front wall panel formed of fiber reinforced polyethylene.

16. The wall assembly of claim 15, wherein the polyethylene is a high density polyethylene.

17. The wall assembly of claim 15, wherein fiber of the fiber reinforced polyethylene is approximately 0.05 inches thick.

18. A wall assembly, comprising:

a base;

a friction modifying element positioned on the base;

a movable wall assembly having a front surface and a side opposite from the front surface, the movable wall assembly positioned on the friction modifying element and movable with respect to the base when a force is exerted upon the front surface of the movable wall assembly by an object such that the movable wall assembly moves from a first position to one of a plurality of second positions to cause deceleration of the object over a distance;

a first shock absorber attached to the movable wall assembly on the side of the movable wall assembly opposite from the front surface, the attachment being at a first spaced distance from the base; and a second shock absorber attached to a same side of the movable wall assembly as the first shock absorber, the attachment being at a second spaced distance from the base, the second spaced distance being greater than the first spaced distance, and the first shock absorber and the second shock absorber apply a force to the movable wall assembly to move the movable wall assembly from the one of the plurality of second positions to the first position when the force is removed.

19. The wall assembly of claim 18, wherein a front top surface of the base is positioned approximately even with or below a level of a playing or activity surface.

20. The wall assembly of claim 18, wherein a bottom surface of the movable wall assembly includes an inclined plane, and a top surface of the base is a mating inclined plane, and the movable wall assembly moves along the top surface of the base in moving from the first position to the second position.

21. The wall assembly of claim 18, wherein the friction modifying element includes one of rollers and sliders.

22. The wall assembly according to claim 18, wherein the one of rollers and sliders include at least one of a bronze, a brass, PTFE, and a nylon material.

23. The wall assembly according to claim 18, wherein the friction modifying element includes self-contained ball bearings.

24. The wall assembly of claim 18, wherein the movable wall assembly weighs a maximum of 50 pounds.

25. The wall assembly of claim 18, wherein the movable wall assembly includes a front wall panel formed of fiber reinforced polyethylene.

26. The wall assembly of claim 25, wherein the polyethylene is a high density polyethylene.

27. The wall assembly of claim 25, wherein fiber of the fiber reinforced polyethylene is approximately 0.05 inches thick.

28. A wall assembly, comprising:

a fixed base;

a moveable wall assembly, the moveable wall assembly including a base interface that includes a curvilinear surface positioned directly on the fixed base; and a plurality of shock absorbers positioned between the fixed base and the moveable wall assembly, wherein when a force is applied to the moveable wall assembly, the moveable wall assembly moves, moving the curvilinear surface along the fixed base from a first position to one of a plurality of second positions, storing energy in the plurality of shock absorbers, and when the force is removed from the moveable wall assembly, the stored energy in the plurality of shock absorbers moves the moveable wall assembly from the one of the plurality of second positions to the first position.

29. The wall assembly of claim 28, wherein the moveable wall assembly is secured to the fixed base by the engagement of a pin attached to the moveable wall assembly with a channel guide secured to the fixed base, the channel guide having a slot or channel formed therein for engagement to the pin.

30. The wall assembly of claim 28, wherein the shock absorbers are a plurality of springs.

31. The wall assembly of claim 28, wherein the movable wall assembly weighs a maximum of 50 pounds.

32. The wall assembly of claim 28, wherein the movable wall assembly includes a front wall panel formed of fiber reinforced polyethylene.

33. The wall assembly of claim 32, wherein the polyethylene is a high density polyethylene.

34. The wall assembly of claim 32, wherein fiber of the fiber reinforced polyethylene is approximately 0.05 inches thick.

* * * * *